US008917410B2

(12) United States Patent
Nakayama et al.

(10) Patent No.: US 8,917,410 B2
(45) Date of Patent: Dec. 23, 2014

(54) IMAGE FORMING SYSTEM, IMAGE FORMING APPARATUS AND PRINT SERVER

(75) Inventors: Toru Nakayama, Osaka (JP); Yoshiteru Nishikawa, Osaka (JP); Kozo Tao, Osaka (JP); Hiromi Yamagami, Osaka (JP); Norifumi Miyahara, Osaka (JP); Ryuichi Ishizu, Osaka (JP); Shinichi Hashimoto, Osaka (JP); Naoki Takeuchi, Osaka (JP)

(73) Assignee: Kyocera Document Solutions, Inc. (JP)

( * ) Notice: Subject to any disclaimer, the term of this patent is extended or adjusted under 35 U.S.C. 154(b) by 688 days.

(21) Appl. No.: 12/424,425

(22) Filed: Apr. 15, 2009

(65) Prior Publication Data

US 2009/0261524 A1 Oct. 22, 2009

(30) Foreign Application Priority Data

| | | |
|---|---|---|
| Apr. 18, 2008 | (JP) | 2008-109638 |
| Apr. 18, 2008 | (JP) | 2008-109639 |
| Apr. 18, 2008 | (JP) | 2008-109640 |
| Apr. 18, 2008 | (JP) | 2008-109641 |
| Apr. 18, 2008 | (JP) | 2008-109642 |
| Apr. 18, 2008 | (JP) | 2008-109643 |
| Apr. 18, 2008 | (JP) | 2008-109644 |
| Apr. 18, 2008 | (JP) | 2008-109645 |
| Apr. 18, 2008 | (JP) | 2008-109646 |
| Apr. 18, 2008 | (JP) | 2008-109647 |

(51) Int. Cl.

| | |
|---|---|
| ***B65H 5/26*** | (2006.01) |
| ***H04L 9/32*** | (2006.01) |
| ***B65H 3/44*** | (2006.01) |
| ***B65H 7/04*** | (2006.01) |

(52) U.S. Cl.

CPC .. *B65H 3/44* (2013.01); *B65H 7/04* (2013.01); *B65H 2511/10* (2013.01); *B65H 2511/216* (2013.01); *B65H 2511/515* (2013.01); *B65H 2513/42* (2013.01); *B65H 2551/20* (2013.01); *B65H 2557/64* (2013.01); *B65H 2801/06* (2013.01)

USPC ..... 358/1.15; 358/1.1; 271/3.141; 271/9.01; 726/19

(58) Field of Classification Search

CPC ..... B65H 2220/02; B65H 2220/03; B65H 2511/10; B65H 2511/216; B65H 2511/515; B65H 2513/42; B65H 2551/20; B65H 2220/01; B65H 2557/64; B65H 2801/06; B65H 3/44; B65H 7/04

USPC ..... 358/1.15, 1.12; 726/19; 271/3.14, 9.01

See application file for complete search history.

(56) References Cited

U.S. PATENT DOCUMENTS 6,748,183 B2 * 6/2004 Edmonds ..... 399/23
2002/0171681 A1 11/2002 Nomura (Continued)

FOREIGN PATENT DOCUMENTS

JP H02-186429 7/1990
JP H03-288741 12/1991

(Continued)

OTHER PUBLICATIONS

English translation for JP2003280876.*

*Primary Examiner* — King Poon
*Assistant Examiner* — Iriana Cruz

(57) ABSTRACT

An image forming apparatus has: pluralities of sheet storage units; a printing unit; a sheet driving unit that feeds a sheet of paper from the sheet storage units to the printing unit; a group setting maintaining unit that forms a group of the sheet storage units; a residual sheet amount detecting unit that detects sheet empty on any of the sheet storage units in the group; a sheet storage switching control unit that controls the sheet driving unit to select another one of the sheet storage units in the same group for feeding a sheet, if the residual sheet amount detecting unit detects the sheet empty; and a sheet empty warning unit that warns a user of the sheet empty detected by the residual sheet amount detecting unit.

2 Claims, 35 Drawing Sheets

(56) References Cited

U.S. PATENT DOCUMENTS

| | | | | |
|---|---|---|---|---|
| 2005/0104272 | A1 | 5/2005 | Watanabe et al. | |
| 2006/0240803 | A1 * | 10/2006 | Valeriano et al. | 455/412.1 |
| 2009/0073471 | A1 * | 3/2009 | Komiyama et al. | 358/1.9 |

FOREIGN PATENT DOCUMENTS

| | | | | |
|---|---|---|---|---|
| JP | H07-033318 | | 2/1995 | |
| JP | H 08-009096 | | 1/1996 | |
| JP | H 11-116101 | | 4/1999 | |
| JP | H 11-180009 | | 7/1999 | |
| JP | 2002-087614 | | 3/2002 | |
| JP | 2002-344682 | | 11/2002 | |
| JP | 2003280876 | * | 2/2003 | G06F 3/12 |
| JP | 2004-251971 | | 9/2004 | |
| JP | 2005-008360 | | 1/2005 | |
| JP | 2005-145624 | | 6/2005 | |
| JP | 2005-157334 | | 6/2005 | |
| JP | 2005-161748 | | 6/2005 | |
| JP | 2007-076868 | * | 3/2007 | G03G 15/00 |
| JP | 2007-76868 | | 3/2007 | |

* cited by examiner

FIG. 22A

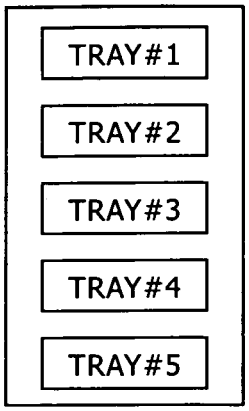

TO SPECIFY TRAY#1:
USE TRAY#1 SPECIFYING COMMAND

TO SPECIFY TRAY#2:
USE TRAY#2 SPECIFYING COMMAND

TO SPECIFY TRAY#3:
USE TRAY#3 SPECIFYING COMMAND

TO SPECIFY TRAY#4:
USE TRAY#4 SPECIFYING COMMAND

TO SPECIFY TRAY#5:
USE TRAY#5 SPECIFYING COMMAND

FIG. 22B

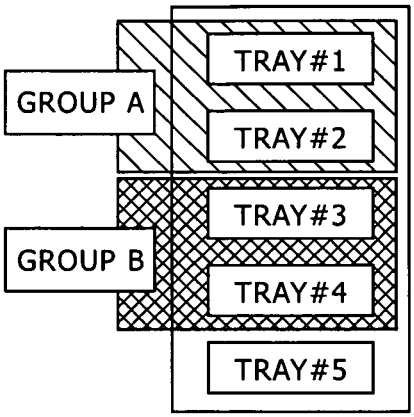

TO SPECIFY TRAY#1:
USE TRAYS#1,#2 SPECIFYING COMMAND

TO SPECIFY TRAY#2:
USE TRAYS#1,#2 SPECIFYING COMMAND

TO SPECIFY TRAY#3:
USE TRAYS#3,#4 SPECIFYING COMMAND

TO SPECIFY TRAY#4:
USE TRAYS#3,#4 SPECIFYING COMMAND

TO SPECIFY TRAY#5:
USE TRAY#5 SPECIFYING COMMAND

FIG. 22C

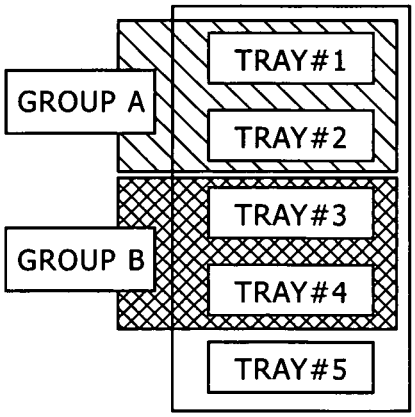

TO SPECIFY TRAY#1:
USE TRAY#1 SPECIFYING COMMAND

TO SPECIFY TRAY#2:
USE TRAY#1 SPECIFYING COMMAND

TO SPECIFY TRAY#3:
USE TRAY#2 SPECIFYING COMMAND

TO SPECIFY TRAY#4:
USE TRAY#2 SPECIFYING COMMAND

TO SPECIFY TRAY#5:
USE TRAY#3 SPECIFYING COMMAND

FIG. 22D

| SPECIFIED TRAY | CORRESPONDING TRAY |
|---|---|
| 1 | 1,2 |
| 2 | 3,4 |
| 3 | 5 |

IMAGE FORMING SYSTEM, IMAGE FORMING APPARATUS AND PRINT SERVER

CROSS-REFERENCE TO RELATED APPLICATIONS

This application relates to and claims priority rights from Japanese Patent Applications:

No. 2008-109647, filed on Apr. 18, 2008,
No. 2008-109641, filed on Apr. 18, 2008,
No. 2008-109645, filed on Apr. 18, 2008,
No. 2008-109639, filed on Apr. 18, 2008,
No. 2008-109644, filed on Apr. 18, 2008,
No. 2008-109646, filed on Apr. 18, 2008,
No. 2008-109643, filed on Apr. 18, 2008,
No. 2008-109640, filed on Apr. 18, 2008,
No. 2008-109642, filed on Apr. 18, 2008, and
No. 2008-109638, filed on Apr. 18, 2008, the entire disclosures of which are hereby incorporated by reference herein.

BACKGROUND OF THE INVENTION

1. Field of the Invention

This invention relates to image forming system, image forming apparatus and print server.

2. Description of the Related Art (First technique) In an image forming apparatus that has pluralities of sheet storage units such as sheet cassettes and a manual sheet feeding tray, the sheet storage units are divided to groups according to sheet size, sheet type, and so on. For example, sheet feeding trays are handled as a group, and a status of the group is indicated according to states of the sheet feeding trays.

(Second technique) An image forming apparatus has a section management system that records and maintains respective numbers of sheets consumed by user sections. The section management system has section codes and limit numbers of consumed sheets of the sections in advance, and manages the number of sheets consumed by each of the sections, and forbids printing by a section when the number of consumed sheet exceeds the limit number in the section.

SUMMARY OF THE INVENTION

The first technique has an advantage capable of indicating the total number of sheets stored in the sheet feeding trays belonging to the group. However, when all sheets in the sheet feeding tray belonging to the group are consumed, an error message of sheet empty is displayed, and printing is stopped. Afterwards, until sheets are supplied to the sheet feeding tray, the printing can not be resumed.

The first technique has an advantage capable of indicating the total number of sheets stored in the sheet feeding tray belonging to the group. However, a user has to set the group manually, since it is difficult to automatically set the group according to user's usage history without user's operations to set the group.

The second technique is not capable of making a regulation rule of each sheet storage unit for each of the sections. Further, a section code has to be input every time before printing.

In terms of forming the group, the first technique is capable of continuously printing on a sheet fed from another sheet storage unit (e.g. sheet feeding tray) in the same group when all sheets are consumed in a sheet storage unit. However, all sheet storage units in the group are positioned in only one image forming apparatus, and thus, the first technique can not form a group that contains respective sheet storage units in pluralities of image forming apparatuses.

In terms of forming the group, the first technique is capable of continuously printing on a sheet fed from another sheet storage unit in the same group when all sheets are consumed in a sheet storage unit. However, if a printer driver is restricted to use only specified sheet feeding trays, then printing can not be performed continuously on a sheet fed from not-specified sheet feeding tray. In addition, if the printer driver is not compatible with such grouping function, then the grouping function can not be used to perform printing continuously.

When sheet storage units in a group store sheets with different sheet attributions, the first technique continues to print on a sheet with a different sheet attribution, or simply cancels the group. In this way, the group is formed regardless of a sheet attribution.

In terms of forming the group, the first technique is capable of continuously printing on a sheet fed from another sheet storage unit (e.g. sheet feeding tray) in the same group when all sheets are consumed in a sheet storage unit. However, a user has to choose sheet storage units to be included into the group from all sheet storage units with a lot of work.

The first technique can assign a group of sheet storage units to a section of users, so that the users in the section only uses the sheet storage units in the group assigned to the section. However, the first technique can not include a sheet storage unit in each of two or more groups.

In terms of forming the group, the first technique is capable of continuously printing on a sheet fed from another sheet storage unit (e.g. sheet feeding tray) in the same group when all sheets are consumed in a sheet storage unit. However, all sheet storage units in the group are positioned in only one image forming apparatus, and therefore, the first technique can not form a group that contains respective sheet storage units in pluralities of image forming apparatuses.

The present invention solves these subjects as follows.

An image forming apparatus according to the first aspect of this invention has:

pluralities of sheet storage units;

a printing unit;

a sheet driving unit that feeds a sheet of paper from the sheet storage units to the printing unit;

a group setting maintaining unit that forms a group of the sheet storage units;

a residual sheet amount detecting unit that detects sheet empty on any of the sheet storage units in the group;

a sheet storage switching control unit that controls the sheet driving unit to select another one of the sheet storage units in the same group for feeding a sheet, if the residual sheet amount detecting unit detects the sheet empty; and a sheet empty warning unit that warns a user of the sheet empty detected by the residual sheet amount detecting unit.

An image forming apparatus according to the second aspect of this invention has:

pluralities of sheet storage units that store sheets of paper to be supplied;

a printing unit that receives a sheet from any of the sheet storage units and prints on the sheet;

a substitution record maintaining unit that receives an input for selecting a sheet storage unit to be substituted for a sheet storage unit in a sheet error, and maintains a record of the substitution, the sheet error indicating that a sheet can not be fed from the sheet storage unit;

an automatic group setting unit that automatically forms a group of the sheet storage units according to the record maintained by the substitution record maintaining unit; and a sheet storage switching control unit that substitutes another one of the sheet storage units in the group to feed a sheet for one of the sheet storage units in the group when a sheet error occurs in the one of the sheet storage units.

An image forming apparatus according to the third aspect of this invention has:

pluralities of sheet storage units;

a group setting unit that forms a group that at least one of the sheet storage units belongs to; and a section group managing unit that associates the group formed by the group setting unit with a section, and maintains a record of consuming sheets fed from a sheet storage unit in the group, and performs section management based on the record.

An image forming system according to the fourth aspect of this invention has pluralities of image forming apparatuses that are connected via electronic communication channels with each other, and print on sheets fed from sheet storage units and output the sheets by printing units.

In the system, each of the image forming apparatuses has:

a communication interface unit capable of connecting to the electronic communication channels;

a group managing unit that forms a group of the sheet storage units in the image forming apparatuses;

a residual sheet amount detecting unit that detects sheet empty on any of the sheet storage units;

a residual job generating unit that generates a print job to be executed by another one of the image forming apparatuses to perform a residual part of printing when the residual sheet amount detecting unit detects the sheet empty;

a job transmitting unit that transmits the print job to the another one of the image forming apparatuses via the communication interface unit;

a job receiving unit that receives a print job from another one of the image forming apparatuses via the communication interface unit; and a job executing unit that executes the received print job.

An image forming apparatus according to the fifth aspect of this invention has:

a sheet storage unit;

a printing unit that receives a sheet of paper from the sheet storage unit, and prints on the sheet;

a communication interface unit capable of connecting to another image forming apparatus via an electronic communication channel;

a residual sheet amount detecting unit that detects sheet empty on the sheet storage unit;

a residual job generating unit that generates a print job to be executed by another image forming apparatus to perform a residual part of printing when the residual sheet amount detecting unit detects the sheet empty;

a job transmitting unit that transmits the print job to the another image forming apparatus via the communication interface unit;

a job receiving unit that receives a print job from another image forming apparatus via the communication interface unit; and a job executing unit that executes the received print job.

An image forming apparatus according to the sixth aspect of this invention has:

pluralities of sheet storage units;

a printing unit;

a sheet driving unit that feeds a sheet of paper from the sheet storage units to the printing unit;

a group setting maintaining unit that forms a group of the sheet storage units;

a residual sheet amount detecting unit that detects sheet empty on any of the sheet storage units in the group; and a sheet storage switching control unit that controls the sheet driving unit to select another one of the sheet storage units in the same group for feeding a sheet, if the residual sheet amount detecting unit detects the sheet empty.

In this image forming apparatus, the sheet storage switching control unit controls the sheet driving unit to finally select one of the sheet storage units that has the maximum number of residual sheets in the same group.

An image forming apparatus according to the seventh aspect of this invention has:

pluralities of sheet storage units;

a printing unit;

a sheet driving unit that feeds a sheet of paper from the sheet storage units to the printing unit;

a command converting unit that converts a sheet storage unit specifying command in a print job to a command to specify one or more sheet storage units according to a conversion table that associates a sheet storage unit with one or more sheet storage units; and a sheet storage switching control unit that controls the sheet driving unit to feed a sheet from the sheet storage unit specified by the converted command.

An image forming apparatus according to the eighth aspect of this invention has:

pluralities of sheet storage units;

a printing unit;

a sheet driving unit that feeds a sheet of paper from the sheet storage units to the printing unit;

a group setting maintaining unit that forms a group of the sheet storage units;

a residual sheet amount detecting unit that detects sheet empty on any of the sheet storage units;

a sheet storage switching control unit that controls the sheet driving unit to select another one of the sheet storage units in the same group for feeding a sheet, if the residual sheet amount detecting unit detects the sheet empty;

a command analyzing unit that analyzes a print job, and determines whether or not the print job is compatible with a grouping function; and a command converting unit that converts a sheet storage specifying command in the print job to either a command to specify a group of sheet storage units or a command to specify a sheet storage unit in the group, if the command analyzing unit determines that the print job is not compatible with a grouping function.

An image forming apparatus according to the ninth aspect of this invention has:

pluralities of sheet storage units;

a printing unit;

a sheet driving unit that feeds a sheet of paper from the sheet storage units to the printing unit;

a group setting maintaining unit that forms a group of the sheet storage units;

a residual sheet amount detecting unit that detects sheet empty on any of the sheet storage units;

a sheet storage switching control unit that controls the sheet driving unit to select another one of the sheet storage units in the same group for feeding a sheet, if the residual sheet amount detecting unit detects the sheet empty;

a command analyzing unit that analyzes a print job, and determines whether or not the print job is compatible with a grouping function; and a command converting unit that converts a sheet size specifying command in the print job to either a command to specify a group of sheet storage units compatible with a sheet size specified by the sheet size specifying command or a command to specify a sheet storage unit in the group, if the command analyzing unit determines that the print job is not compatible with a grouping function.

An image forming apparatus according to the tenth aspect of this invention has:

pluralities of sheet storage units;

a printing unit;

a sheet driving unit that feeds a sheet of paper from the sheet storage units to the printing unit;

a group setting maintaining unit that forms a group from the sheet storage units;

a residual sheet amount detecting unit that detects sheet empty on any of the sheet storage units in the group;

a sheet storage switching control unit that controls the sheet driving unit to select another one of the sheet storage units in the same group for feeding a sheet, if the residual sheet amount detecting unit detects the sheet empty;

a sheet attribution detecting unit that detects one or more sheet attributions of sheets stored in the sheet storage units;

an attribution consistency determining unit that determines whether or not a sheet attribution of a sheet stored in one of the sheet storage units in the group is same as a sheet attribution of a sheet stored in other ones of the sheet storage units; and an automatic group setting unit that removes a sheet storage unit with an inconsistent sheet attribution determined by the attribution consistency determining unit from the group.

An image forming apparatus according to the eleventh aspect of this invention has:

pluralities of sheet storage units;

a printing unit;

a sheet driving unit that feeds a sheet of paper from the sheet storage units to the printing unit;

a group setting maintaining unit that forms a group of the sheet storage units;

a residual sheet amount detecting unit that detects sheet empty on any of the sheet storage units in the group;

a sheet storage switching control unit that controls the sheet driving unit to select another one of the sheet storage units in the same group for feeding a sheet, if the residual sheet amount detecting unit detects the sheet empty; and an automatic group setting unit that automatically forms the group according to a sheet attribution of sheets stored in the sheet storage units.

An image forming apparatus according to the twelfth aspect of this invention has:

pluralities of sheet storage units;

a group setting maintaining unit that forms groups of the sheet storage units, the groups commonly having any of the sheet storage units; and a group sheet usage recording unit that maintains respective records of consuming sheets in the groups.

An image forming system according to the thirteenth aspect of this invention has pluralities of image forming apparatuses that are connected via electronic communication channels with each other, and print on sheets fed from sheet storage units and output the sheets by printing units.

In the system, each of the image forming apparatuses has:

a communication interface unit capable of connecting to the electronic communication channels;

a group managing unit that forms a group of the sheet storage units in the image forming apparatuses;

a job dividing unit that divides a print job into divisional print jobs to perform parallel printing on sheets fed from the sheet storage units in the group;

a job transmitting unit that transmits at least one of the divisional print jobs to at least other one of the image forming apparatuses via the communication interface unit;

a job receiving unit that receives one of the divisional print jobs from another one of the image forming apparatuses via the communication interface unit; and a job executing unit that executes the received divisional print job.

An image forming system according to the fourteenth aspect of this invention has:

pluralities of image forming apparatuses that print on sheets fed from sheet storage units and output the sheets by printing units; and a print server that is connected via electronic communication channels to the image forming apparatuses, and sends print jobs to the image forming apparatuses.

In the system, the print server has:

a communication interface unit capable of connecting to the electronic communication channels;

a group managing unit that forms a group of the sheet storage units in the image forming apparatuses;

a job dividing unit that divides a print job into divisional print jobs to perform parallel printing on sheets fed from the sheet storage units in the group; and a job transmitting unit that transmits the divisional print jobs to the image forming apparatuses via the communication interface unit.

In the system, each of the image forming apparatuses has:

a communication interface unit capable of connecting to the electronic communication channels;

a job receiving unit that receives one of the divisional print jobs via the communication interface unit; and a job executing unit that executes the received divisional print job.

An image forming apparatus according to the fifteenth aspect of this invention has:

a sheet storage unit;

a printing unit that receives a sheet of paper from the sheet storage unit, and prints on the sheet;

a communication interface unit capable of connecting to an electronic communication channel;

a group managing unit that forms a group of the sheet storage unit and at least one sheet storage unit in at least one other image forming apparatus connected via the electronic communication channel;

a job dividing unit that divides a print job into divisional print jobs to perform parallel printing on sheets fed from the sheet storage units in the group;

a job transmitting unit that transmits at least one of the divisional print jobs to at least one other image forming apparatus via the communication interface unit;

a job receiving unit that receives one of the divisional print jobs from another image forming apparatus via the communication interface unit; and a job executing unit that executes the received divisional print job.

A print server according to the sixteenth aspect of this invention has:

a group managing unit that forms a group of sheet storage units in image forming apparatuses connected via electronic communication channels to each other;

a job dividing unit that divides a print job into divisional print jobs to perform parallel printing on sheets fed from the sheet storage units in the group; and a job transmitting unit that transmits the divisional print jobs to the image forming apparatuses via the communication interface unit.

These and other objects, features and advantages of the present invention will become more apparent upon reading of the following detailed description along with the accompanied drawings.

BRIEF DESCRIPTION OF THE DRAWINGS

FIGS. 22A to 22D show diagrams for explaining a group concept and a command conversion in the image forming apparatus according to Embodiment 6 of this invention;

DETAILED DESCRIPTION OF THE PREFERRED EMBODIMENT

Hereinafter, embodiments of this invention will be explained with reference to attached drawings.

Embodiment 1

[Machine Configuration]

Figure 1:
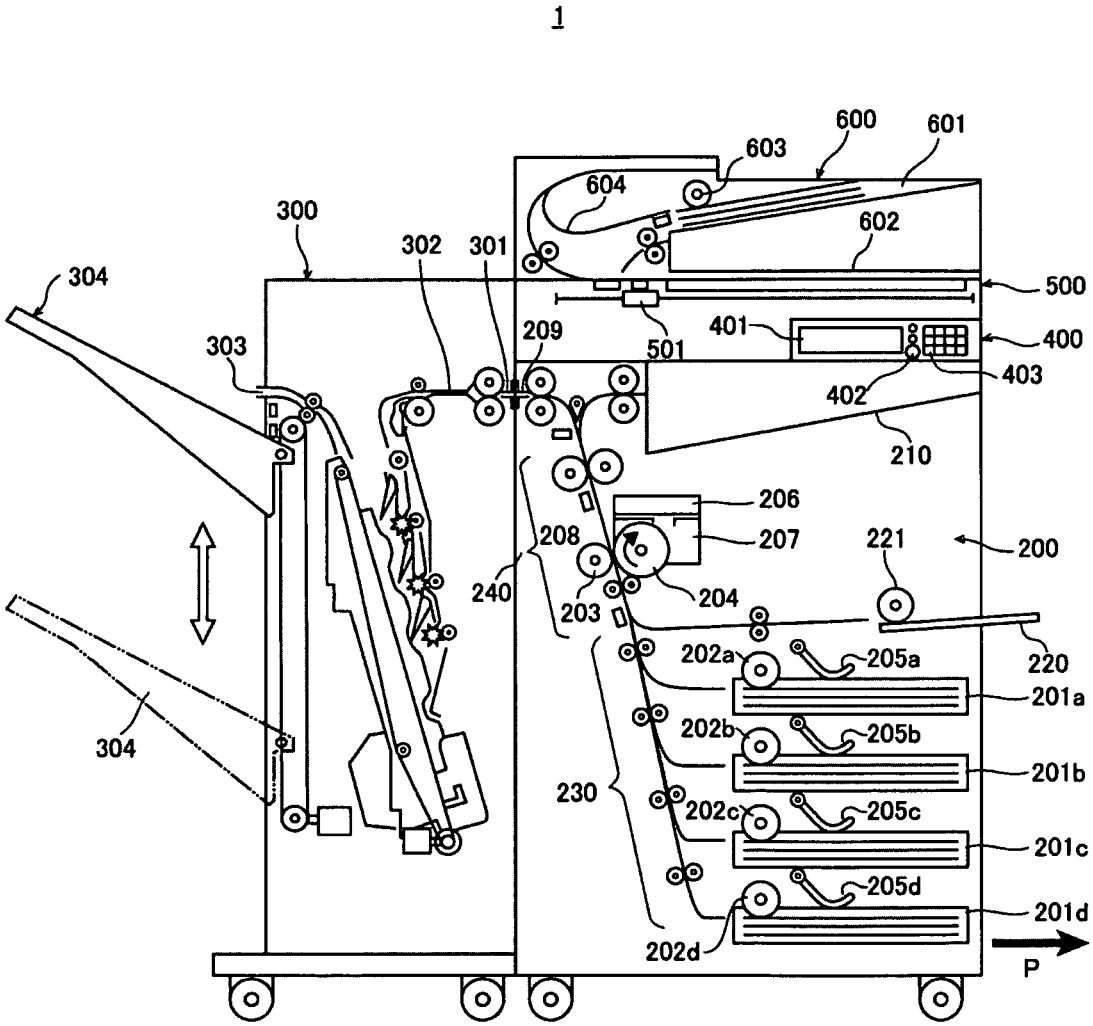
FIG. 1 mainly shows an internal side view of mechanical configuration of an image forming apparatus according to Embodiment 1 of this invention.

FIG. 1 mainly shows an internal side view of mechanical configuration of an image forming apparatus according to Embodiment 1 of this invention.

Hereinafter, a sheet storage unit means a plate-shaped sheet feeding tray like a manual sheet feeding tray 220 mentioned below, or a box-shaped sheet feeding tray like a sheet cassette 201*a*, 201*b*, 201*c*, or 201*d*.

An image forming apparatus 1 contains a body part 200, a sheet postprocessing part 300 positioned in the left side of the body part 200, an operation unit 400 for receiving an instruction input by a user operation, a document scanning unit 500 positioned on the body part 200, and a document feeding part 600 positioned over the document scanning unit 500.

The operation unit 400 has a touch panel 401 (including a display unit), a start key 402, ten keys 403, and so on. The touch panel 401 displays user operation screens, and displays user operation buttons for inputting an instruction by a user operation, and so on. The start key 402 is used for inputting a print execution instruction and so on by a user. The ten keys 403 are used for inputting the number of sheets to be printed.

The document feeding part 600 has a document storage unit 601, a document outputting unit 602, a sheet feeding roller 603, a document transportation unit 604, and so on. The document scanning unit 500 has a scanner 501 and so on. The sheet feeding roller 603 feeds a document put on the document storage unit 601, and the document transportation unit 604 transports each sheet of the document to the scanner 501 in turn. The scanner 501 scans the document, and then outputs the document to the document outputting unit 602.

The body part 200 has (a) pluralities of sheet cassettes 201*a*, 201*b*, 201*c* and 201*d* (as sheet storage units), (b) a manual sheet feeding tray 220 (as a sheet storage unit), (c) pluralities of sheet feeding rollers 202 and 221 (as a part of a sheet driving unit), (d) a transfer roller 203 (as a part of a printing unit), (e) a photoconductor drum 204 (as a part of the printing unit), (f) a light exposure device 206 (as a part of the printing unit), (g) a developing device 207 (as a part of the printing unit), (h) a fixing roller 208 (as a part of the printing unit), (i) a sheet outlet 209, (j) a sheet output tray 210, and so on.

The sheet cassettes 201*a*, 201*b*, 201*c* and 201*d* and the manual feeding tray 220 constitute sheet storage units.

The transfer roller 203, the photoconductor drum 204, the light exposure device 206, the developing device 207, and the fixing roller 208 constitute a printing unit 240.

The sheet feeding rollers 202 and 221, a sheet transportation path from the sheet storage units to the printing unit 240, and a driving system for them constitute a sheet driving unit 230.

The photoconductor drum 204 rotates in a direction of the arrow and is uniformly charged by a charging device (not shown). The light exposure device 206 emits a laser light generated from a signal modulated with image data of the document scanned by the document scanning unit 500, and forms an electrostatic latent image on the photoconductor drum 204. The developing device 207 supplies black toner to the photoconductor drum 204, and forms a toner image.

On the other hand, print sheets of paper are stored in the sheet cassettes 201*a*, 201*b*, 201*c* and 201*d* of the sheet storage units, and the sheet feeding rollers 202*a*, 202*b*, 202*c*, 202*d* (i.e. the sheet feeding rollers 202) make contact with sheets on the top of the print sheets in the sheet cassettes 201*a*, 201*b*, 201*c* and 201*d*, and rotate to feed the sheets to the transportation path in the sheet driving unit 230, respectively. The sheet feeding roller 221 makes contact with a sheet on the top of print sheets on the manual sheet feeding tray 220, and rotates to feed the sheets to the transfer roller 203 via the transportation path in the sheet driving unit 230. The transfer roller 203 transfers the toner image formed on the photoconductor drum 204 onto the transported sheet, and the fixing roller 208 fixes the toner image transferred on the sheet by heating. After that, the sheet is transported via the sheet outlet 209 of the body part 200 to the sheet postprocessing part 300. Alternatively, the sheet may be output to the output sheet tray 210.

Residual amount sensors 205*a*, 205*b*, 205*c* and 205*d* are attached to the sheet cassettes 201*a*, 201*b*, 201*c* and 201*d*, respectively, to detect respective residual sheet amounts in them. The residual amount sensor 205*a*, 205*b*, 205*c* or 205*d* has a shape of "J" as shown in the figure, and rotates around a shaft on the top according to a decrease of the residual sheet amount, and detects the residual sheet amount based on the rotation. In addition, since a contact part for a sheet in the residual amount sensor 205*a*, 205*b*, 205*c* or 205*d* sinks into a hole (not shown) of the base of the sheet cassette (i.e. sheet feeding tray) when no sheets are stored, the residual amount sensor 205*a*, 205*b*, 205*c* or 205*d* is capable of detecting sheet empty.

It should be noted that the sheet feeding roller 221 acts as a residual sheet amount sensor for the manual sheet feeding tray 220.

In the image forming apparatus 1, when the sheet cassette 201*a*, 201*b*, 201*c* or 201*d* is removed from the body part 200 to supply sheets of paper, it slides toward the right in FIG. 1 (in the direction of the arrow of "P" in FIG. 1). Therefore, since it does not cross the sheet feeding path from the sheet feeding rollers 202*a*, 202*b*, 202*c* and 202*d* to the transfer roller 203 and the photoconductor drum 204, the sheet cassette not currently used can be removed and installed even while printing is being performed, without stopping the printing.

Similarly, a sheet can be supplied to the manual sheet feeding tray 220 even while printing is being performed, without stopping the printing.

The sheet postprocessing part 300 has a sheet inlet 301, a sheet transportation unit 302, a sheet outlet 303, stack trays 304, and so on. The sheet transportation unit 302 transports a printed sheet input via the sheet inlet 301 from the sheet outlet 209 in turn, and outputs the printed sheet via the sheet outlet 303 to the stack trays 304. The stack trays 304 are capable of moving in the vertical direction according to the number of the printed sheets output via the sheet outlet 303.

[Functional Blocks]

Figure 2:
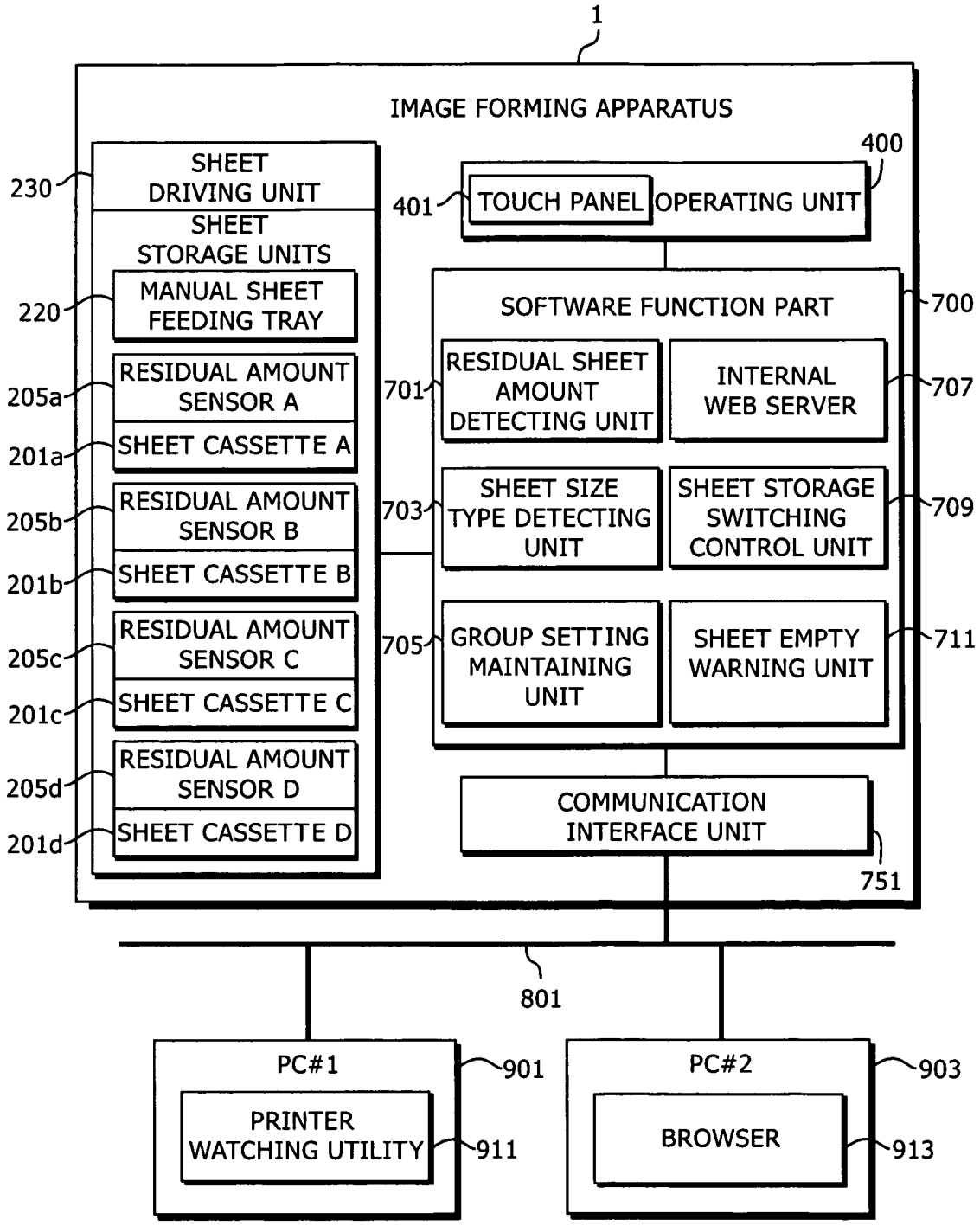
FIG. 2 shows a functional block diagram of the image forming apparatus according to Embodiment 1 of this invention.

FIG. 2 shows a functional block diagram of the image forming apparatus according to Embodiment 1 of this invention.

This functional block diagram does not show other components which are generally installed in an image forming apparatus, such as the printing unit 240 and the postprocessing part 300.

As shown in FIG. 2, the image forming apparatus 1 has a software function part 700 and a communication interface unit 751 as functional blocks together with the aforementioned sheet storage units (the sheet cassettes 201*a*, 201*b*, 201*c* and 201*d*, and the manual sheet feeding tray 220), the sheet driving unit 230, the operation unit 400, the touch panel 401 (a display unit), and so on.

The software function part 700 has a sheet residual detecting unit 701, a sheet size type detecting unit 703, a group setting maintaining unit 705, an internal web server 707, a sheet storage switching control unit 709, and a sheet empty warning unit 711.

Further, the image forming apparatus 1 is connected to a network 801 by the communication interface unit 751, and is connected via the network 801 to a PC (Personal Computer) #1 901 and a PC (Personal Computer) #2 903 connected to the network 801.

In the following part, the functional blocks are explained.

The communication interface unit 751 is an interface unit that connects the image forming apparatus 1 to the network. The image forming apparatus 1 communicates with an external device such as a personal computer by the communication interface unit 751.

The software function part 700 is embodied by executing a software program in a computer inside of the image forming apparatus 1.

The residual sheet amount detecting unit 701 receives output signals from the residual amount sensors 205*a*, 205*b*, 205*c* and 205*d*, and detects residual amounts of sheets of paper stored in the sheet cassettes 201*a*, 201*b*, 201*c* and 201*d*, and detects sheet empty on any of the sheet cassettes 201*a*, 201*b*, 201*c* and 201*d*.

The sheet size type detecting unit 703 receives sheet size signals from frame members, and signals from sensors positioned on the sheet transportation path, and detects respective sheet sizes, respective sheet types and so on of the sheets in the sheet cassettes 201*a*, 201*b*, 201*c* and 201*d* based on the signals. The frame members fit sheets and detect sheet sizes of them in the sheet cassettes 201*a*, 201*b*, 201*c* and 201*d*.

Some sheet types such as thick paper, color paper and one-side used paper are not detected by those sensors and the frame members. For such sheet types, the group setting maintaining unit 705 sets the sheet type according to a user input.

The group setting maintaining unit 705 is capable of forming groups of the sheet cassettes (as a grouping function). In general, a group is formed from the sheet cassettes of the same sheet size and the same sheet type. However, a group may be formed from the sheet cassettes of the different sheet sizes and/or the different sheet types.

The image forming apparatus 1 is capable of handling a group formed from the sheet storage units (the sheet cassettes 201*a*, 201*b*, 201*c* and 201*d* and the manual sheet feeding tray 220) as a large capacity sheet storage unit. Hereinafter, this is called as a grouping function.

This grouping function enables to perform printing on a lot of sheets in excess of the maximum sheet capacity of the sheet cassette. When all sheets in one of the sheet cassettes in a group are consumed, the sheet cassette is automatically changed to another one of the sheet cassettes in order to feed a sheet continuously. Therefore, it is possible to continuously perform printing until all sheets in all of the sheet cassettes in the group are consumed without a sheet empty error and print engine stop. This is one of the largest advantages of the grouping function.

The group setting maintaining unit 705 forms a group of the sheet storage units, and makes and maintains a record of the group. For example, a group is formed from sheet cassettes A and C that the sheet size is A4 and the sheet type is plain paper, and a group is formed from sheet cassettes B and D and a manual sheet feeding tray that the sheet size is A4 and the sheet type is one-side used paper. How to form a group is mentioned below with reference to FIG. 5.

The group may be formed according to an input to the operation panel 400, according to an instruction received via the communication interface unit 751 from a printer watching utility 911 of a PC#1 901 as an external device, or by using a setting function of the internal web server 707 from a browser 913 of a PC#2 903 as an external device.

The internal web server 707 is installed to be accessed by the browser 913 of the PC#2 903 as an external device in order to provide status information of the image forming apparatus 1. It is possible to access a web page provided by the internal web server 707, and to see a setting status of the image forming apparatus 1 and to change a setting of the image forming apparatus 1 in the web page. It is also possible to access a web page provided by the internal web server 707, and to see and change a setting of the group in the web page.

The sheet storage switching control unit 709 controls the sheet driving unit 230 to automatically change a sheet storage unit from which a sheet is fed when all sheets in the sheet storage unit in a group are consumed, and to continuously feed a sheet from another one of the sheet storage units (the sheet cassettes and the manual feeding tray) in the group without stopping printing.

The sheet empty warning unit 711 warns a user of sheet empty on any of the sheet cassettes, and warns a user of a caution for sheet supply when only one (i.e. the last one) of the sheet cassettes stores a sheet.

[Flowchart]

Figure 3:
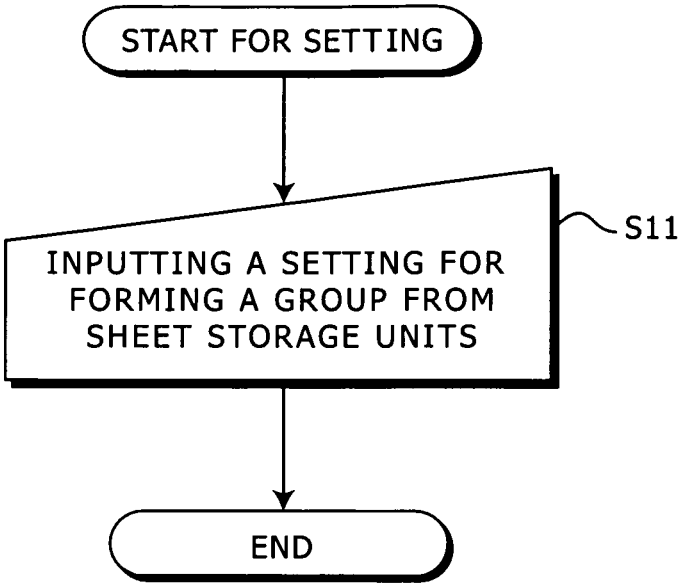
FIG. 3 shows a flowchart of forming a group in the image forming apparatus according to Embodiment 1 of this invention.

In the following part, forming a group in the image forming apparatus is explained with reference to a flowchart in FIG. 3.

Step S11: The image forming apparatus 1 forms a group of sheet storage units selected from all the sheet storage units (i.e. the sheet cassettes 201*a*, 201*b*, 201*c* and 201*d* and the manual sheet feeding tray 220). As mentioned above, a user operates either the operation unit 400 of the image forming apparatus 1 or a PC connected via a network to the image forming apparatus 1 to input a setting for forming a group. Specifically, an operation of forming a group is mentioned below with reference to FIG. 5.

Figure 4:
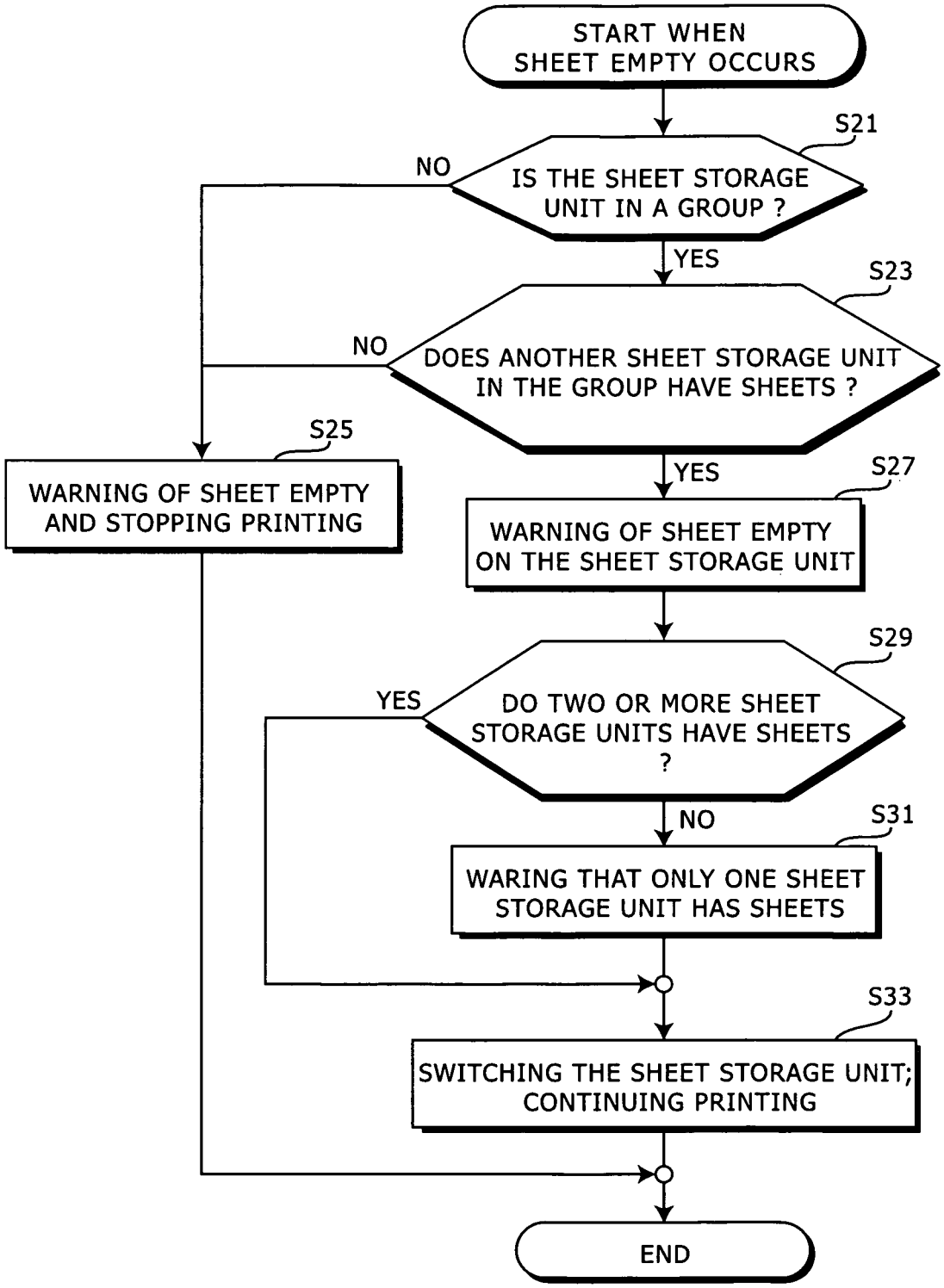
FIG. 4 shows a flowchart of operations performed when sheet empty occurs in the image forming apparatus according to Embodiment 1 of this invention.

With reference to a flowchart of FIG. 4, explained are operations performed when sheet empty occurs in the image forming apparatus 1. The image forming apparatus 1 starts a process shown in FIG. 4 when the residual sheet amount detecting unit 701 detects sheet empty based on output signals received from the sensors of the sheet storage units while printing is being performed.

Step S21: The sheet empty warning unit 711 determines whether or not the sheet storage unit where sheet empty is detected belongs to a group according to group information of sheet storage units maintained by the group setting maintaining unit 705 and information on the sheet storage unit with sheet empty detected by the residual sheet amount detecting unit 701. If the sheet storage unit where sheet empty is detected belongs to a group, then Step S23 is next executed. Otherwise, if the sheet storage unit where sheet empty is detected does not belong to any groups, then Step S25 is next executed.

Step S23: The sheet empty warning unit 711 determines whether or not there is a sheet in any other one of the sheet storage units in the group according to the group information and the information obtained by the residual sheet amount detecting unit 701. If there is a sheet in any other one of the sheet storage units in the group, then Step S27 is next executed. Otherwise, if there are no sheets in the others of the sheet storage units in the group, then Step S25 is next executed.

Step S25: Since the sheet storage unit without any sheets does not belong to any groups, or there are no sheets in the other sheet storage units in the group, the sheet empty warning unit 711 warns that printing can not be continued due to sheet empty, and the printing unit 230 stops printing. The process shown in FIG. 4 ends here. If sheets are supplied into any of the sheet storage units in the group, then the printing is resumed.

For warning in Step S25, a warning message is displayed in the touch panel 401 (i.e. display unit) of the operation unit 400, or the image forming apparatus 1 notifies the printer watching utility 911 installed in the PC#1 901, or the image forming apparatus 1 notifies the browser of the PC#2 903 via the internal web server 707. Alternatively, two or three methods of the aforementioned warning methods may be performed.

Step S27: The sheet empty warning unit 711 warns that sheet empty occurs on the sheet storage unit. This warning is performed by means of at least one of the aforementioned warning methods mentioned in Step S25.

Step S29: The sheet empty warning unit 711 determines whether or not the group contains two or more sheet storage units of which each has a sheet. If the number of the sheet storage units of which each has a sheet is more than one, then Step S33 is next executed. Otherwise, if the group contains only one sheet storage unit which has a sheet, then Step S31 is next executed.

Step S31: The sheet empty warning unit 711 warns a user that only one sheet storage unit has a sheet, and that sheets of paper need to be supplied to at least one of empty sheet storage units. This warning is performed by means of at least one of the aforementioned warning methods mentioned in Step S25.

Step S33: The sheet storage switching control unit 709 provides an instruction to the sheet driving unit 230 to change a sheet storage unit from the sheet storage unit without any sheets to one of sheet storage units of which each has a sheet in order to continue printing without stopping. Printing continues by means of feeding a sheet from the changed sheet storage unit.

According to the aforementioned operations, even if sheet empty occurs on one of sheet storage units in a group, a sheet storage unit to feed a sheet is changed to another sheet storage unit in the group that has a sheet, if it exists, and then the apparatus notifies of it. Further, if only one sheet storage unit in the group has a sheet, then a user is warned that sheets of paper need to be supplied to at least one of empty sheet storage units.

When the apparatus warns of sheet empty in Step S27, the apparatus is not required to use all warning methods, and may use only one warning method such as displaying in the touch panel (i.e. a display unit in it). Alternatively, the touch panel may display that a residual sheet amount of the sheet storage unit is nothing. Alternatively, the warning may not be done according to a setting.

Here, the sheet empty starts the aforementioned process, but another event such as power-on of the image forming apparatus or user operation for starting it may start the aforementioned process.

[User Interface Screen for Forming a Group]

With reference to a user interface screen shown in FIG. 5, explained are operations for forming a group from the sheet storage units with the touch panel 401 in the image forming apparatus 1.

It is also possible to use the internal web server 707 or the printer watching utility 911 to form a group from the sheet storage units. When the internal web server 707 or the printer watching utility 911 is used, the same screen as that shown in FIG. 5 is displayed, and a user operates a mouse or the like instead of the touch panel 401.

FIGS. 5A to 5D show an example of a group setting screen displayed on the touch panel 401.

Figure 5A:
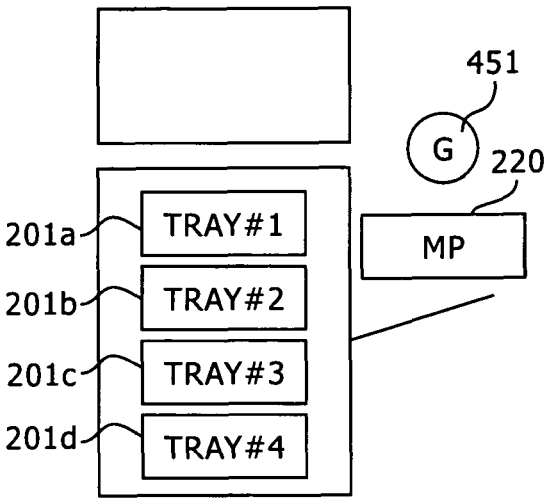
FIGS. 5A to 5D show a user interface screen for forming a group in the image forming apparatus according to Embodiment 1 of this invention.

In the group setting screen, as shown in FIG. 5A, some parts in the apparatus 1 are indicated as icons (i.e. buttons). TRAY#1 button is corresponding to the sheet cassette 201*a* (sheet cassette A), TRAY#2 button is corresponding to the sheet cassette 201*b* (sheet cassette B), TRAY#3 button is corresponding to the sheet cassette 201*c* (sheet cassette C), and TRAY#4 button is corresponding to the sheet cassette 201*d* (sheet cassette D). MP button is corresponding to the manual sheet feeding tray 220. In addition, a group setting button 451 is displayed on the group setting screen.

Figure 5B:
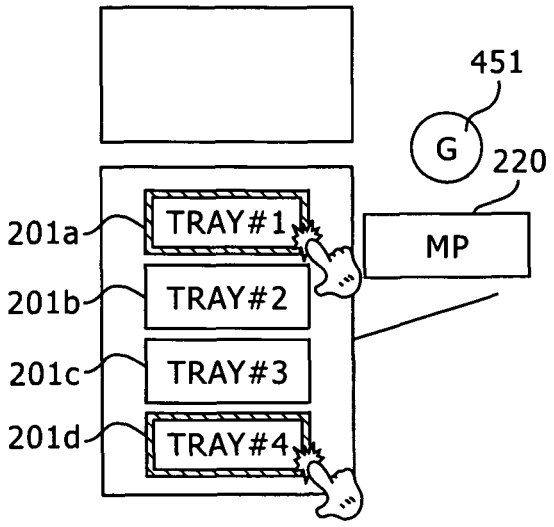

As shown in FIG. 5B, a user chooses and touches the icons (i.e. the buttons) that the user wants to use for forming a group. The touched icons are highlighted due to user's touches.

Figure 5C:
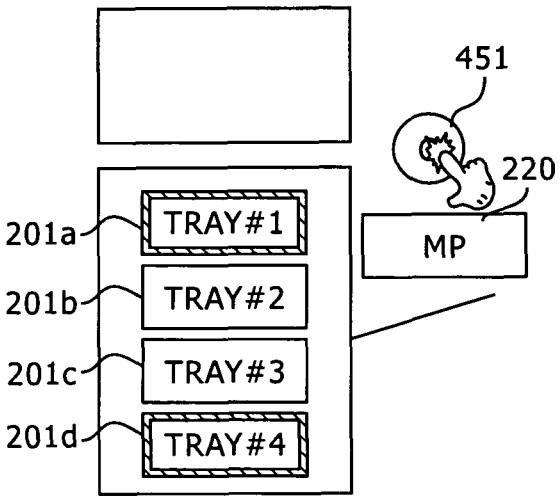

After the user touches the icons, as shown in FIG. 5C, the user touches the group setting button 451 to execute forming a group.

Figure 5D:
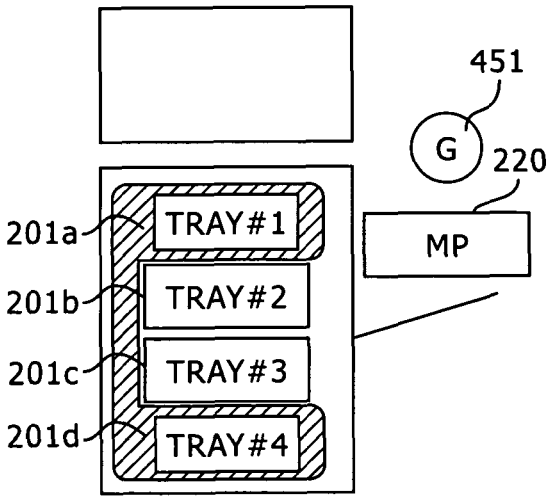

The group, as a result of executing forming a group, is indicated as a frame that encloses the selected icons (e.g. TRAY#1 and TRAY#4 in FIG. 5D).

Advantages of Embodiment 1

In ordinary machines, it is not possible to prevent to stop printing when sheet empty occurs on a sheet storage unit used to feed a sheet for printing, even if the sheet storage unit belongs to a group. According to this embodiment, this problem is solved by using another sheet storage unit in the group, and sending a message of sheet empty when sheet empty occurs on any of sheet storage units in the group, and warning to cause a user to supply sheets when the last one of the sheet storage units only has a sheet.

The image forming apparatus 1 enables to perform continuous printing on a lot of sheets in excess of the maximum sheet capacity of the sheet cassette.

Even while printing is being performed, without stopping the printing, sheets can be supplied to a sheet storage unit that is not used for the printing.

A user is notified of sheet empty on a sheet cassette, and therefore, the user can supply sheets to the sheet cassette. When the image forming apparatus is started, the image forming apparatus checks states of the sheet storage units, and notifies as well if sheet empty occurs. The image forming apparatus can detect sheet empty at another timing than the timing when all sheets in a sheet storage unit are consumed.

Further, when the only one (i.e. the last one) of the sheet storage units has a sheet, the image forming apparatus 1 warns a user of it. The user receives the warning and supplies sheet to a sheet storage unit without any sheets. Therefore, in an apparatus that sheets can be supplied to a sheet cassette without stopping printing, such as the image forming apparatus of Embodiment 1, printing is continuously performed without a stop due to a limit of sheet capacity of sheet storage units in a group.

In Embodiment 1, the image forming apparatus 1 has the document feeding part 600, the document scanning unit 500 and the postprocessing part 300. This is an example of a relatively high performance image forming apparatus. This invention is not limited to this embodiment, and it can also be applied to an image forming apparatus without these parts and units.

In the image forming apparatus 1 of Embodiment 1, without a stop of printings, sheets can be supplied to a sheet storage unit not currently used to feed a sheet for printing. However, some image forming apparatuses have a structure that stops printing when sheets are supplied to a sheet storage unit. For example, a sheet cassette crosses a sheet feeding path when the sheet cassette is pulled out. Such image forming apparatus also notifies a user of sheet empty, and consequently, the user can prepare sheets to be supplied before stopping printing. Therefore, the apparatus only would stop in a short period. Thus, a higher advantage is given by applying this invention to an image forming apparatus that sheets can be supplied to a sheet storage unit not currently used to feed a sheet for printing.

Embodiment 2

Hereinafter, an image forming apparatus of Embodiment 2 is explained. In Embodiment 2, both a sheet feeding tray and a sheet storage unit refer to the same thing.

[Machine Configuration]

A mechanical configuration of the image forming apparatus in Embodiment 2 is identical to that in Embodiment 1, and therefore, it is not explained here.

[Functional Blocks]

Figure 6:
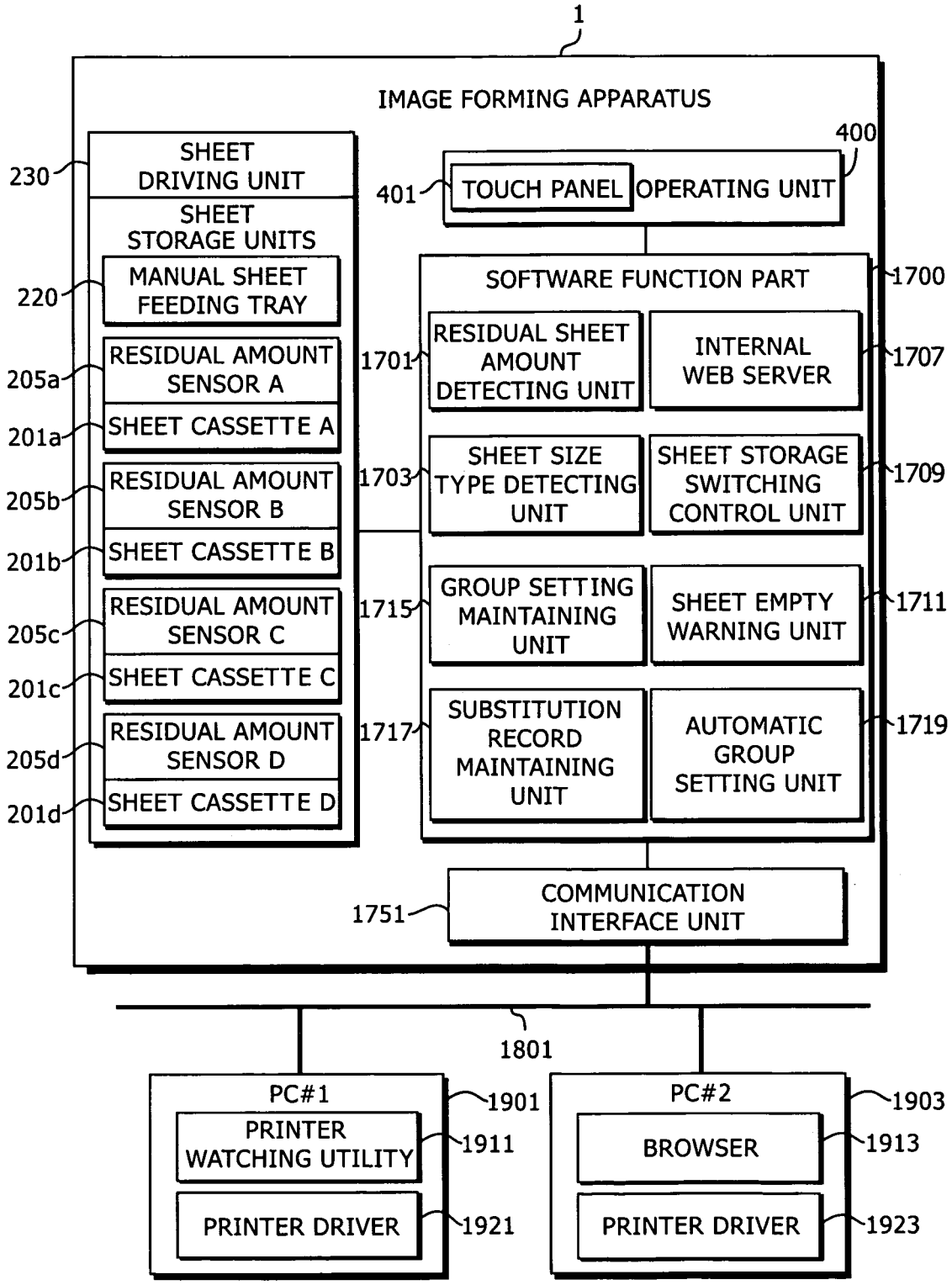
FIG. 6 shows a functional block diagram of an image forming apparatus according to Embodiment 2 of this invention.

FIG. 6 shows a functional block diagram of an image forming apparatus according to Embodiment 2.

This functional block diagram does not show other components which are generally installed in an image forming apparatus.

As shown in FIG. 6, the image forming apparatus 1 has a software function part 1700 and a communication interface unit 1751 as functional blocks together with the sheet storage units (the sheet cassettes 201*a*, 201*b*, 201*c* and 201*d*, and the manual sheet feeding tray 220), the sheet driving unit 230, the operation unit 400, the touch panel 401 (a display unit), and so on.

The software function part 1700 has functional blocks of a sheet residual detecting unit 1701, a sheet size type detecting unit 1703, an internal web server 1707, a sheet storage switching control unit 1709, a sheet empty warning unit 1711, a group setting maintaining unit 1715, a substitution record maintaining unit 1717, and an automatic group setting unit 1719.

Further, the image forming apparatus 1 is connected to a network 1801 by the communication interface unit 1751, and is connected via the network 1801 to a PC (Personal Computer) #1 1901 and a PC (Personal Computer) #2 1903 connected to the network 1801.

In the following part, the functional blocks are explained.

The communication interface unit 1751 is an interface unit that connects the image forming apparatus 1 to the network. The image forming apparatus 1 communicates with an external device such as a personal computer by the communication interface unit 1751.

The software function part 1700 is embodied by executing a software program in a computer inside of the image forming apparatus 1. In the following part, the functional blocks in the software function part 1700 are explained.

The residual sheet amount detecting unit 1701 receives output signals from the residual amount sensors 205*a*, 205*b*, 205*c* and 205*d*, and detects residual amounts of sheets of paper stored in the sheet cassettes 201*a*, 201*b*, 201*c* and 201*d*, and detects sheet empty on any of the sheet cassettes 201*a*, 201*b*, 201*c* and 201*d*.

The sheet size type detecting unit 1703 receives sheet size signals from frame members, and signals from sensors positioned on the sheet transportation path, and detects respective sheet sizes, respective sheet types and so on of the sheets in the sheet cassettes 201*a*, 201*b*, 201*c* and 201*d* based on the signals. The frame members fit sheets and detect sheet sizes of them in the sheet cassettes 201*a*, 201*b*, 201*c* and 201*d*.

Some sheet types such as thick paper, color paper and one-side used paper are not detected by those sensors and the frame members. For such sheet types, the group setting maintaining unit 1715 sets the sheet type according to a user input.

The internal web server 1707 has the same function as that of the internal web server 707. The internal web server 1707 can provide a setting screen (mentioned below) for setting a sheet storage unit to be substituted.

The sheet storage switching control unit 1709 controls the sheet driving unit 230 to automatically change a sheet storage unit from which a sheet is fed when all sheets in the sheet storage unit in a group are consumed, and to continuously feed a sheet from another one of the sheet storage units (the sheet cassettes and the manual feeding tray) in the group without stopping printing.

The sheet empty warning unit 1711 warns a user of sheet empty on one of the sheet cassettes when all sheets are consumed for printing in the sheet cassette.

The group setting maintaining unit 1715 is capable of forming groups of the sheet cassettes (as a grouping function). In general, a group is formed from the sheet cassettes of the same sheet size and the same sheet type. However, a group may be formed from the sheet cassettes of the different sheet sizes and/or the different sheet types.

This image forming apparatus 1 has a grouping function. This grouping function enables to perform printing on a lot of sheets in excess of the maximum sheet capacity of the sheet cassette. Therefore, it is possible to continuously perform printing until all sheets in all of the sheet cassettes in the group are consumed. This is one of the largest advantages of the grouping function.

The group setting maintaining unit 1705 forms a group of the sheet storage units, and makes and maintains a record of the group. For example, a group is formed from sheet cassettes A and C that the sheet size is A4 and the sheet type is plain paper, and a group is formed from sheet cassettes B and D and a manual sheet feeding tray that the sheet size is A4 and the sheet type is one-side used paper.

The group may be formed according to an input to the operation panel 400, according to an instruction received via the communication interface unit 1751 from a printer watching utility 1911 of a PC#1 1901 as an external device, or by using a setting function of the internal web server 1707 from a browser 1913 of a PC#2 1903 as an external device.

The group setting maintaining unit 1705 makes and maintains not only a record of the group formed manually, but also receives information on the group formed by the automatic group setting unit 1719, and makes and maintains a record of the group according to the information. It is explained in detail below.

The group setting maintaining unit 1715 forms a group when a user instruction is input. If a sheet feeding tray does not belong to a group when a sheet error occurs on the sheet feeding tray, then the apparatus causes a user to choose another sheet feeding tray to be substituted for the sheet feeding tray where the sheet error occurs, and resumes a print job with feeding a sheet from the substituted sheet feeding tray. The substitution record maintaining unit 1717 maintains a record of these sheet feeding trays.

A sheet error mainly means an error due to sheet empty, and also means an error due to mismatch of a sheet attribution between a sheet fed from a tray and a sheet required to printing and postprocessing, and an error that even though the tray has a sheet, a sheet can not be fed without a jam. That is, the apparatus reboots after a jam, but the apparatus may resume without a reboot if a sheet driving system stops due to some reasons other than a jam, for example, the sheet driving system mechanically fails to feed a sheet from the tray. A sheet error also means an error due to this situation.

Table 1 shows examples of records maintained by the substitution record maintaining unit 1717.

TABLE 1

| # | USER | DATE AND TIME | ERROR TYPE | ERROR TRAY | SUBSTITUTE TRAY | ERROR SHEET ATTRIBUTION | SUBSTITUTE SHEET ATTRIBUTION |
|---|---|---|---|---|---|---|---|
| 1 | a1818 | 20xx/3/3-09:32 | SHEET EMPTY | TRAY #1 | TRAY #4 | A4-N-PLAIN | A4-R-PLAIN |
| 2 | c3246 | 20xx/3/1-15:34 | STOP OF SHEET DRIVING UNIT | TRAY #2 | TRAY #3 | B5-N-PLAIN | A4-N-ONE-SIDE USED PAPER |
| 3 | k8764 | 20xx/2/16-10:12 | SHEET EMPTY | TRAY #3 | TRAY #4 | A4-N-PLAIN | A4-R-PLAIN |

A record in the first row means that while the user "a1818" uses the apparatus, at the date and time "20xx/03/03-09:32", a "sheet empty" error occurs, and at that time, a sheet feeding tray that the error occurs is "TRAY#1", and a sheet feeding tray "TRAY#4" is selected for substitution; and sheet attributions of a sheet in TRAY#1 are a sheet size of "A4", a sheet orientation of "N" (here, "N" means the vertical orientation, i.e. portrait), and a sheet type of "PLAIN" (here, "PLAIN" means plain paper); and sheet attributions of a sheet in TRAY#4 are a sheet size of "A4", a sheet orientation of "R" (here, "R" means the horizontal orientation, i.e. landscape), and a sheet type of "PLAIN". Hereinafter, TRAY#1, TRAY#2, TRAY#3, and TRAY#4 mean the sheet cassette 201*a* to 201*d*, respectively.

The automatic group setting unit 1719 automatically forms a group from the sheet storage units, based on substitution records in Table 1 maintained by the substitution record maintaining unit 1717.

Table 2 shows an example of a table that contains frequencies of combinations between a sheet feeding tray that an error occurs and a sheet feeding tray substituted for the sheet feeding tray in the error. Table 2 is derived from a table that contains substitution records more than those in Table 1.

TABLE 2

| | ERROR | | | | |
|---|---|---|---|---|---|
| SUBSTITUTE | TRAY# 1 | TRAY# 2 | TRAY# 3 | TRAY# 4 | MANUAL TRAY |
| TRAY# 1 | — | 34 | 12 | 32 | 1 |
| | — | 37.8% | 34.3% | 58.2% | 50.0% |
| TRAY# 2 | 2 | — | 8 | 0 | 1 |
| | 1.6% | — | 22.9% | 0.0% | 50.0% |
| TRAY# 3 | 36 | 26 | — | 23 | 0 |
| | 28.1% | 28.9% | — | 41.8% | 0.0% |
| TRAY# 4 | 85 | 0 | 15 | — | 0 |
| | 66.4% | 0.0% | 42.9% | — | 0.0% |
| MANUAL TRAY | 5 | 30 | 0 | 0 | — |
| | 3.9% | 33.3% | 0.0% | 0.0% | — |
| SUB TOTAL | 128 | 90 | 35 | 55 | 2 |

A record in the first column of Table 1 indicates the numbers and percentages of times that respective sheet feeding trays were selected as a substitution sheet feeding tray when a sheet error occurred on TRAY#1.

Values in the first column are explained in turn from the top toward the bottom. In the first column, since TRAY#1 is not substituted for TRAY#1 itself when a sheet error occurs, a field of TRAY#1 as a substituted sheet feeding tray is a blank.

Next, the number of times that TRAY#2 was substituted is 2, and its percentage is 1.6 percent; the number of times that TRAY#3 was substituted is 36, and its percentage is 28.1 percent; the number of times that TRAY#4 was substituted is 85, and its percentage is 66.4 percent; and the number of times that MT (manual tray) was substituted is 5, and its percentage is 3.9 percent. The total number of times of substitution is 128.

A pair of sheet storage units with the strongest relation (i.e. with the highest combination frequency) in Table 2 is a combination of TRAY#1 and TRAY#4 in the first column.

Therefore, the automatic group setting unit 1719 forms a new group of TRAY#1 and TRAY#4. The automatic group setting unit 1719 sends this setting information of the new group to the group setting maintaining unit 1715, and the group setting maintaining unit 1715 maintains a record of this new group based on the setting information.

After forming this new group, when a sheet error occurs on TRAY#1, a tray used for feeding a sheet of paper is automatically changed from TRAY#1 to TRAY#4, and a print job continues. Similarly, when a sheet error occurs on TRAY#4, a tray used for feeding a sheet of paper is automatically changed from TRAY#4 to TRAY#1, and a print job continues.

In Embodiment 2, a new group is formed from a combination of the trays with the highest frequency in the table. Further, it is possible to analyze remaining trays and repeatedly forming one or more other groups from one or more combinations of the remaining trays (e.g. a combination with the second highest frequency, a combination with the third highest frequency, etc.).

If the difference between the highest frequency and the second highest frequency is small, then a new group may not be formed because of a low significant relationship. Specifically, if the difference between the highest frequency and the second highest frequency is smaller than a predetermined threshold, then a new group may not be formed. Alternatively, if the difference between the highest frequency and the second highest frequency is small, a new group may be formed of three trays: a tray where an error occurs, a tray with the highest frequency, and a tray with the second highest frequency.

Alternatively, a new group may be formed from trays without low frequencies in the table.

In Embodiment 2, a new group is formed only according to the frequency in Table 2, but a new group may be automatically formed according to the frequency and the sheet attribution in Table 1. For example, a new group is not formed from trays with different sheet sizes.

The automatic group setting unit 1719 analyzes the tables and forms a new group at least one of timings: (a) at a predetermined time (e.g. 6 AM every day) while powered-on, (b) every time interval (e.g. every 6 hours), (c) when a user inputs an instruction, (d) at starting a job, and (e) when a user selects a tray to be substituted.

[Flowchart]

Figure 7:
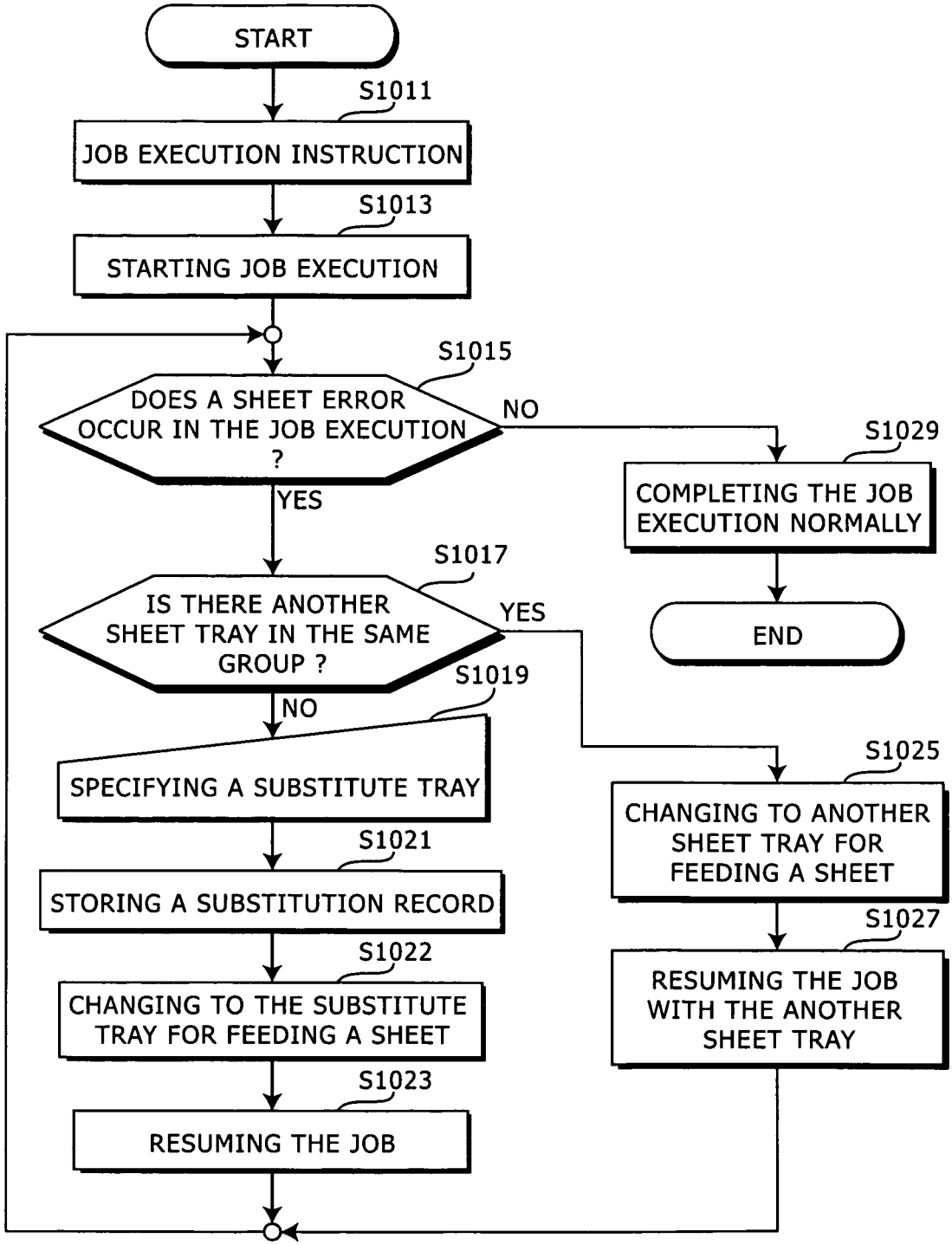
FIG. 7 shows a flowchart of operations when a sheet error occurs in the image forming apparatus according to Embodiment 2 of this invention.

With reference to a flowchart of FIG. 7, explained are operations performed when a sheet error occurs in the image forming apparatus 1.

Step S1011: An instruction is input to execute a job. This instruction is input from the operation panel 400 of the image forming apparatus 1, or a printer driver 1921 or 1923 of the PC#1 1901 or the PC#2 1903.

Step S1013: The job is started. The printing unit 204 performs printing on a sheet of paper fed from a currently selected sheet feeding tray.

Step S1015: It is determined whether or not a sheet error occurs in the job execution. If a sheet error occurs, then Step S1017 is next executed. Otherwise, if a sheet error does not occur until the end of the job, then Step S1029 is next executed.

Step S1017: The group setting maintaining unit 1715 determines whether or not the sheet feeding tray currently selected to feed a sheet belongs to a group, and determines whether or not another sheet feeding tray in the group has a sheet. If the sheet feeding tray currently selected to feed a sheet belongs to a group, and another sheet feeding tray in the group has a sheet, then Step S1025 is next executed. Otherwise, if the sheet feeding tray currently selected to feed a sheet does not belong to any groups, then Step S1019 is next executed. Also, if another sheet feeding tray in the group does not have a sheet, then Step S1019 is next executed.

Step S1019: The substitution record maintaining unit 1717 receives a user input to select a sheet feeding tray to be substituted. A user interface screen displayed in Step S1019 will be explained in the following section "User interface screen and operations for selecting a sheet feeding tray to be substituted" with reference to FIG. 9.

Step S1021: The substitution record maintaining unit 1717 makes a record of the substitution sheet feeding tray selected by a user, and maintains the record as shown in Table 1.

Step S1022: The sheet storage switching control unit 1709 controls the sheet driving unit 230 to change the current sheet feeding tray and to feed a sheet from the substituted sheet feeding tray selected in Step S1019.

Step S1023: The job is resumed with feeding a sheet from the substituted sheet feeding tray. Step S1015 is executed next to Step S1023, and in Step S1015, it is continuously determined whether or not a sheet error occurs until the end of the job.

Step S1025: If in Step S1017 it is determined that the sheet feeding tray currently selected to feed a sheet belongs to a group, and another sheet feeding tray in the group has a sheet, then the sheet storage switching control unit 1709 controls the sheet driving unit 230 to change the current sheet feeding tray and to feed a sheet from the another sheet feeding tray in the group.

Step S1027: The job is resumed with feeding a sheet from the another sheet feeding tray in the group. Step S1015 is executed next to Step S1023, and in Step S1015, it is continuously determined whether or not a sheet error occurs until the end of the job.

Step S1029: If in Step S1015 it is determined that the job reaches the end, then the job is terminated and operations for the job ends.

According to the aforementioned operations, when a sheet error occurs on a sheet feeding tray, if the sheet feeding tray belongs to a group and another sheet feeding tray in the group has a sheet, then the job is continued with feeding a sheet from the another sheet feeding tray; otherwise, if the another sheet feeding tray in the group does not have any sheets, then a substituted sheet feeding tray is selected and this substitution is recorded, and the job is continued with feeding a sheet from the substituted sheet feeding tray.

In the following part, with reference to a flowchart in FIG. 8, an automatic group forming operation is explained. The automatic group setting unit 1719 performs this operation based on the record made in Step S1021.

Figure 8:
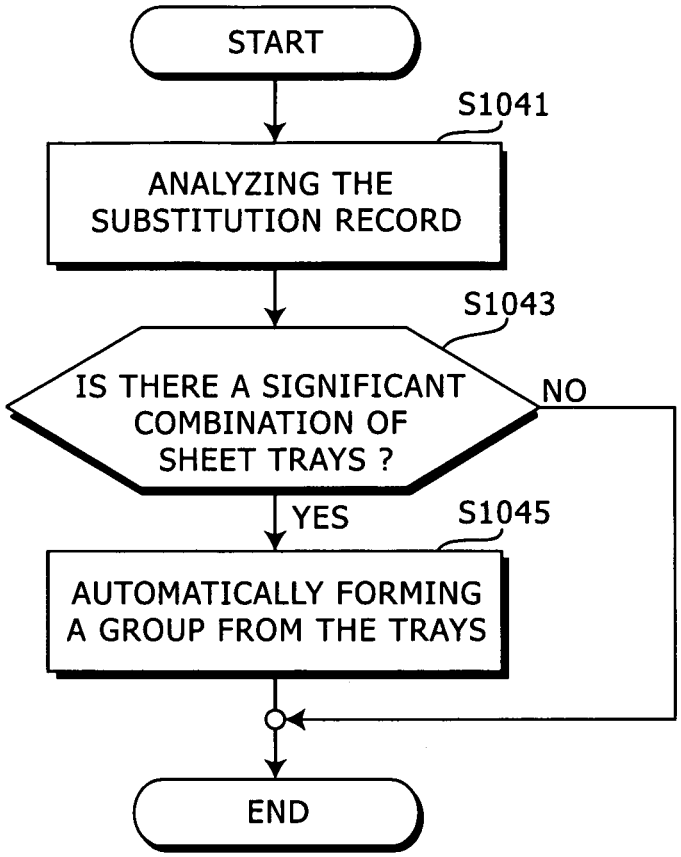
FIG. 8 shows a flowchart of operations for automatically forming a group in the image forming apparatus according to Embodiment 2 of this invention.

The process of the flowchart in FIG. 8 is started at least one of timings: (a) at a predetermined time while powered-on, (b) every time interval, (c) when a user inputs an instruction, (d) at starting a job, and (e) when a user selects a tray to be substituted.

Step S1041: The automatic group setting unit 1719 analyzes substitution records (e.g. records in Table 1) maintained by the substitution record maintaining unit 1717. A detailed explanation of this operation by the automatic group setting unit 1719 is mentioned above.

Step S1043: The automatic group setting unit 1719 determines whether or not there is a significant combination of the sheet feeding trays. A detailed explanation of this operation by the automatic group setting unit 1719 is mentioned above with Table 2. If there is a significant combination of the sheet feeding trays, then Step S1045 is next executed. Otherwise, if there are no significant combinations of the sheet feeding trays, then this process ends.

Step S1045: The automatic group setting unit 1719 forms a group of the sheet feeding trays in the significant combination, and notifies the group setting maintaining unit 1715 of the combination. The group setting maintaining unit 1715 makes and maintains a record of the combination of the trays (i.e. the group). As a result, even if a sheet error occurs on any of the sheet feeding trays in the group, printing is continued by using another sheet feeding tray in the group.

[User Interface Screen and Operations for Selecting a Sheet Feeding Tray to be Substituted]

With reference to a user interface screen in FIG. 9, explained are operations for selecting a sheet feeding tray to be substituted. The substitution record maintaining unit 1717 performs these operations when a sheet error occurs in the image forming apparatus 1. This interface screen is displayed on the touch panel 401 of the image forming apparatus 1, and the user touches the touch panel to select the tray.

Figure 9A:
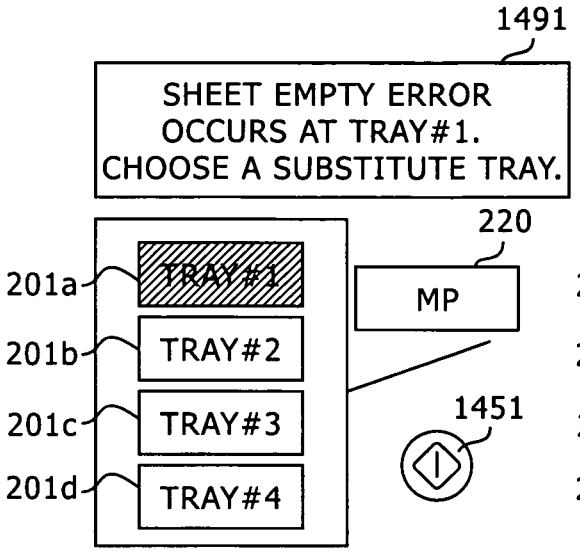
FIGS. 9A to 9C show a user interface screen for selecting a sheet feeding tray to be substituted in the image forming apparatus according to Embodiment 2 of this invention.
Figure 9B:
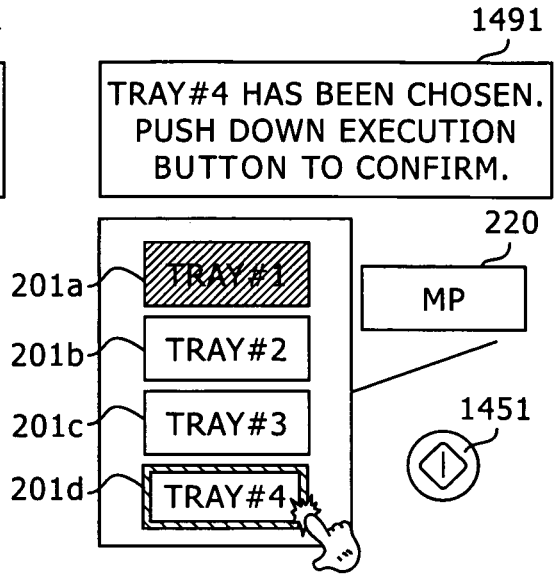
Figure 9C:
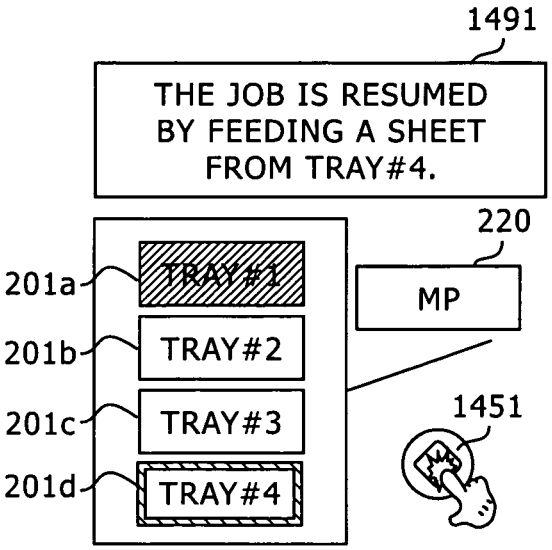

FIGS. 9A to 9C show an example of an interface screen for selecting a substituted sheet feeding tray. In the screen, as shown in FIG. 9A, some parts in the apparatus 1 are indicated as icons (i.e. buttons). TRAY#1 button is corresponding to the sheet cassette 201*a* (sheet cassette A), TRAY#2 button is corresponding to the sheet cassette 201*b* (sheet cassette B), TRAY#3 button is corresponding to the sheet cassette 201*c* (sheet cassette C), and TRAY#4 button is corresponding to the sheet cassette 201*d* (sheet cassette D). MP button is corresponding to the manual sheet feeding tray 220. In addition, an execution button 1451 and a message box 1491 are displayed on the interface screen.

When a sheet error occurs on TRAY#1, as shown in FIG. 9A, the icon of TRAY#1 is grayed out to indicate it, and a message is displayed in the message box 1491 to cause a user to choose a sheet feeding tray to be substituted. This message prompts a user to input.

As shown in FIG. 9B, from icons of the trays displayed on the touch panel, the user chooses and touches an icon of a tray to be substituted (here, the icon of TRAY#4), and then the touched icon is highlighted.

Next, as shown in FIG. 9C, the user touches the execution button 1451 to confirm that TRAY#4 is selected to substitute for TRAY#1. As a result, the job is continuously resumed with feeding a sheet from TRAY#4.

Instead of the execution button 1451, another button such as the start button 402 may be touched to confirm that TRAY#4 is selected to substitute for TRAY#1.

Advantages of Embodiment 2

The automatic group setting unit 1719 saves user's work for forming a group.

The automatic group setting unit 1719 forms a group based on a user's usage history, and therefore the group is compatible with a user's actual situation.

The substitution record maintaining unit 1717 may maintain substitution records of all users rather than a part of users, and the automatic group setting unit 1719 forms a group based on substitution records of all users. The group that the automatic group setting unit 1719 forms is useful for all users.

The more substitution records the substitution record maintaining unit 1717 maintains, the more compatible the group is formed.

In Embodiment 2, the image forming apparatus 1 is an example of a relatively high performance image forming apparatus. This invention is not limited to this embodiment, and it can also be applied to an image forming apparatus without optional parts and units such as the document feeding part 600, the document scanning unit 500 and the postprocessing part 300.

The aforementioned print job may be a job generated inside the image forming apparatus 1 such a copy job, or may be a print job received from an external device connected to the image forming apparatus 1 such as the PC#1 1901 with the printer driver 1921.

In Embodiment 2, the interface screen for selecting a sheet feeding tray to be substituted is displayed on the touch panel. However, when a print job from the PC#1 1901 is executed, the printer driver 1921 of the PC#1 1901 may cause a display device in the PC#1 1901 to display the interface screen as shown in FIG. 9 for selecting sheet feeding tray to be substituted. Further, when not only a job from the PC but also a job generated inside the image forming apparatus 1 are executed, the printer watching utility 1911 or the browser 1913 may cause a display device to display the interface screen as shown in FIG. 9 for selecting sheet feeding tray to be substituted.

Embodiment 3

Hereinafter, an image forming apparatus of Embodiment 3 is explained. In Embodiment 3, both a sheet feeding tray and a sheet storage unit refer to the same thing.

[Machine Configuration]

Figure 10:
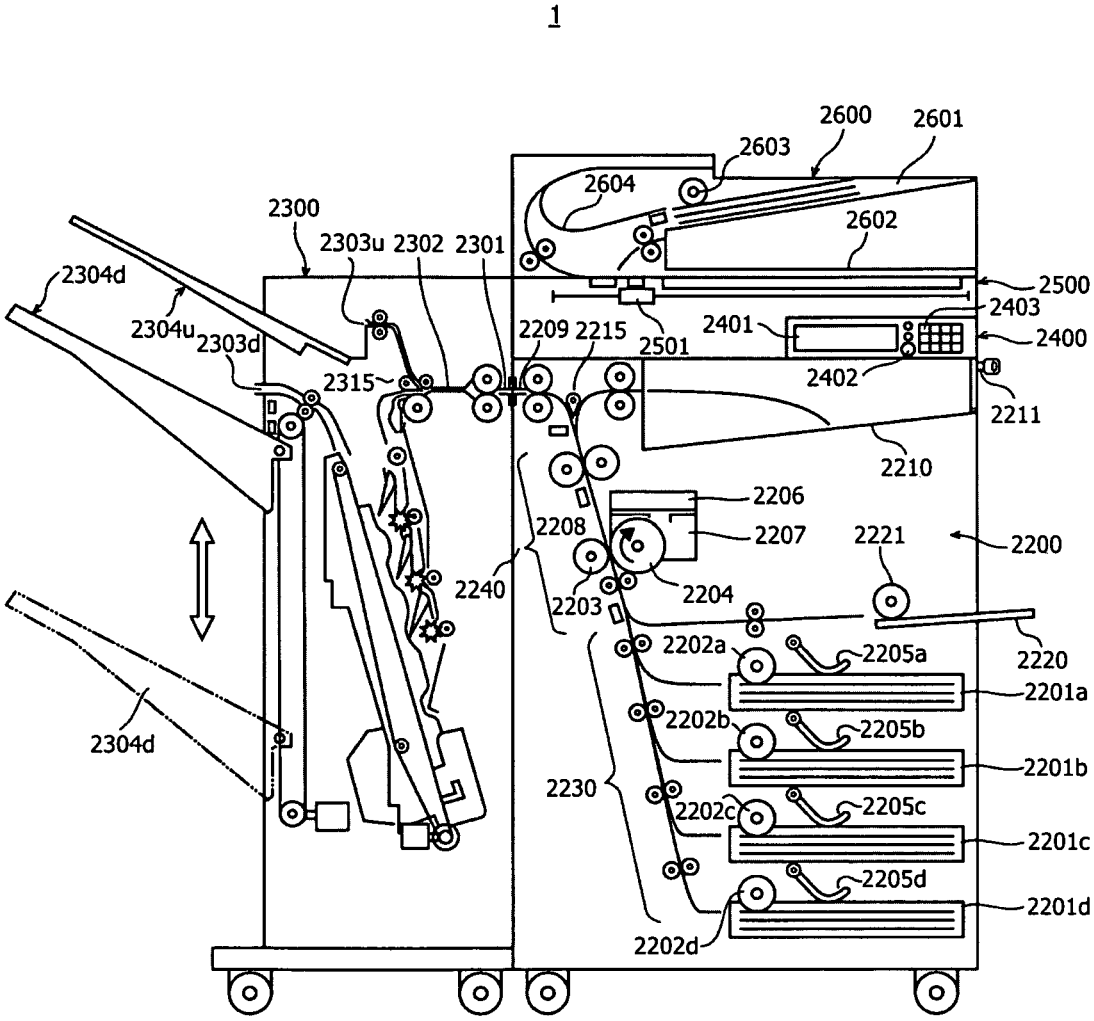
FIG. 10 mainly shows an internal side view of mechanical configuration of an image forming apparatus according to Embodiment 3 of this invention.

FIG. 10 mainly shows an internal side view of mechanical configuration of an image forming apparatus according to Embodiment 3 of this invention.

Here, a sheet storage unit means a plate-shaped sheet feeding tray like a manual sheet feeding tray 2220 mentioned below, or a box-shaped sheet feeding tray like a sheet cassette 2201*a*, 2201*b*, 2201*c*, or 2201*d*.

An image forming apparatus 1 contains a body part 2200, a sheet postprocessing part 2300 positioned in the left side of the body part 2200, an operation unit 2400 for receiving an instruction input by a user operation, a document scanning unit 2500 positioned on the body part 2200, and a document feeding part 2600 positioned over the document scanning unit 2500.

The operation unit 2400 has a touch panel 2401 (including a display unit), a start key 2402, ten keys 2403, and so on. The touch panel 2401 displays user operation screens, and displays user operation buttons for inputting an instruction by a user operation, and so on. The start key 2402 is used for inputting a print execution instruction and so on by a user. The ten keys 2403 are used for inputting the number of sheets to be printed.

The document feeding part 2600 has a document storage unit 2601, a document outputting unit 2602, a sheet feeding roller 2603, a document transportation unit 2604, and so on. The document scanning unit 2500 has a scanner 2501 and so on. The sheet feeding roller 2603 feeds a document put on the document storage unit 2601, and the document transportation unit 2604 transports each sheet of the document to the scanner 2501 in turn. The scanner 2501 scans the document, and then outputs the document to the document outputting unit 2602.

The body part 2200 has (a) pluralities of sheet cassettes 2201*a*, 2201*b*, 2201*c* and 2201*d* (as sheet storage units), (b) a manual sheet feeding tray 2220 (as a sheet storage unit), (c) pluralities of sheet feeding rollers 2202 and 2221 (as a part of a sheet driving unit), (d) a transfer roller 2203 (as a part of a printing unit), (e) a photoconductor drum 2204 (as a part of the printing unit), (f) a light exposure device 2206 (as a part of the printing unit), (g) a developing device 2207 (as a part of the printing unit), (h) a fixing roller 2208 (as a part of the printing unit), (i) a sheet outlet 2209, (j) a sheet output tray 2210, and so on.

The sheet output tray 2210 has a key lockable open-shut member 2211. A lock method on the key lockable open-shut member 2211 may be use a physical key as shown in FIG. 10, or may be use an electronic key for unlocking the member 2211 with a passcode input at the operation unit 2400.

The sheet cassettes 2201*a*, 2201*b*, 2201*c* and 2201*d* and the manual feeding tray 2220 constitute sheet storage units.

The transfer roller 2203, the photoconductor drum 2204, the light exposure device 2206, the developing device 2207, and the fixing roller 2208 constitute a printing unit 2240.

The sheet feeding rollers 2202 and 2221, a sheet transportation path from the sheet storage units to the printing unit 2240, and a driving system for them constitute a sheet driving unit 2230.

The photoconductor drum 2204 rotates in a direction of the arrow and is uniformly charged by a charging device (not shown). The light exposure device 2206 emits a laser light generated from a signal modulated with image data of the document scanned by the document scanning unit 2500, and forms an electrostatic latent image on the photoconductor drum 2204. The developing device 2207 supplies black toner to the photoconductor drum 2204, and forms a toner image.

On the other hand, print sheets of paper are stored in the sheet cassettes 2201*a*, 2201*b*, 2201*c* and 2201*d* of the sheet storage units, and the sheet feeding rollers 2202*a*, 2202*b*, 2202*c*, 2202*d* (i.e. the sheet feeding rollers 2202) make contact with sheets on the top of the print sheets in the sheet cassettes 2201*a*, 2201*b*, 2201*c* and 2201*d*, and rotate to feed the sheets to the transportation path in the sheet driving unit 2230, respectively. The sheet feeding roller 2221 makes contact with a sheet on the top of print sheets on the manual sheet feeding tray 2220, and rotates to feed the sheets to the transfer roller 2203 via the transportation path in the sheet driving unit 2230. The transfer roller 2203 transfers the toner image formed on the photoconductor drum 2204 onto the transported sheet, and the fixing roller 2208 fixes the toner image transferred on the sheet by heating.

After that, the sheet is transported via the sheet outlet 2209 of the body part 2200 to the sheet postprocessing part 2300. Alternatively, the sheet may be output to the output sheet tray 2210. The output direction of the printed sheet can be changed between the sheet outlet 2209 and the postprocessing part 2300 by a sheet output switching cam 2215.

Residual amount sensors 2205*a*, 2205*b*, 2205*c* and 2205*d* are attached to the sheet cassettes 2201*a*, 2201*b*, 2201*c* and 2201*d*, respectively, to detect respective residual sheet amounts in them. The residual amount sensor 2205*a*, 2205*b*, 2205*c* or 2205*d* has a shape of "J" as shown in the figure, and rotates around a shaft on the top according to a decrease of the residual sheet amount, and detects the residual sheet amount based on the rotation. In addition, since a contact part for a sheet in the residual amount sensor 205*a*, 205*b*, 205*c* or 205*d* sinks into a hole (not shown) of the base of the sheet cassette (i.e. sheet feeding tray) when no sheets are stored, the residual amount sensor 205*a*, 205*b*, 205*c* or 205*d* is capable of detecting sheet empty.

It should be noted that the sheet feeding roller 2221 acts as a residual sheet amount sensor for the manual sheet feeding tray 2220.

The sheet postprocessing part 2300 has a sheet inlet 2301, a sheet transportation unit 2302, sheet outlets 2303, stack trays 2304, and so on. The stack trays 2304 includes an upper stack tray 2304*u* that receives a printed sheet via an upper sheet outlet 2303*u*, and a lower stack tray 2304*d* that receives a printed sheet via a lower sheet outlet 2303*d*.

The sheet transportation unit 2302 changes an outlet of a printed sheet input via the sheet inlet 2301 from the sheet outlet 2209 by a switching cam 2315 of the postprocessing part 2300, and transports the printed sheet either via the upper outlet 2303*u* to the upper stack tray 2304*u* or via the lower outlet 2303*d* to the lower stack tray 2304*d*.

The lower stack trays 2304*d* is capable of moving in the vertical direction according to the number of the printed sheets output via the lower sheet outlet 2303*d*.

An output sheet tray to which a printed sheet is output is selected from the output sheet tray 2210, the upper stack tray 2304*u*, and the lower stack tray 2304*d* by a sheet output switching control unit 2711.

[Functional Blocks]

Figure 11:
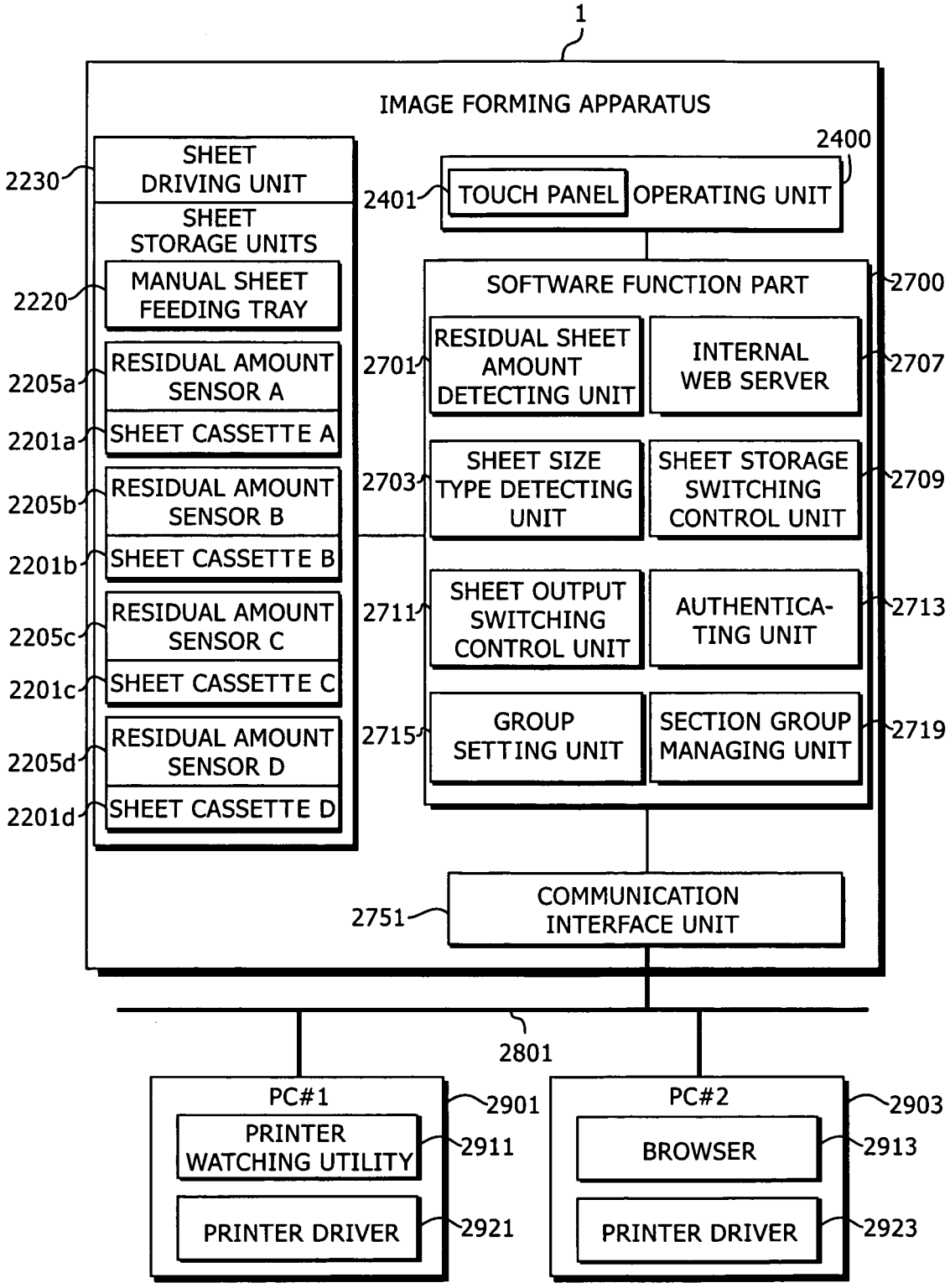
FIG. 11 shows a functional block diagram of the image forming apparatus according to Embodiment 3 of this invention.

FIG. 11 shows a functional block diagram of an image forming apparatus according to Embodiment 3.

This functional block diagram does not show other components which are generally installed in an image forming apparatus.

As shown in FIG. 11, the image forming apparatus 1 has a software function part 2700 and a communication interface unit 2751 as functional blocks together with the aforementioned sheet storage units (the sheet cassettes 2201*a*, 2201*b*, 2201*c* and 2201*d*, and the manual sheet feeding tray 2220), the sheet driving unit 2230, the operation unit 2400, the touch panel 2401 (a display unit), and so on.

The software function part 2700 has functional blocks of a sheet residual detecting unit 2701, a sheet size type detecting unit 2703, an internal web server 2707, a sheet storage switching control unit 2709, a sheet output switching control unit 2711, an authenticating unit 2713, a group setting unit 2715, and a section group managing unit 2719.

Further, the image forming apparatus 1 is connected to a network 2801 by the communication interface unit 2751, and is connected via the network 2801 to a PC (Personal Computer) #1 2901 and a PC (Personal Computer) #2 2903 connected to the network 2801.

In the following part, the functional blocks are explained.

The communication interface unit 2751 is an interface unit that connects the image forming apparatus 1 to the network. The image forming apparatus 1 communicates with an external device such as a personal computer by the communication interface unit 2751.

The software function part 2700 is embodied by executing a software program in a computer inside of the image forming apparatus 1. In the following part, the functional blocks in the software function part 2700 are explained.

The residual sheet amount detecting unit 2701 receives output signals from the residual amount sensors 2205*a*, 2205*b*, 2205*c* and 2205*d*, and detects residual amounts of sheets of paper stored in the sheet cassettes 2201*a*, 2201*b*, 2201*c* and 2201*d*, and detects sheet empty on any of the sheet cassettes 2201*a*, 2201*b*, 2201*c* and 2201*d*.

The sheet size type detecting unit 2703 receives sheet size signals from frame members, and signals from sensors positioned on the sheet transportation path, and detects respective sheet sizes, respective sheet types and so on of the sheets in the sheet cassettes 2201*a*, 2201*b*, 2201*c* and 2201*d* based on the signals. The frame members fit sheets and detect sheet sizes of them in the sheet cassettes 2201*a*, 2201*b*, 2201*c* and 2201*d*.

Some sheet types such as thick paper, color paper and one-side used paper are not detected by those sensors and the frame members. For such sheet types, the group setting maintaining unit 2715 sets the sheet type according to a user input.

The internal web server 2707 has the same function as that of the internal web server 707. The internal web server 2707 can provide a setting screen (mentioned below) for setting a sheet storage unit to be substituted.

The sheet storage switching control unit 2709 controls the sheet driving unit 2230 to automatically change a sheet storage unit from which a sheet is fed when all sheets in the sheet storage unit in a group are consumed, and to continuously feed a sheet from another one of the sheet storage units (the sheet cassettes and the manual feeding tray) in the group without stopping printing.

If a sheet storage unit used to feed a sheet is automatically changed to another one in a group, then the apparatus may print on a sheet that a user does not intend to use in some cases, for example, a case that sheet storage units with different sheet sizes and/or different sheet types belongs to the group. Therefore, there is a setting of whether or not the automatic change of sheet storage unit is performed. The apparatus operates according to this setting.

For example, in a case that a group contains TRAY#1, TRAY#2, and TRAY#3, and TRAY#1 has a sheet of A4 plain paper, TRAY#2 has a sheet of A4 plain paper, and TRAY#3 has a sheet of A3 plain paper, the setting can be set as the automatic change can be performed only between TRAY#1 and TRAY#2, and the automatic change is performed neither between TRAY#1 and TRAY#3 nor between TRAY#2 and TRAY#3.

When a sheet supply request from a group to another group occurs and the request specifies sheet attributions, the sheet storage switching control unit 2709 controls the sheet driving unit to feed a sheet with the specified sheet attributions from a sheet storage unit in the another group. For example, when sheet empty of A4 paper on a sheet storage unit in a group used by a user section, a sheet supply request occurs due to a user's request or automatically in order to feed a sheet of A4 paper from a sheet storage unit in another group. When a sheet supply request occurs, the sheet storage switching control unit 2709 changes a sheet storage unit used to feed a sheet.

In addition to sheet empty, for example, in a case that a section (e.g. a sales department) often uses OHP (OverHead Projector) sheets and stores OHP sheets on a sheet storage unit in a group corresponding to the section, but another section (e.g. a general affairs department) does not store OHP sheets on a sheet storage unit in another group corresponding to the another section, a sheet supply request occurs when the another section (e.g. the general affairs department) borrows and uses OHP sheets from the section (e.g. the sales department).

In any of the aforementioned cases, the section group managing unit 2719 makes and maintains a record of borrowing and lending a sheet between sections.

The section group managing unit 2719 assigns the sheet output trays (i.e. the sheet output tray 2210, the upper stack tray 2304*u*, and the lower stack tray 2304*d*) to groups, and the sheet output switching control unit 2711 causes a printed sheet of a group to be output only to the sheet output tray assigned to the group. Specifically, the sheet output switching control unit 2711 controls the switching cams 2215 and 2315 to set a sheet output tray to which a printed sheet is output.

When the key lockable open-shut member 2211 of the sheet output tray 2210 is locked, users in another section can not see a printed sheet in the sheet output tray 2210.

The section group managing unit 2719 manages relationships between the sheet output trays and the groups, and the sheet output switching control unit 2711 operates together with the section group managing unit 2719.

The authenticating unit 2713 determines whether or not a user belongs to any of sections. The authenticating unit 2713 may determine that a user belongs to a group selected by a user operation to the operation unit 2400. Alternatively, the authenticating unit 2713 may determine whether or not a user belongs to any of user sections according to a section ID and a section password input by a user. Alternatively, the authenticating unit 2713 may determine whether or not a user belongs to any of user sections through a user authentication based on a user ID and a user password input by a user. These IDs and passwords may be read out from an ID card such as RFID (Radio Frequency Identification), IC card, or magnetic card.

The group setting unit 2715 maintains a group setting based on an input to forming groups from sheet storage units. One or more of the sheet storage units can belong to a group. All of the sheet storage units do not need to belong to any of groups, and one or more of the sheet storage units may not belong to any of groups.

Further, the group setting unit 2715 maintains a setting based on an input to add the sheet output trays to the aforementioned groups.

The section group managing unit 2719 identifies a user section corresponding to a group according to the record maintained by the group setting unit 2715, and makes records of consuming sheets fed from the sheet storage units for user sections in order to perform a section management.

In addition, the section group managing unit 2719 associates a sheet output tray in the group with a user section, and causes a printed sheet of the user section to be output to the sheet output tray. Therefore, printed sheets of different user sections are not mixed on a sheet output tray.

The section group managing unit 2719 controls feeding a sheet from a current sheet storage unit according to an instruction from the sheet storage switching control unit 2709.

The section group managing unit 2719 controls outputting a sheet to a current sheet output tray according to an instruction from the sheet output switching control unit 2711.

Table 3 shows an example of records (i.e. group settings) maintained by the section group managing unit 2719.

TABLE 3

| # | GROUP | SHEET FEEDING TRAY IN THE GROUP | SHEET OUTPUT TRAY IN THE GROUP | USER SECTION | TOTAL NUMBER OF CONSUMED SHEETS | RECORD OF LENDING AND BORROWING SHEETS |
|---|---|---|---|---|---|---|
| 1 | A | TRAY#1, TRAY#4 | LOWER STACK TRAY | SALES DEPT | 638 | LEND 120 SHEETS (A4) TO GROUP B |
| 2 | B | TRAY#2, TRAY#3 | OUTPUT TRAY, UPPER STACK TRAY | GENERAL AFFAIRS DEPT | 232 | BORROW 120 SHEETS (A4) FROM GROUP A |

In Table 3, two groups A and B of sheet storage units have been set. The group A contains TRAY#1 and TRAY#4, and the group B contains TRAY#2 and TRAY#3. In Embodiment 3, TRAY#1, TRAY#2, TRAY#3, and TRAY#4 mean the sheet cassettes 2201*a* to 2201*d*, respectively.

The lower stack tray 2304*d* belongs to the group A, and the sheet output tray 2210 and the upper stack tray 2304*u* belong to the group B.

Each of the groups is associated with a user section. For example, as shown in Table 3, the group A is associated with a sales department, and is used only by a user of the sales department, and the group B is associated with a general affairs department, and is used only by a user of the general affairs department.

In addition, Table 3 shows that the total number of sheets consumed by the group A (i.e. the sales department) is 638, and the total number of sheets consumed by the group B (i.e. the general affairs department) is 232.

The section group managing unit 2719 and the sheet output switching control unit 2711 operates together to output a printed sheet of a user to the sheet output tray corresponding to the group to which the user belongs.

In Embodiment 3, at least the sheet output tray 2210 of the sheet output trays has the key lockable open-shut member 2210, and therefore confidential documents or the like can be output to the sheet output tray 2210. In Embodiment 3, two or more sheet output trays may have key lockable open-shut members.

The section group managing unit 2719 allows to borrow and lend a sheet between sections in an urgent situation, and makes a record of borrowing and lending a sheet between sections (i.e. between groups).

Usually, a user only uses a sheet of paper fed from the sheet storage units in a group corresponding to a section of the user. However, when there are no sheets on the sheet storage units in a group corresponding to a section of the user, the user can borrow a sheet from another section (i.e. another group of sheet storage units).

In advance, the apparatus has set one or more combinations of groups of which one group can borrow a sheet from the other group in an urgent situation. For example, when the sales department tries to print a A4 document on a sheet fed from TRAY#1, but TRAY#1 has no sheets and TRAY#4 has sheets of A3 paper, the sale department borrows a sheet of A4 paper from TRAY#3 of the general affairs department. The section group managing unit 2719 makes a record of borrowing and lending a sheet between the sales department and the general affairs department. Table 3 has records of borrowing and lending a sheet, that is, records of borrowing sheets of A4 paper from the group A to the group B.

The section group managing unit 2719 causes the records to be printed at least one of timings: (a) a preset time, (b) every time interval, and (c) when the number of records exceeds a predetermined threshold. The records are printed repeatedly at the aforementioned timings, and therefore a user tends not to forget that sheets were borrowed/lent between sections.

It is possible to set whether or not the records are printed. Further, it is possible to set one or more of the aforementioned timings to print the records.

[User Interface Screen for Forming a Group]

A user interface screen for forming a group in Embodiment 3 is the same as that in Embodiment 1, and therefore, it is not explained here.

Advantages of Embodiment 3

In Embodiment 3, groups are formed from sheet storage units, and the groups are associated with user sections, respectively, and sheet consumption by the user sections is recorded. Therefore, the image forming apparatus can perform a section management. Further, in Embodiment 3, sheet output trays are associated with the groups, and therefore it prevents a user from taking a printed sheet of another section by mistake. Further, in Embodiment 3, in an urgent situation such as sheet empty, a sheet can be borrowed/lent between sections.

The section group managing unit identifies a group corresponding to a user section, and makes a record of sheet consumption by the user section. Therefore, it is possible to perform a section management on each of groups. The section group managing unit can form and maintain a group of sheet storage units that store sheets with different sheet attributions. Therefore, a section uses sheets with different sheet attributions.

In Embodiment 3, not only sheet storage units but also sheet output trays belong to groups. Therefore, a user tends not to take a printed sheet of another section by mistake.

Further, in Embodiment 3, a printed sheet can be output to a sheet output tray with a key lockable open-shut member. Therefore, it is possible to prevent users of another section from seeing the printed sheet (e.g. a confidential document) in the sheet output tray with a key lockable open-shut member.

When a sheet is borrowed/lent between groups, the section group managing unit 2719 controls the sheet storage switching control unit to borrow and use a sheet fed from another group to print. Therefore, in an urgent situation such as sheet empty or no paper stocks in a group, the group can borrow a sheet from another group to print.

A record of borrowing/lending a sheet of paper is printed at least one of timings: (a) a preset time, (b) every time interval, and (c) when the number of records exceeds a predetermined threshold. Therefore, a user tends not to forget that sheets were borrowed/lent between sections.

In Embodiment 3, the image forming apparatus 1 is an example of a relatively high performance image forming apparatus. This invention is not limited to this embodiment, and it can also be applied to an image forming apparatus without optional parts and units such as the document feeding part 600, the document scanning unit 500 and the postprocessing part 300.

Embodiment 4

Hereinafter, an image forming apparatus of Embodiment 4 is explained.

[Machine Configuration]

A mechanical configuration of the image forming apparatus in Embodiment 4 is identical to that in Embodiment 1, and therefore, it is not explained here.

[Functional Blocks]

Figure 12:
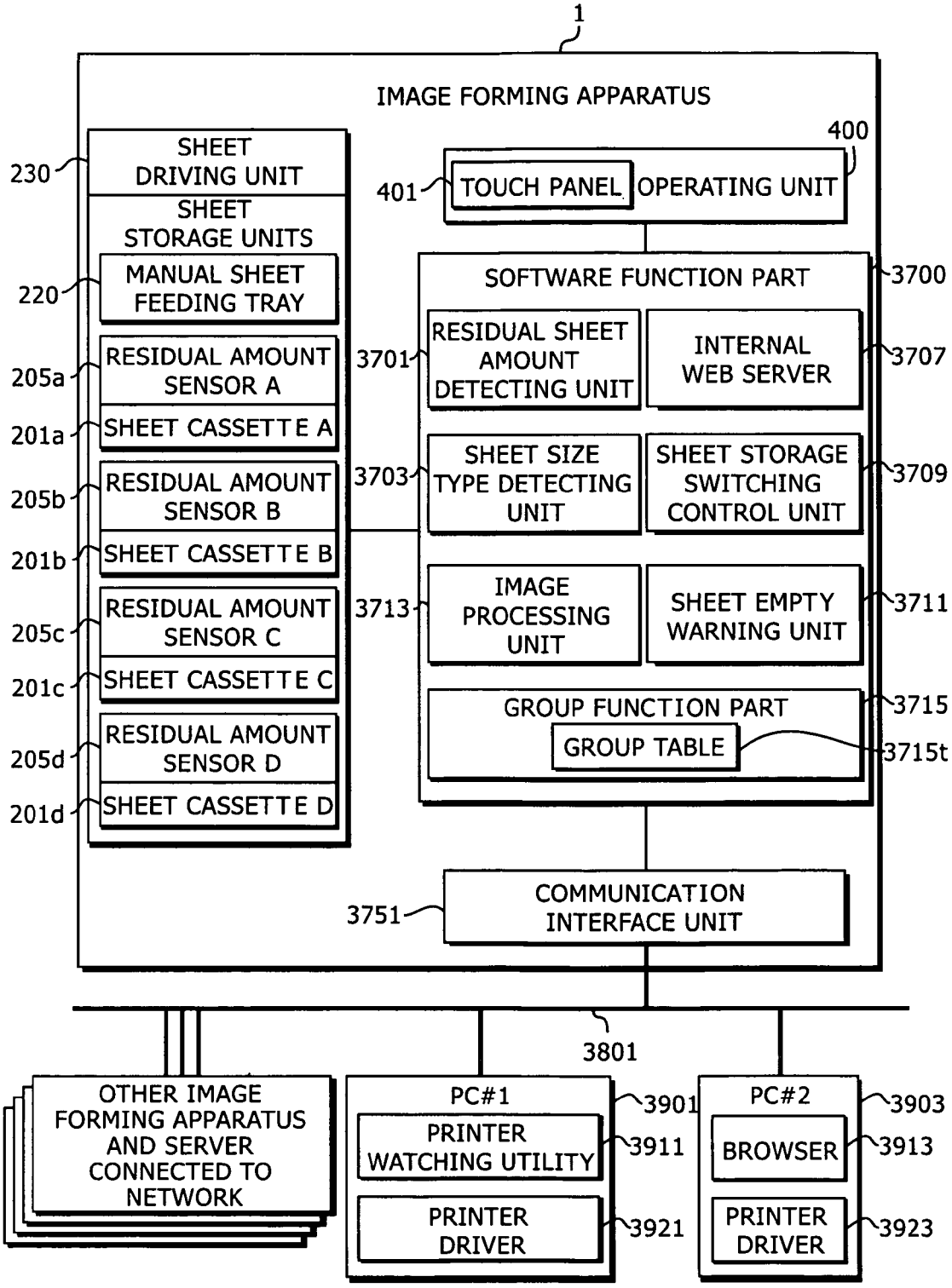
FIG. 12 shows a functional block diagram of an image forming apparatus according to Embodiment 4 of this invention.

FIG. 12 shows a functional block diagram of an image forming apparatus according to Embodiment 4.

This functional block diagram does not show other components which are generally installed in an image forming apparatus.

As shown in FIG. 12, the image forming apparatus 1 has a software function part 3700 and a communication interface unit 3751 as functional blocks together with the aforementioned sheet storage units (the sheet cassettes 201*a*, 201*b*, 201*c* and 201*d*, and the manual sheet feeding tray 220), the sheet driving unit 230, the operation unit 400, the touch panel 401 (including a display unit), and so on.

The software function part 3700 has a sheet residual detecting unit 3701, a sheet size type detecting unit 3703 (as a sheet attribution detecting unit), an internal web server 3707, a sheet storage switching control unit 3709, a sheet empty warning unit 3711, an image processing unit 3713, and a group function part 3715.

Further, the image forming apparatus 1 is connected to a network 3801 (as electronic communication channels) by the communication interface unit 3751, and is connected via the network 3801 to a PC (Personal Computer) #1 3901 and a PC (Personal Computer) #2 3903 connected to the network 3801. The image forming apparatus 1 is also connected via the network 3801 to a management server 3101. The image forming apparatus 1 can form a group that contains a sheet storage unit in another image forming apparatus. The management server 3101 has a group management function. These connections will be explained in detail below with reference to FIGS. 14 and 15.

In the following part, the functional blocks are explained.

The communication interface unit 3751 is an interface unit that connects the image forming apparatus 1 to the network 3801. The image forming apparatus 1 communicates with an external device such as a personal computer by the communication interface unit 3751. The image forming apparatus 1 also communicates with another image forming apparatus and the management server 3101 by the communication interface unit 3751 for a network group of sheet storage units.

The software function part 3700 is embodied by executing a software program in a computer inside of the image forming apparatus 1.

The residual sheet amount detecting unit 3701 receives output signals from the residual amount sensors 205*a*, 205*b*, 205*c* and 205*d*, and detects residual amounts of sheets of paper stored in the sheet cassettes 201*a*, 201*b*, 201*c* and 201*d*, and detects sheet empty on any of the sheet cassettes 201*a*, 201*b*, 201*c* and 201*d*.

The sheet size type detecting unit 3703 receives sheet size signals from frame members, and signals from sensors positioned on the sheet transportation path, and detects respective sheet sizes, respective sheet types and so on of the sheets in the sheet cassettes 201*a*, 201*b*, 201*c* and 201*d* based on the signals. The frame members fit sheets and detect sheet sizes of them in the sheet cassettes 201*a*, 201*b*, 201*c* and 201*d*.

Some sheet types such as thick paper, color paper and one-side used paper are not detected by those sensors and the frame members. For such sheet types, the group function part 3715 sets the sheet type according to a user input.

The internal web server 3707 has the same function as that of the internal web server 707.

The sheet storage switching control unit 3709 has the same function as that of the sheet storage switching control unit 709.

The sheet empty warning unit 3711 warns of sheet empty on one of the sheet storage units in a group when all sheets are consumed for printing in the sheet storage unit.

The image processing unit 3713 converts print job data to data in a format compatible with the printing unit 240. When print job data from the printer driver 3921 is described in a page description language, the image processing unit 3713 converts print job data described in a page description language to data in a bitmap format compatible with the printing unit 240.

Figure 13:
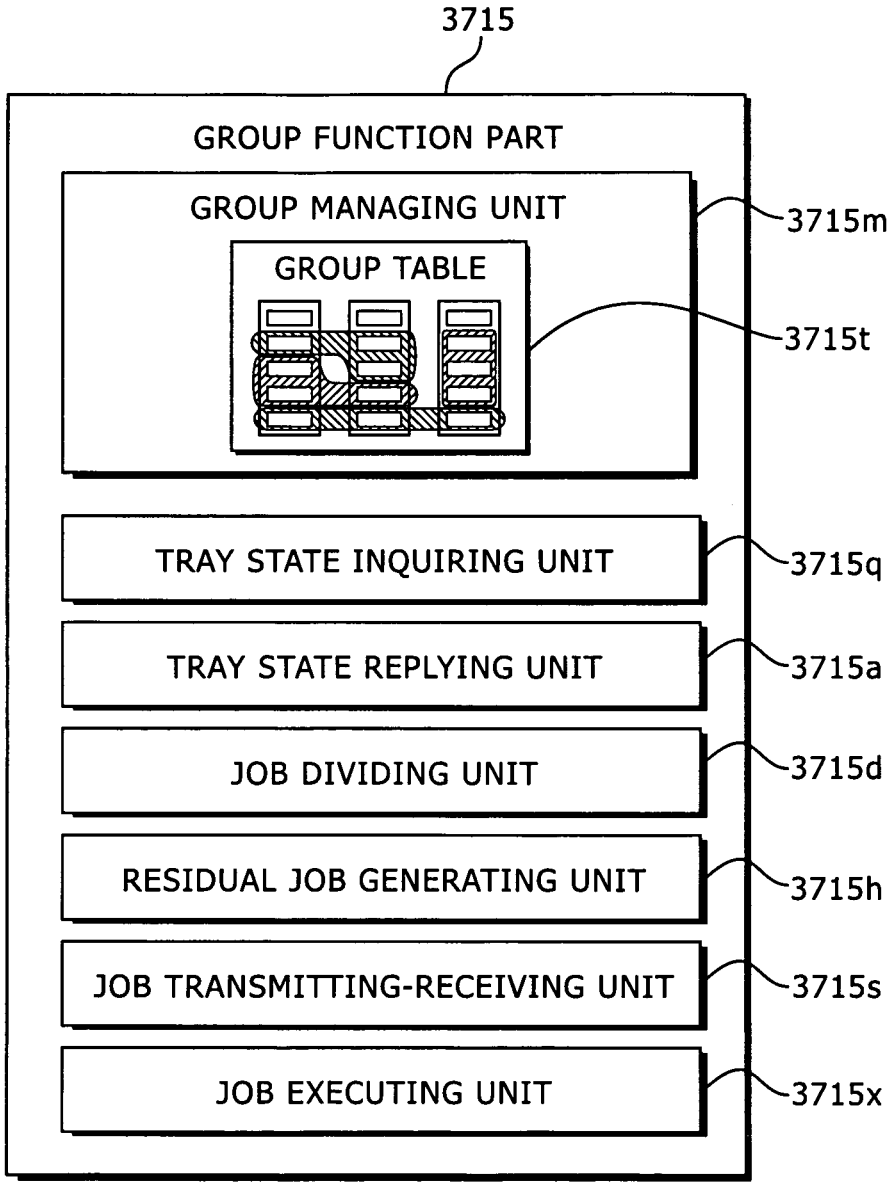
FIG. 13 shows a functional block diagram of the grouping function part in the image forming apparatus according to Embodiment 4 of this invention.

The group function part 3715 performs a grouping function in the image forming apparatus 1. With reference to FIG. 13, the group function part 3715 is explained in detail.

As shown in FIG. 13, the group function part 3715 has functional blocks of a group managing unit 3715*m*, a tray state inquiring unit 3715*q*, a tray state replying unit 3715*a*, a job dividing unit 3715*d*, a residual job generating unit 3715*h*, a job transmitting-receiving unit 3715*s* (as a job transmitting unit and a job receiving unit), and a job executing unit 3715*x*. In the following part, the functional blocks are explained.

The group managing unit 3715*m* receives an input to form a group of sheet storage units, and makes and maintains a record of the group based on the input. The group managing unit 3715*m* is capable of forming groups of the sheet cassettes (as a grouping function). In general, a group is formed from the sheet cassettes of the same sheet size and the same sheet type. However, a group may be formed from the sheet cassettes of the different sheet sizes and/or the different sheet types. For example, a maintenance person inputs a default group setting when no sheets are in the sheet storage units. In this case, when the maintenance person inputs the setting, he/she does not know whether or not all of the sheet storage units in the group have sheets of the same sheet size and the same sheet type in the future.

This image forming apparatus 1 has a grouping function. This grouping function enables to perform printing on a lot of sheets in excess of the maximum sheet capacity of the sheet cassette. Therefore, it is possible to continuously perform printing until all sheets in all of the sheet cassettes in the group are consumed. This is one of the largest advantages of the grouping function.

The group may be formed according to an input to the operation panel 400, according to an instruction received via the communication interface unit 3751 from a printer watching utility 3911 of a PC#1 3901 as an external device, or by using a setting function of the internal web server 3707 from a browser 3913 of a PC#2 3903 as an external device.

The group managing unit 3715*m* is capable of forming a group of sheet storage units not only in this image forming apparatus of this group managing unit 3715*m*, but also in another image forming apparatus connected via the network to this image forming apparatus. In other words, the group managing unit 3715*m* can form a group that ranges between two or more image forming apparatuses. Hereinafter, a group that contains sheet storage units in two or more image forming apparatuses is called as "network group," and a function to form a network group is called as "network grouping function." Therefore, when sheet empty occurs on a sheet storage unit in a network group due to printing in an image forming apparatus of this group managing unit 3715*m*, another image forming apparatus which has another sheet storage unit in the network group is used to print. The group managing unit 3715*m* makes a record of forming a group (including a network group), and maintains the record in a group table 3715*t*. Therefore, the group table 3715*t* may have a record of a group of sheet storage units in only one of the image forming apparatus, and a record of a network group. Records in the group table will be explained below with reference to FIGS. 14 and 15.

In addition, forming a group or a network group, and transmitting and receiving necessary information of it will be explained below with reference to FIG. 16.

The group managing unit 3715*m* transmits the group table 3715*t* to a group managing unit of another image forming apparatus, and receives a group table from the group managing unit of another image forming apparatus. Each of the image forming apparatuses connected via the network to each other merges the group tables, and respective ones of the image forming apparatuses have the same group tables 3715*t*.

The image forming apparatuses in Embodiment 4 have a parallel printing function based on the network grouping function. The parallel printing function distributes respective print jobs (i.e. print instructions) to sheet storage units in a network group, and enables the image forming apparatuses to print in parallel. As a result, total time of printing is clearly reduced.

The tray state inquiring unit 3715*q* sends an inquiry to another image forming apparatus to inquire a state of a sheet storage unit in a network group. Specifically, it inquires whether or not a sheet storage units in the network group has a correct sheet (i.e. a sheet with a correct sheet size, a correct sheet type, and so on), and whether or not a sheet storage unit in the network group has sheets of paper more than an expected usage amount for printing.

The tray state replying unit 3715*a* sends a reply on a state of the sheet storage unit to the inquiry received from a tray state inquiring unit (same as the tray state inquiring unit 3715*q*) in another image forming apparatus. Specifically, the tray state replying unit 3715*a* obtains information on sheets stored in the sheet storage unit from the residual sheet amount detecting unit 3701 and the sheet size type detecting unit 3703, and sends a reply based on the information.

The job dividing unit 3715*d* divides a print job into divisional print jobs to perform parallel printing in the image forming apparatuses. The number of the divisional print jobs is the same as the number of the image forming apparatuses to be used for parallel printing.

When sheet empty occurs on a sheet storage unit before finishing the print job while the image forming apparatus 1 is printing according to a print job received from the printer driver 3921 of the PC#1 3901, the residual job generating unit 3715*h* generates a print job to be executed by another image forming apparatus to execute a residual part of the unfinished print job. The print job generated by the residual job generating unit 3715*h* is transmitted to the another image forming apparatus, and the another image forming apparatus executes the print job.

The job transmitting-receiving unit 3715*s* transmits a print job generated by the job dividing unit 3715*d* or the residual job generating unit 3715*h* to another image forming apparatus, and receives a print job generated by a job dividing unit of another image forming apparatus (same as the job dividing unit 3715*d*) or a residual job generating unit of another image forming apparatus (same as the residual job generating unit 3715*h*). The job transmitting-receiving unit 3715*s* communicates with another image forming apparatus via the communication interface unit 3751 to transmit and receive print jobs.

The job executing unit 3715*x* executes a print job received by the job transmitting-receiving unit 3715*s*, and causes the printing unit of this image forming apparatus 1 to print based on the received print job.

[Network Configuration]

Figure 14:
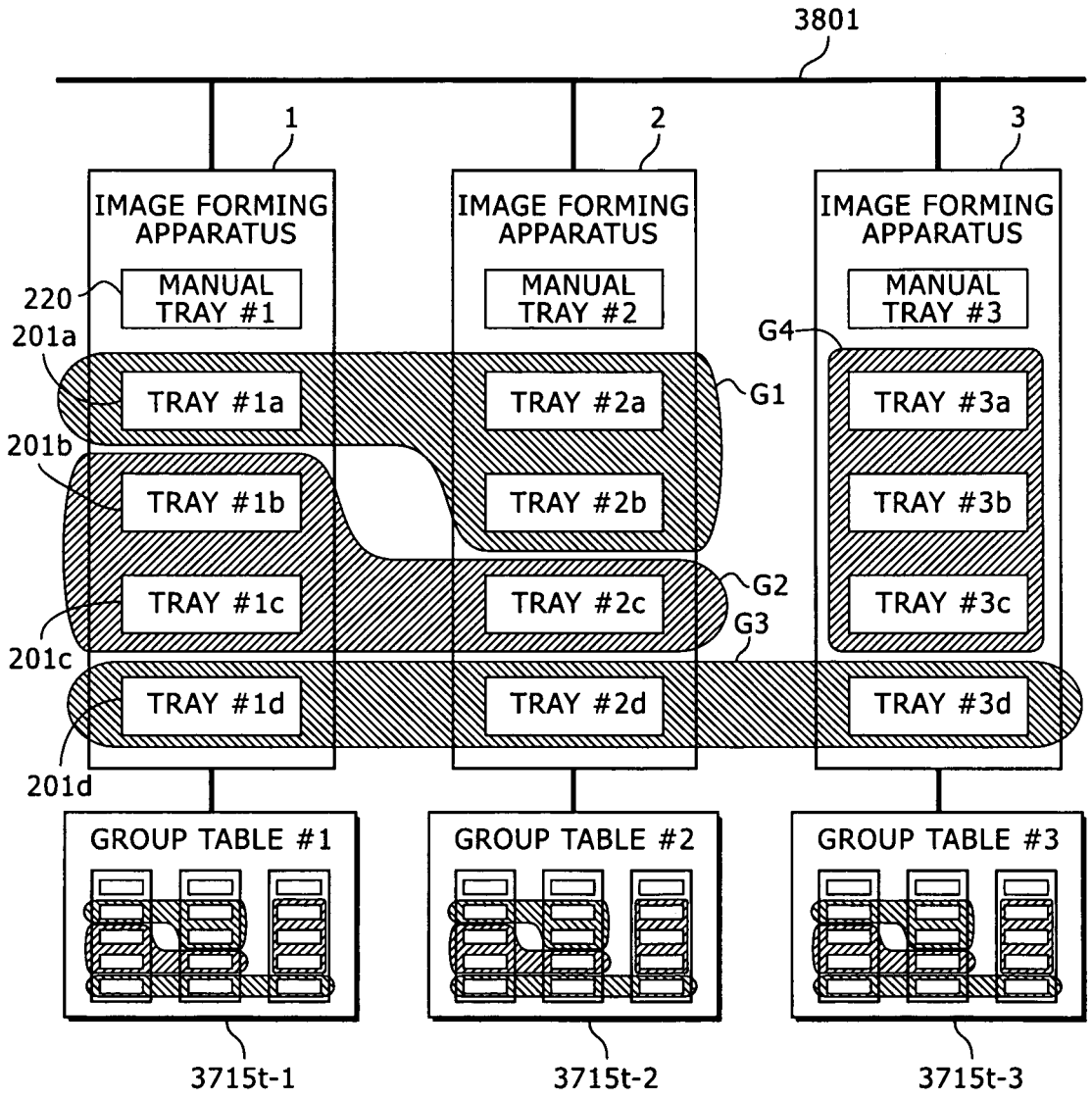
FIG. 14 shows a network configuration of image forming apparatuses without a management server according to Embodiment 4 of this invention.

FIG. 14 shows a network configuration of image forming apparatuses without a management server according to Embodiment 4. Three image forming apparatuses (i.e. the image forming apparatus 1, an image forming apparatus 2, and an image forming apparatus 3), of which each has the same configuration shown in FIGS. 1, 12 and 13, are connected via the network 3801 to each other.

In FIG. 14, the manual sheet feeding tray 220 of the image forming apparatus 1 is depicted as MANUAL TRAY #1; and the sheet cassettes 201*a*, 201*b*, 201*c* and 201*d* of the image forming apparatus 1 are depicted as TRAY #1*a*, TRAY #1*b*, TRAY #1*c* and TRAY #1*d*. Similarly, in FIG. 14, trays 220 and cassettes 201*a*, 201*b*, 201*c* and 201*d* in the image forming apparatuses 2 and 3 are depicted as well as those in the image forming apparatus 1.

FIG. 14 shows four groups (that is, network groups G1 to G3 and a group G4) formed in the image forming apparatuses.

(Group G1) The network group G1 has been formed from three trays: TRAY #1*a* of the image forming apparatus 1, TRAY #2*a* and TRAY #2*b* of the image forming apparatus 2.

(Group G2) The network group G2 has been formed from three trays: TRAY #1*b* and TRAY #1*c* of the image forming apparatus 1, and TRAY #2*c* of the image forming apparatus 2.

(Group G3) The network group G3 has been formed from three trays: TRAY #1*d* of the image forming apparatus 1, TRAY #2*d* of the image forming apparatus 2, and TRAY #3*d* of the image forming apparatus 3.

(Group G4) The group G4 has been formed from three trays inside one of the image forming apparatuses: TRAY #3*a*, TRAY #3*b*, and TRAY #3*c* inside of the image forming apparatus 3.

Setting information on the groups is recorded in the group table 3715*t*. Here, a group table 3715*t*-*i* (i=1, 2, or 3) in the figure is the group table 3715*t* in the image forming apparatus i. The group tables 3715*t*-1 to 3715*t*-3 are merged in the image forming apparatuses 1 to 3. Each of the merged group tables 3715*t*-1 to 3715*t*-3 has same records, and the merged group tables 3715*t*-1 to 3715*t*-3 are maintained by the group managing parts 3715*m* of the image forming apparatuses 1 to 3, respectively.

Figure 15:
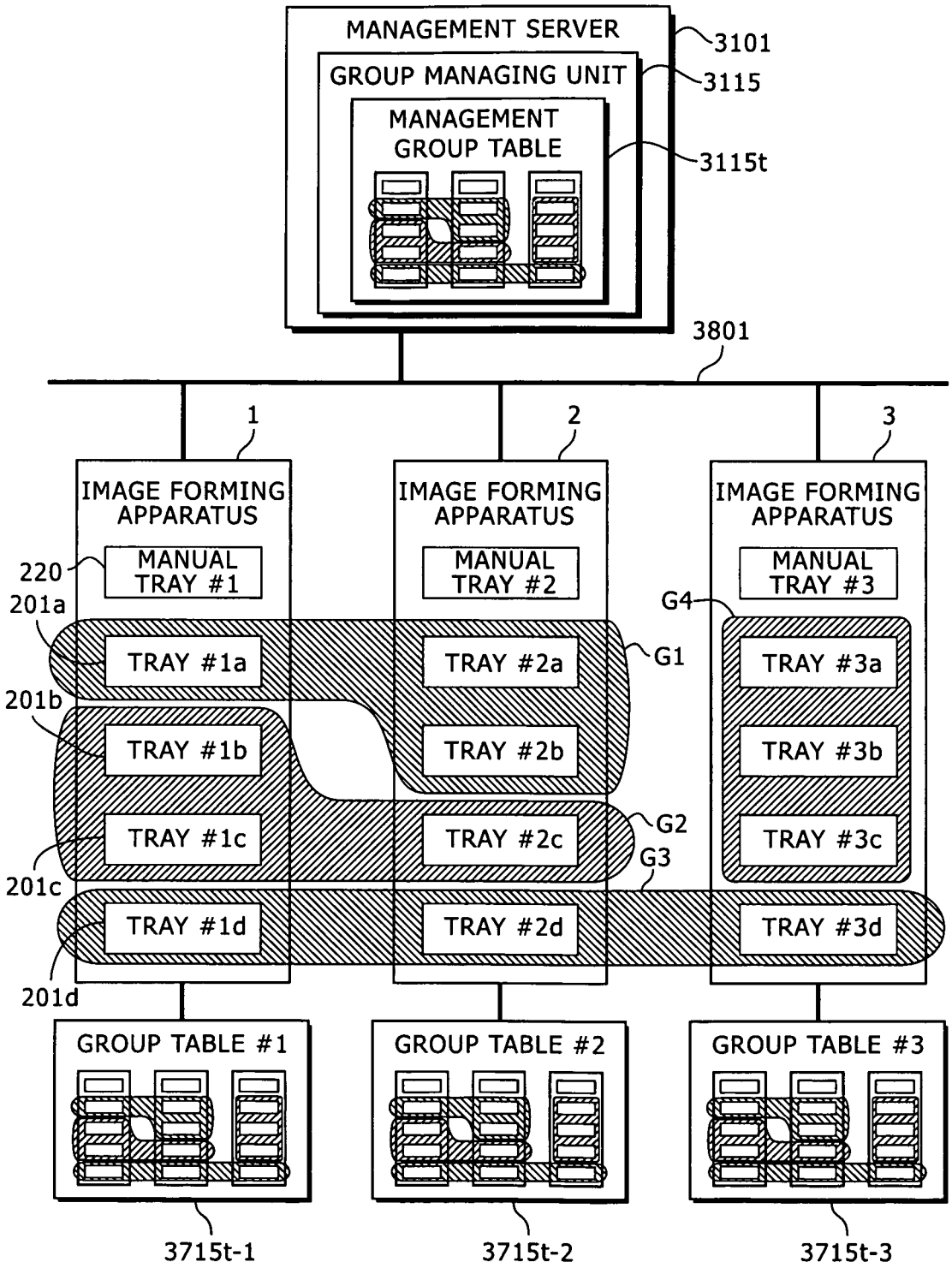
FIG. 15 shows a network configuration of image forming apparatuses with a management server according to Embodiment 4 of this invention.

FIG. 15 shows a network configuration of image forming apparatuses with a management server according to Embodiment 4. The management server 3101 has a group managing unit 3115, and maintains a management group table 3115*t* that contains group setting information. When the management group table 3115*t* is generated or updated, the management server 3101 transmits the management group table 3115*t* to the image forming apparatuses 1, 2 and 3. The management group table 3115*t* is received and maintained as the group table 3715*t*-1, 3715*t*-2 or 3715*t*-3 by the group managing part 3715*m* in each of the image forming apparatuses 1, 2 and 3.

The group managing unit 3115 may generate the management group table 3115*t* based on necessary information (e.g. configuration and settings of sheet storage units in the image forming apparatuses). The management server 3101 may communicate with the image forming apparatuses to obtain the necessary information. This necessary information is explained in detail below.

[Forming a Group from Sheet Storage Units]

Figure 16:
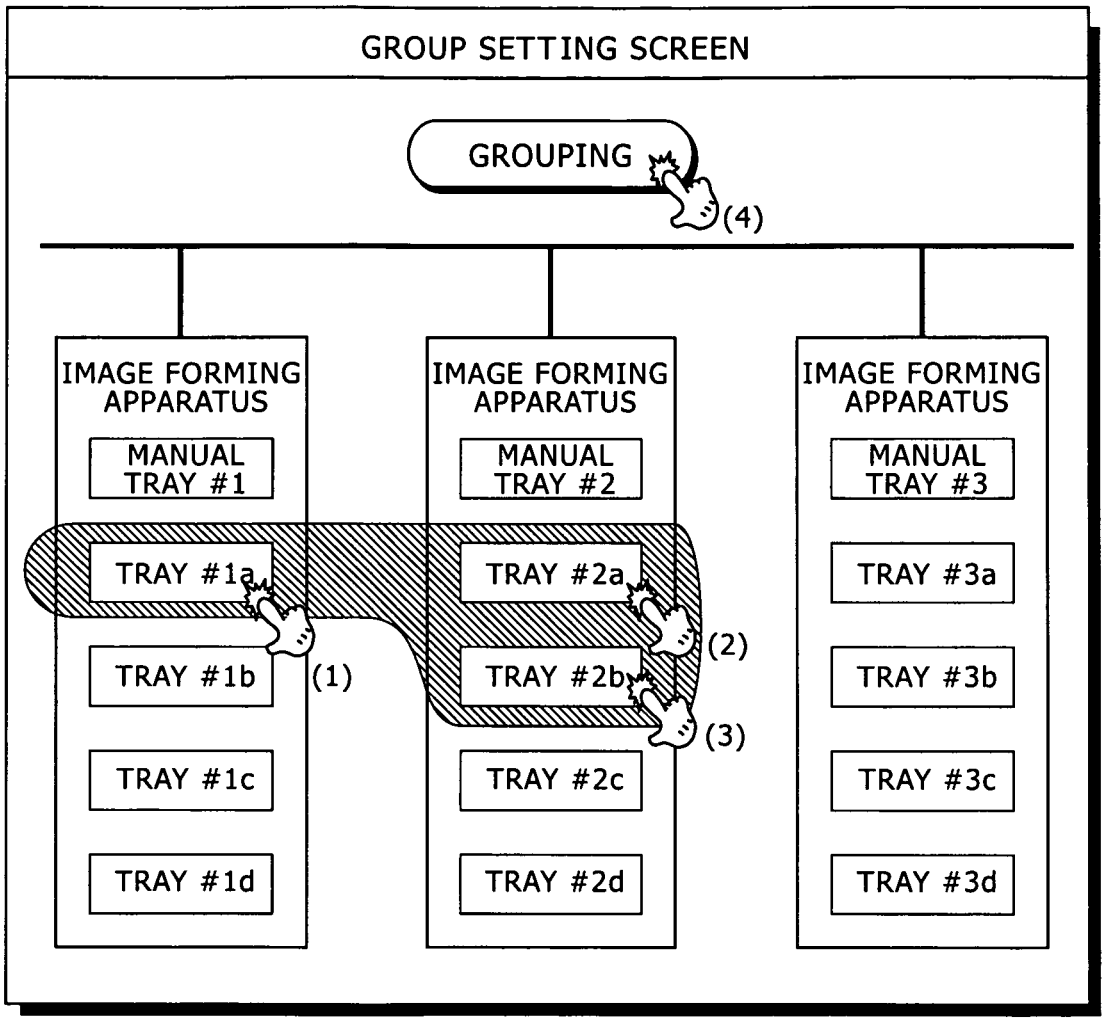
FIG. 16 shows a user interface screen for forming a group in the image forming apparatus according to Embodiment 4 of this invention.

FIG. 16 shows a user interface screen displayed as one of screens: a screen of the touch panel 401 in the image forming apparatus 1, a screen of the printer watching utility 3911, and a screen of the browser 3913 used to access the internal web server 3707. A user inputs instructions to form a group from sheet storage units on the user interface screen.

As shown in FIG. 16, for example, when a user wants to make the group G1, the user chooses TRAY #1*a* of the image forming apparatus 1 with a user operation (1), and TRAY #2*a* and TRAY #2*b* of the image forming apparatus 2 with user operations (2) and (3), and then chooses and pushes down GROUPING button.

The group table 3715*t* is generated based on setting information on a group formed in this way. This group table 3715*t* is transmitted from either the image forming apparatus 1, 2 or 3 that generates it or the management server 3101 to each of the image forming apparatuses 1 to 3, and maintained by each of the image forming apparatuses 1 to 3. When the group table 3715*t* is changed, the changed group table is transmitted again, and the image forming apparatuses 1 to 3 receive it and update the group table 3715 with the received one by merging the both.

Transmitting and receiving the group table 3715*t* are carried out by the group managing part 3715*m* in each of the image forming apparatuses. In a case that the management server 3101 is in an image forming system of the image forming apparatuses, some information is transmitted and received among the group management parts 3715*m* of the image forming apparatuses and the group managing unit 3115 of the management server.

This information is on configurations of sheet storage units in the image forming apparatuses. In the case shown in FIG. 14 or FIG. 15, the image forming apparatuses have sheet storage units in the same configuration, but the image forming apparatuses may have sheet storage units in the different configurations. Therefore, this information is necessary to generate the group table 3715*t*, and is transmitted and received among them. Transmitting and receiving this information is carried out before forming a group among the image forming apparatuses (among the image forming apparatuses and the management server, if the management server exists), and then the configurations of the sheet storage units can be indicated in the interface screen for forming a group.

Like the group G4 in the image forming apparatus 3 in FIGS. 14 and 15, if a group has been formed of sheet storage units in only one of the image forming apparatus, then setting information on the group is also transmitted and received among the group managing parts 3715*m* of the image forming apparatuses (among the group managing parts 3715*m* and the group managing unit 3115 of the management server, if the management server exists).

The setting information may contain configuration information on the sheet storage units, and sheet attribution information such as sheet size, sheet type, and sheet orientation.

[Flowchart]

Figure 17:
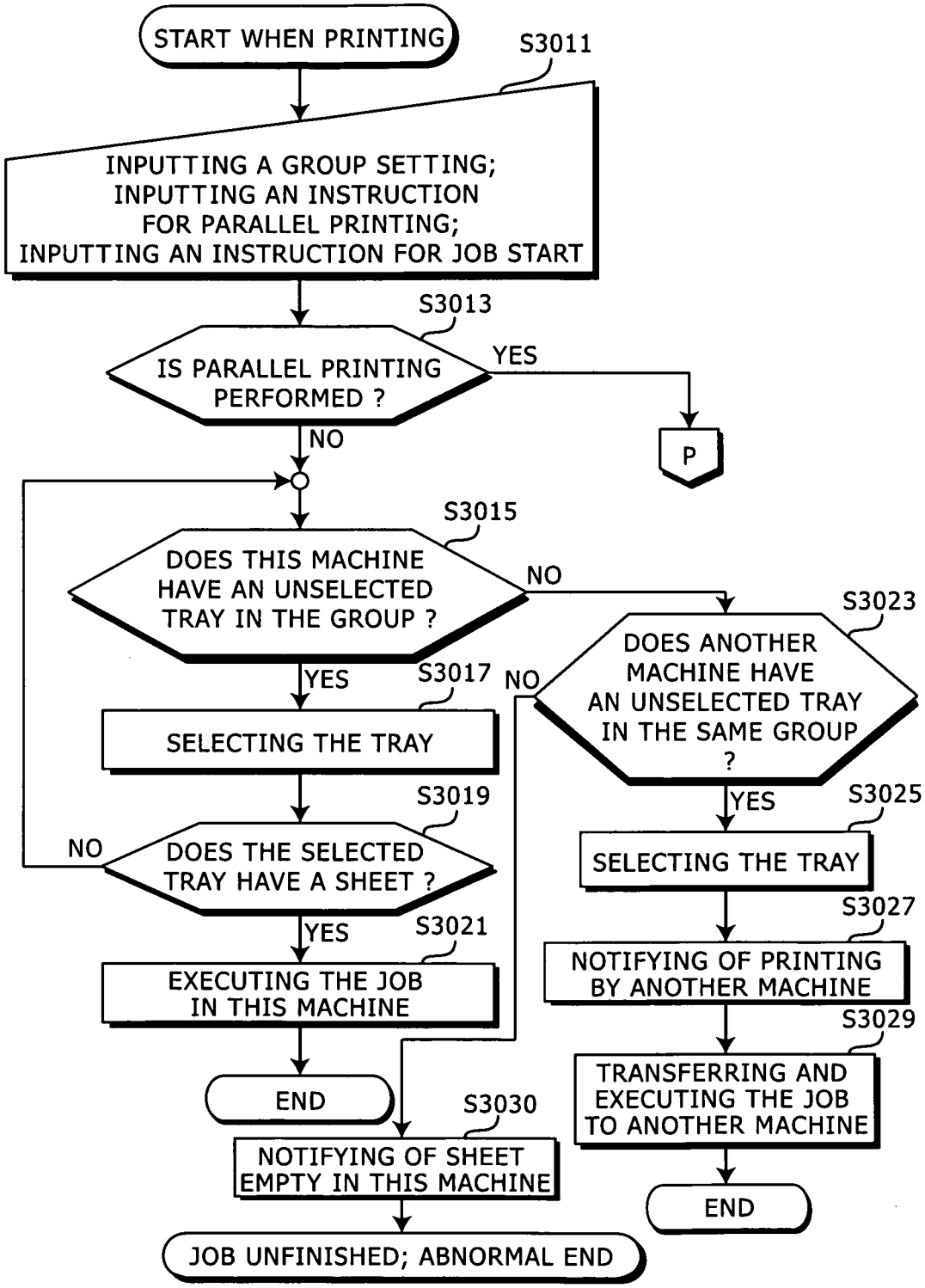
FIG. 17 shows a flowchart of executing a print job in the image forming apparatus according to Embodiment 4 of this invention.
Figure 18:
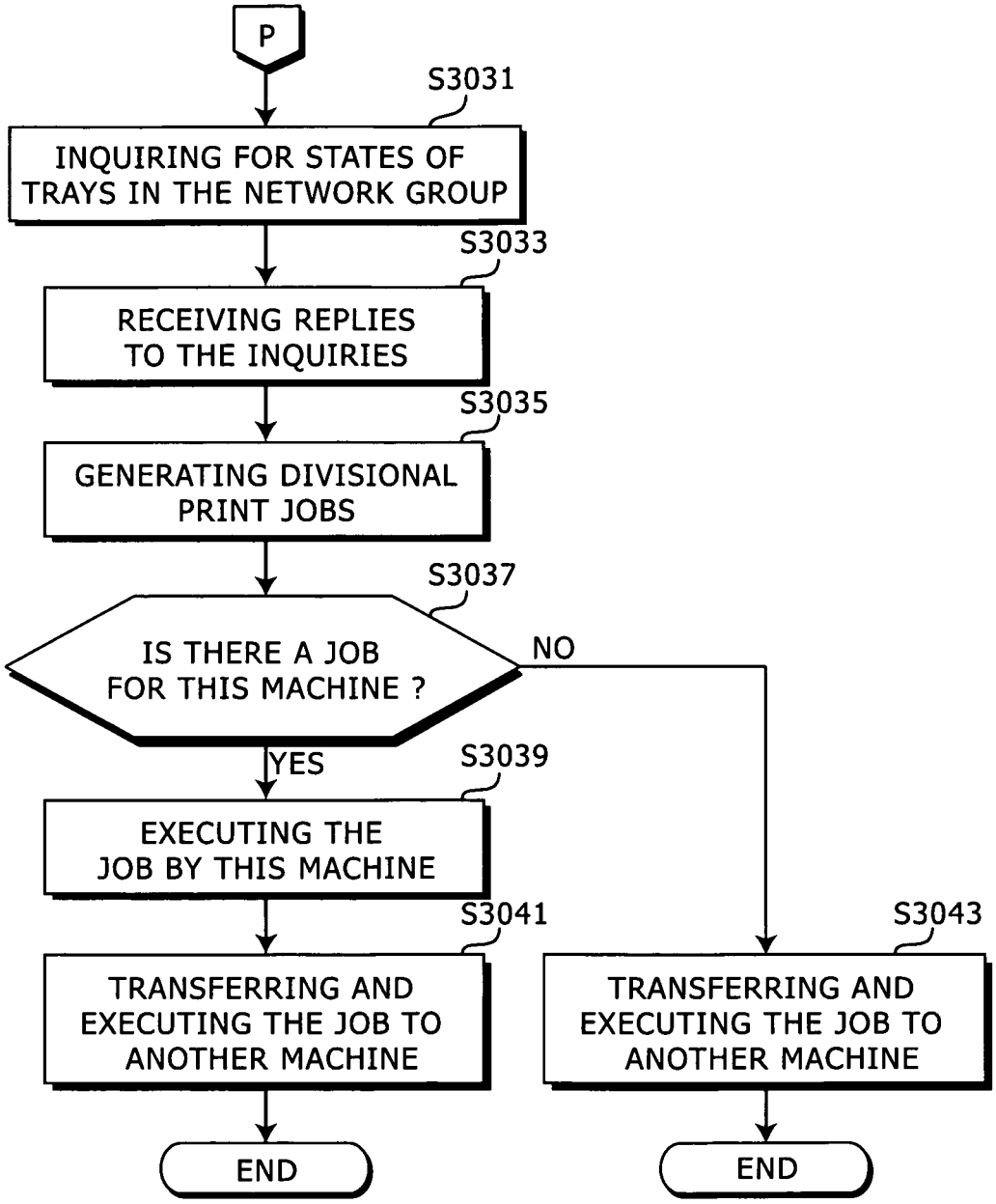
FIG. 18 shows a flowchart of parallel printing with another image forming apparatus in the image forming apparatus according to Embodiment 4 of this invention.

With reference to flowcharts in FIGS. 17 and 18, explained are operations for executing a print job with a network group in the image forming apparatuses of Embodiment 4.

A process of the flowchart shown in FIG. 17 is started when a print job is started.

Step S3011: The group managing part 3715*m* receives inputs of settings for the print job.

(Sub Step 1) The group managing part 3715*m* receives an input of a setting that indicates (a) sheet storage units selected to form a group in the image forming apparatuses connected via the network to each other, and (b) image forming apparatuses that have the selected sheet storage units. Alternatively, the group managing part 3715*m* may use an extent setting instead of the input setting.

(Sub Step 2) The group managing part 3715*m* receives an input of whether or not the print job is divided and distributed to the image forming apparatuses, and the image forming apparatuses performs printing of the print job in parallel.

(Sub Step 3) An input to start the print job is received. The print job is started by an input to the operation unit 400 of the image forming apparatus 1, or by an input via the network from the printer driver 3921 of the PC#1 3901.

Step S3013: According to the input in Sub Step 2 of Step S3011, the group managing part 3715*m* determines whether or not the print job is divided and distributed to the image forming apparatuses, and the image forming apparatuses performs printing of the print job in parallel. If it is determined that the print job is divided and distributed to the image forming apparatuses, and the image forming apparatuses performs printing of the print job in parallel, then Step S3031 marked by [P] in FIG. 18 is next executed. Otherwise, if it is determined that the print job is not divided and distributed to the image forming apparatuses, and the image forming apparatuses does not perform printing of the print job in parallel, then Step S3015 is next executed.

Step S3015: The group managing part 3715*m* determines whether (a) the group specified in the print job contains a sheet storage unit of this image forming apparatus (that is, the image forming apparatus that starts the print job), and (b) the sheet storage unit has not been selected for the print job. Hereinafter, the image forming apparatus that starts the print job is referred as "this machine." If the group contains the sheet storage unit, then for starting the print job by this machine, Step S3017 is next executed. Otherwise, if the group does not contains the sheet storage unit, then Step S3023 is next executed.

Step S3017: The group managing part 3715*m* selects the sheet storage unit of this machine identified in Step S3015. This selection is recorded in the group table 3715*t* maintained by the group managing part 3715*m*, and it prevents this sheet storage unit from being selected again.

Step S3019: The group managing part 3715*m* determines whether or not the sheet storage unit selected in Step S3017 has a sheet of paper according to an output signal received from a residual amount sensor of this sheet storage unit (e.g. the residual amount sensor 205*a*, if the sheet storage unit 201*a* is selected). If the selected sheet storage unit has a sheet, then Step S3021 is next executed. Otherwise, if the selected sheet storage unit does not have any sheets, then Step S3015 is next executed.

Step S3021: The print job is executed by this machine until the end of it.

Step S3023: The group managing part 3715*m* determines whether (a) the group specified in Step S3011 contains a sheet storage unit of another image forming apparatus (that is, the image forming apparatus connected to this machine), and (b) the sheet storage unit has not been selected for the print job. If the group contains the sheet storage unit, then Step S3025 is next executed. Otherwise, if the group does not contain the sheet storage unit, then Step S3030 is next executed.

Step S3025: The group managing part 3715*m* selects the sheet storage unit of another image forming apparatus identified in Step S3023. This selection is recorded in the group table 3715*t* maintained by the group managing part 3715*m*, and it prevents this sheet storage unit from being selected again. The group managing part 3715*m* notifies the other image forming apparatuses in the group of this selection.

Step S3027: For example, using the display unit in the touch panel 401, the group managing part 3715*m* notifies a user that this machine is not available for printing and the selected image forming apparatus performs printing.

Step S3029: The residual job generating unit 3715*h* generates a print job to be transmitted to the selected image forming apparatus. The job transmitting-receiving unit 3715*s* transmits the generated print job to the selected image forming apparatus. The print job is executed by the selected image forming apparatus until the end of it.

Step S3030: For example, using the display unit in the touch panel 401, the group managing part 3715*m* notifies a user that the print job is not finished due to sheet empty of this machine, for example, if Step S3030 is executed after a sheet storage unit of this machine has been selected in Step S3017. The process in the flowchart ends here without finishing the print job.

In this case, when a sheet is supplied to the sheet storage unit in this machine, Step S3015 is executed, and the process is resumed.

In the following part, with reference to FIG. 18, operations are explained in a case that parallel printing is selected in Step S3013 of FIG. 17.

The parallel printing means that a print job is divided and distributed to pluralities of image forming apparatuses that have sheet storage units in a network group when the network group is specified in the print job in order to execute the print job in a short time. For example, if the network group G3 shown in FIG. 14 is specified, then a print job is divided and distributed to the image forming apparatuses 1, 2 and 3 for parallel printing.

For example, in case of a print job for printing six copies of a three page document and the network group G3 is specified in the print job, three divisional print jobs for two copies of the three page document are distributed to the image forming apparatuses 1, 2 and 3. Consequently, the image forming apparatus 1 performs printing two copies of the three page document on sheets fed from TRAY #1*d*, and the image forming apparatus 2 performs printing two copies of the three page document on sheets fed from TRAY #2*d*, and the image forming apparatus 3 performs printing two copies of the three page document on sheets fed from TRAY #3*d*. Therefore, only one third of time is needed for printing six copies of the three page document.

As mentioned above, copies of a document to be printed by the print job can be divided. In another way, pages of a document to be printed by the print job can be divided. For example, a print job for printing six copies of the three page document is divided into three divisional print jobs for printing six copies of one page, and then the image forming apparatus 1 performs printing six copies of the first page in the three page document, and the image forming apparatus 2 performs printing six copies of the second page in the three page document, and the image forming apparatus 3 performs printing six copies of the third page in the three page document. Operations for parallel printing are started from Step S3031.

Step S3031: The tray state inquiring unit 3715*q* sends an inquiry to each of one or more other image forming apparatuses that has a sheet storage unit in the specified network group to inquire a state of the sheet storage unit in the network group. Specifically, it inquires whether or not the sheet storage unit is available for the print job, that is, whether it has correct sheets. If the network group contains a sheet storage unit of this machine, then the tray state inquiring unit 3715*q* also inquires this machine (e.g. the tray state replying unit 3715*a*) of the same thing.

Step S3033: A tray state replying unit in the apparatus that receives the inquiry sends a reply on a state of the sheet storage unit. The tray state inquiring unit 3715*q* of this machine receives the reply. The tray state inquiring unit 3715*q* determines whether or not each of sheet storage unit in the network group is available according to the reply. The tray state inquiring unit 3715*q* determines that the sheet storage unit of the image forming apparatus from which the reply is not received is not available.

Step S3035: The job dividing unit 3715*d* divides the print job into divisional print jobs to perform parallel printing in the image forming apparatuses (may include this machine) which have the available sheet storage units in the network group.

Step S3037: It is determined whether or not the divisional print jobs contain a print job for this machine. If the divisional print jobs contain a print job for this machine, then Step S3039 is next executed. Otherwise, if the divisional print jobs do not contain any print jobs for this machine, then Step S3043 is next executed.

Step S3039: This machine starts executing the divisional print job generated for this machine in Step S3035.

Step S3041: The job transmitting-receiving unit 3715*s* transmits one or more of the divisional print jobs generated in Step S3035 to one or more of the other image forming apparatuses. Each of the divisional print jobs is executed by each of the other image forming apparatuses until the end of it.

Step S3043: As well as in Step S3041, the job transmitting-receiving unit 3715*s* transmits the divisional print jobs generated in Step S3035 to the other image forming apparatuses. Each of the divisional print jobs is executed by each of the other image forming apparatuses until the end of it.

In the following part, explained are operations performed when sheet empty occurs on this machine or one of the other image forming apparatuses while a print job is being executed.

Figure 19:
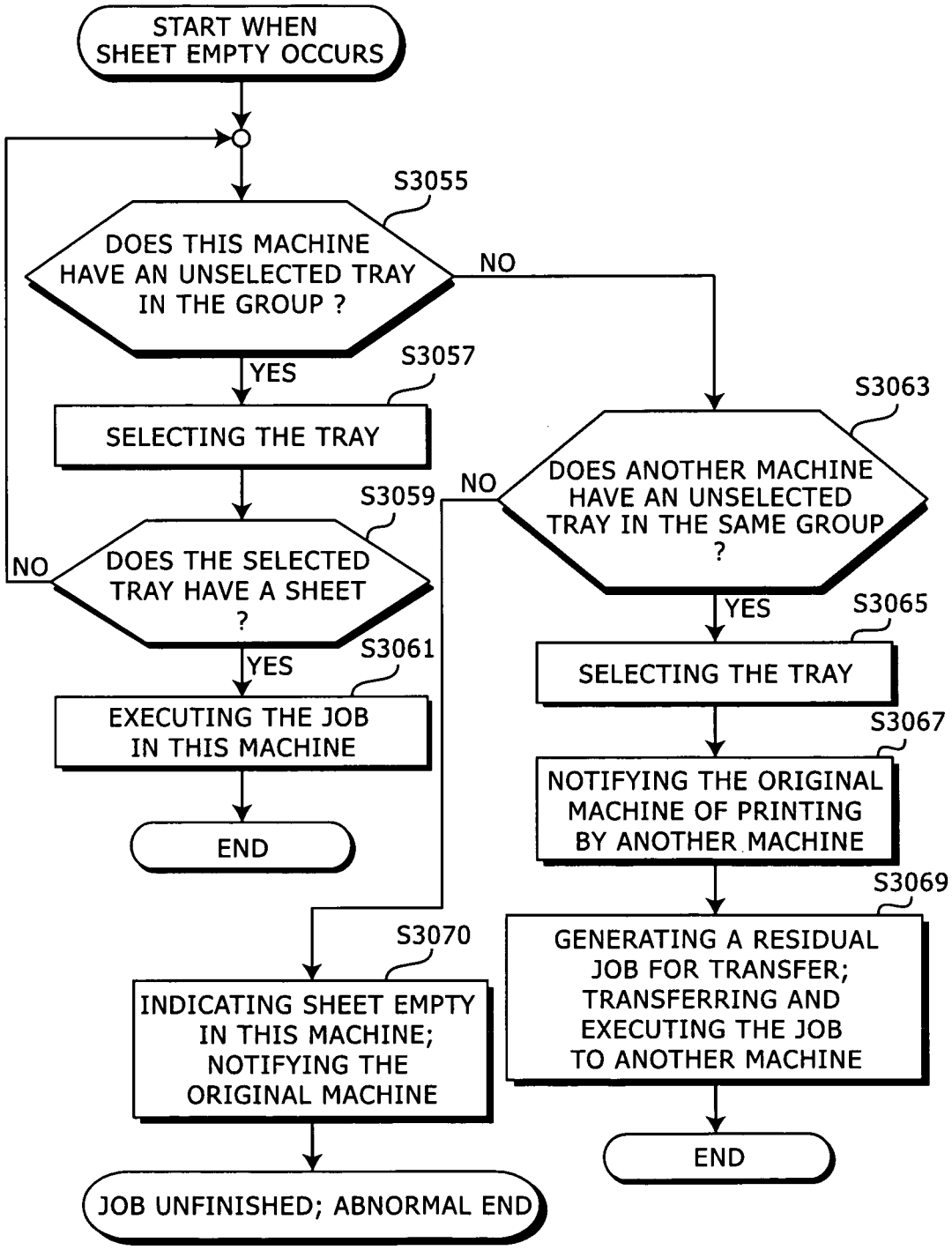
FIG. 19 shows a flowchart of an operation when sheet empty occurs in the image forming apparatus according to Embodiment 4 of this invention.

"This machine" in FIG. 19 means one of the image forming apparatuses in which sheet empty occurs, rather than the image forming apparatus that starts a print job. Hereinafter, an image forming apparatus in which sheet empty occurs is referred as "this machine."

Step S3055: When sheet empty occurs, the group managing part 3715*m* of this machine determines whether or not this machine has a sheet feeding tray that has not been selected in the group specified in the print job. The image forming apparatus that sheet empty occurs may be or may not be the image forming apparatus that starts the print job. If this machine has a sheet feeding tray that has not been selected in the group, then Step S3057 is next executed. Otherwise, if this machine does not have any sheet feeding trays that have not been selected in the group, then Step S3063 is next executed.

Step S3057: The group managing part 3715*m* selects the sheet storage unit of this machine identified in Step S3055. This selection is recorded in the group table 3715*t* maintained by the group managing part 3715*m*, and it prevents this sheet storage unit from being selected again.

Step S3059: The group managing part 3715*m* determines whether or not the sheet storage unit selected in Step S3057 has a sheet of paper according to an output signal received from a residual amount sensor of this sheet storage unit (e.g. the residual amount sensor 205*a*, if the sheet storage unit 201*a* is selected). If the selected sheet storage unit has a sheet, then Step S3061 is next executed. Otherwise, if the selected sheet storage unit does not have any sheets, then Step S3055 is next executed.

Step S3061: The print job is executed by this machine until the end of it.

Step S3063: The group managing part 3715*m* determines whether (a) the group specified in the print job contains a sheet storage unit of another image forming apparatus, and (b) the sheet storage unit has not been selected for the print job. Here, the another image forming apparatus is the image forming apparatus connected to this machine, except for the original image forming apparatus that originally receives an instruction to start the print job. If the group contains the sheet storage unit, then Step S3065 is next executed. Otherwise, if the group does not contain the sheet storage unit, then Step S3070 is next executed.

Step S3065: The group managing part 3715*m* selects the sheet storage unit of the another image forming apparatus identified in Step S3063. This selection is recorded in the group table 3715*t* maintained by the group managing part 3715*m*, and it prevents this sheet storage unit from being selected again. The group managing part 3715*m* notifies the other image forming apparatuses in the group of this selection.

Step S3067: For example, using the display unit in the touch panel 401, the group managing part 3715*m* notifies the original image forming apparatus that this machine is not available for printing and the selected image forming apparatus performs printing.

Step S3069: The residual job generating unit 3715*h* generates a print job to be transmitted to the selected image forming apparatus. The job transmitting-receiving unit 3715*s* transmits the generated print job to the selected image forming apparatus. The print job is executed by the selected image forming apparatus until the end of it.

Step S3070: For example, using the display unit in the touch panel 401, the group managing part 3715*m* notifies a user that the print job is not finished due to sheet empty of this machine, for example, if Step S3070 is executed after a sheet storage unit of this machine has been selected in Step S3057. The process in the flowchart ends here without finishing the print job.

In this case, when a sheet is supplied to the sheet storage unit of this machine, Step S3055 is executed, and the process is resumed.

Advantages of Embodiment 4

In this system of the image forming apparatuses connected via the network, a print job is divided and executed by the image forming apparatuses in parallel. Therefore, a time for printing is reduced to a short time as divided by the number of the image forming apparatuses.

When parallel printing is not performed, even if sheet empty occurs on a sheet feeding tray in one of the image forming apparatuses, another one of the image forming apparatuses automatically performs printing with feeding a sheet from another sheet feeding tray in the group that contains the sheet feeding tray with the sheet empty. Therefore, it is possible to print before a sheet is supplied to the sheet feeding tray with the sheet empty.

When in one of the image forming apparatuses, one of sheet feeding trays in a network group has a sheet of a rarely used type such as OHP sheet or thick sheet of paper, a user can use a sheet of the rarely used type by operating another one of the image forming apparatuses. Therefore, it saves user's work (e.g. exchanging sheets) when a user wants to use a sheet of a rarely used type.

In the case that the system has the management server that manages group settings by the group managing unit, a load for managing the group settings in the image forming apparatuses is reduced. As a result, burdens on managing the group settings are reduced in CPUs and memories in the image forming apparatuses, and therefore printing performance by the CPUs and the memories is increased. In addition, in this case, burdens on communication for managing the group tables are reduced.

Further, when sheet empty occurs, one of the image forming apparatuses may generate a print job of a residual part of printing, and temporarily keeps the print job in a server, a host computer, or another one of the image forming apparatuses, and then the one of the image forming apparatuses may receive and execute the kept print job. Resources for the print job in the one of the image forming apparatuses can be released and used for other operations.

Further, one of the image forming apparatuses transmits a print job to another one of the image forming apparatuses after it confirms that the another one is available for printing. Therefore, the another one is prevented from transmitting the print job to a further other one of the image forming apparatuses without executing the print job.

In Embodiment 4, the image forming apparatus 1 is an example of a relatively high performance image forming apparatus. This invention is not limited to this embodiment, and it can also be applied to an image forming apparatus without optional parts and units such as the document feeding part 600, the document scanning unit 500 and the postprocessing part 300.

In Embodiment 4, the image forming apparatuses and the management server are connected to the network 3801 as electronic communication channels, and they are capable of communicating with each other. Alternatively, an electronic communication channel of another type such as USB (Universal Serial Bus) or IEEE1394 may be used for communication among them.

Embodiment 5

Hereinafter, an image forming apparatus of Embodiment 5 is explained.

[Machine Configuration]

A mechanical configuration of the image forming apparatus in Embodiment 5 is identical to that in Embodiment 1, and therefore, it is not explained here.

[Functional Blocks]

A functional block diagram of the image forming apparatus in Embodiment 5 is identical to that in Embodiment 1, and therefore, it is not explained here.

[Flowchart]

Figure 20:
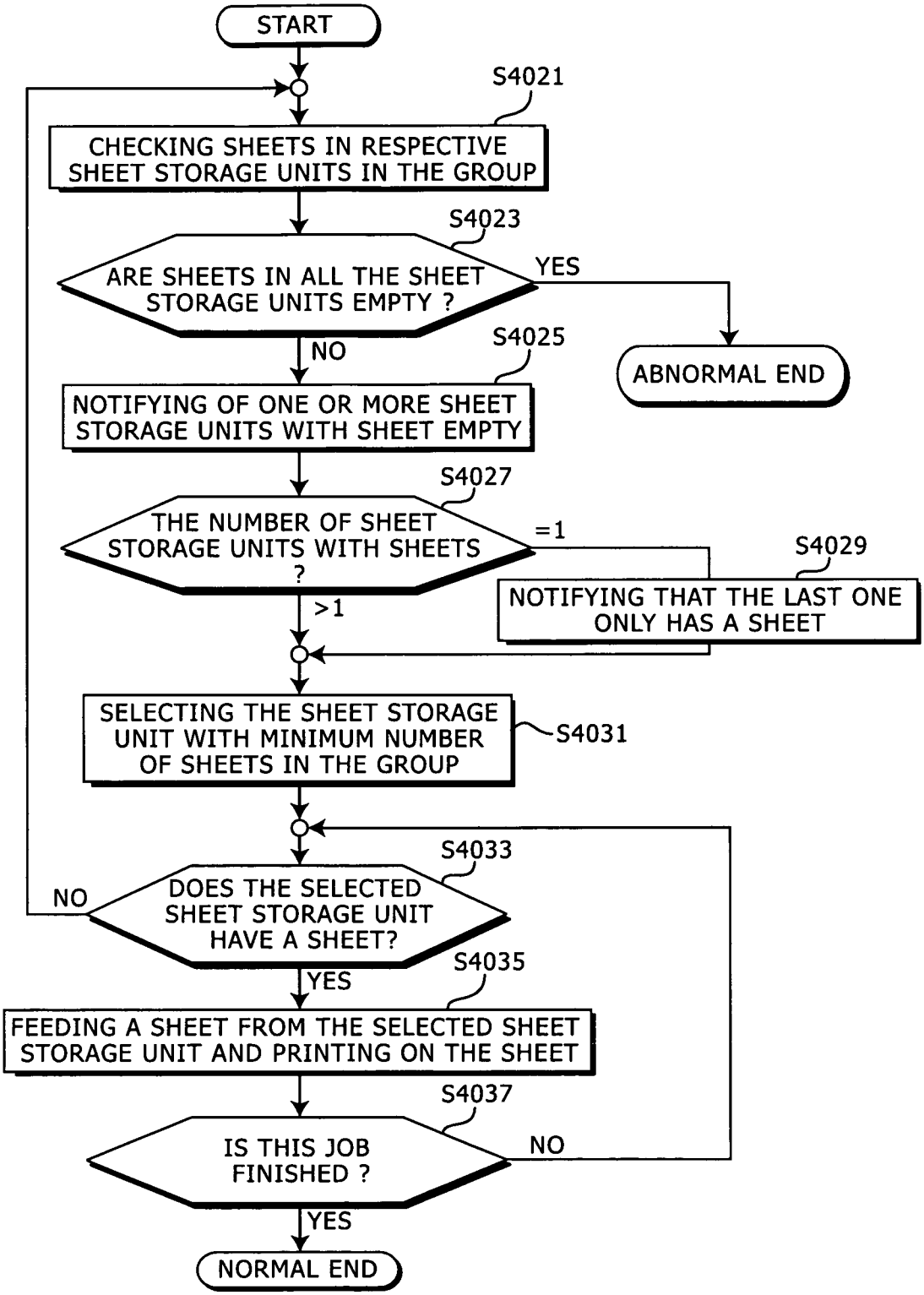
FIG. 20 shows a flowchart of operations for starting printing in an image forming apparatus according to Embodiment 5 of this invention.

With reference to FIG. 20, explained are operations performed by the image forming apparatus 1 when the image forming apparatus 1 changes a sheet storage unit in a specified group and warns of sheet empty.

The image forming apparatus starts a process of the flowchart shown in FIG. 20 when a print job is started.

Step S4021: The residual sheet amount detecting unit 701 detects a residual amount of sheets in each of sheet storage units in a currently specified group.

Step S4023: It is determined whether there are no sheets in all the sheet storage units in the group according to the detecting result in Step S4021. If there are no sheets in all the sheet storage units in the group, then a message of sheet empty is displayed, and since the printing can not be continued, the process abnormally ends. Otherwise, if there is a sheet in any of the sheet storage units in the group, then Step S4025 is next executed. After the process abnormally ends, the process of the flowchart in FIG. 20 is restarted when a user supplies a sheet to one of the sheet storage units.

Step S4025: The sheet empty warning unit 711 warns that sheet empty occurs on one or more of the sheet storage units. For warning in Step S4025, a warning message is displayed in the touch panel 401 (including a display unit) of the operation unit 400, or the image forming apparatus 1 notifies the printer watching utility 911 installed in the PC#1 901, or the image forming apparatus 1 notifies the browser of the PC#2 903 via the internal web server 707. Alternatively, two or three methods of the aforementioned warning methods may be performed.

Step S4027: It is determined whether or not two or more of the sheet storage units have sheets according to the detecting result in Step S4021. If two or more of the sheet storage units have sheets, then Step S4031 is next executed. Otherwise, if only one of the sheet storage units has a sheet, then Step S4029 is next executed.

Step S4029: The sheet empty warning unit 711 warns a user that only one sheet storage unit has a sheet, and that sheets of paper need to be supplied to at least one of empty sheet storage units. This warning is performed by means of at least one of the aforementioned warning methods in Step S4025.

Step S4031: The sheet storage switching control unit 709 selects a sheet storage unit that currently has the minimum number of sheets (i.e. the minimum residual amount of sheets) from the sheet storage units that have sheets.

Step S4033: It is determined whether or not the selected sheet storage unit has a sheet. If the selected sheet storage unit has a sheet, then Step S4035 is next executed. Otherwise, if the selected sheet storage unit does not have any sheets, then Step S4021 is next executed.

Step S4035: Printing is performed with feeding a sheet from the selected sheet storage unit.

Step S4037: It is determined whether or not all pages in the print job have been printed. If all pages in the print job have been printed, then the process normally ends. Otherwise, if all pages in the print job have not been printed, then Step S4033 is next executed.

According to the aforementioned operations, even if sheet empty occurs on a sheet storage unit currently selected in a group, the sheet storage unit is changed to another sheet storage unit with a sheet in the group, if it exists, and then the apparatus notifies of it. Further, when only one sheet storage unit in the group has a sheet, a user is warned that sheets of paper need to be supplied to at least one of empty sheet storage units.

When the apparatus warns of sheet empty in Step S4025, the apparatus is not required to use all warning methods, and may use only one warning method such as displaying in the touch panel (including a display unit). Alternatively, the touch panel may display that a residual sheet amount of the sheet storage unit is nothing. Alternatively, the warning may not be done according to a setting.

Here, the sheet empty starts the aforementioned process, but another event such as power-on of the image forming apparatus or user operation for starting it may start the aforementioned process.

[User Interface Screen for Forming a Group]

A user interface screen for forming a group in Embodiment 5 is the same as that in Embodiment 1, and therefore, it is not explained here.

Advantages of Embodiment 5

In ordinary machines, it is not possible to prevent printing to be stopped when sheet empty occurs on a sheet storage unit used to feed a sheet for printing, even if the sheet storage unit belongs to a group. According to this embodiment, this problem is solved by using another sheet storage unit in the group, and sending a message of sheet empty and warning to cause a user to supply sheets when sheet empty occurs on any of sheet storage units in the group and when the last one of the sheet storage units in the group has a sheet.

In Embodiment 5, the image forming apparatus 1 enables to perform continuous printing on a lot of sheets in excess of the maximum sheet capacity of the sheet storage unit. Even while printing is being performed, without stopping the printing, sheets can be supplied to a sheet storage unit that is not currently used for the printing.

In a group of sheet storage units, a sheet is firstly consumed in a sheet storage unit with minimum number of sheets, and therefore, it is possible to early warn a user of sheet empty. As a result, it provides a user a long time to supply a sheet until all sheets are consumed in all the sheet storage units in the group, and consequently, it tends not to stop printing due to sheet empty.

A user is notified of sheet empty on a sheet cassette, and therefore, the user can supply sheets to the sheet cassette. When the image forming apparatus is started, the image forming apparatus checks states of the sheet storage units, and notifies as well if sheet empty occurs. The image forming apparatus can detect sheet empty at another timing than the timing when all sheets in a sheet storage unit are consumed.

Further, when the last one of the sheet storage units in a group has a sheet, the image forming apparatus 1 warns a user of it. The user receives the warning and supplies sheets to an empty sheet storage unit. Therefore, in an apparatus that sheets can be supplied to a sheet cassette without stopping printing, such as the image forming apparatus of Embodiment 5, printing is continuously performed without a stop due to a limit of sheet capacity of sheet storage units in a group.

In Embodiment 5, the image forming apparatus 1 is an example of a relatively high performance image forming apparatus. This invention is not limited to this embodiment, and it can also be applied to an image forming apparatus without optional parts and units such as the document feeding part 600, the document scanning unit 500 and the postprocessing part 300.

In Embodiment 5, the image forming apparatus 1 warns of sheet empty by the sheet empty warning unit 711. Alternatively, as well as a known technique, the image forming apparatus 1 may indicate a residual amount of sheets by a display unit such as the touch panel. For example, the touch panel 401 may display icons corresponding to the residual amounts of sheets detected by the residual amount sensors 205*a*, 205*b*, 205*c* and 205*d*. The image forming apparatus 1 may indicate sheet empty in the same way as indicating a residual amount of sheets.

In Embodiment 5, in Step S4031 of FIG. 20, the image forming apparatus 1 selects in turns sheet storage units in an increasing order of the residual sheet amounts of the sheet storage units. Alternatively, in a case that there are more than two image forming apparatuses, under a condition that the sheet storage unit with the maximum residual amount of sheets is selected last, for example, other sheet storage units may be selected along a downward order or along a predetermined priority order. In these way, the sheet storage unit with the maximum residual amount of sheets is selected last, and in Step S4029 a user is warned for supplying a sheet, and printing is continuously performed without a stop.

In the image forming apparatus 1 of Embodiment 5, without a stop of printings, sheets can be supplied to a sheet storage unit that is not currently used to feed a sheet for printing. However, some image forming apparatuses have a structure that stops printing when sheets are supplied to a sheet storage unit. For example, a sheet cassette crosses a sheet feeding path when the sheet cassette is pulled out. Such image forming apparatus also notifies a user of sheet empty, and the user can prepare sheets to be supplied before stopping printing. Therefore, the apparatus only would stop in a short period. Thus, a higher advantage is given by applying this invention to an image forming apparatus that sheets can be supplied to a sheet storage unit that is not used to feed a sheet for printing.

The image forming apparatus 1 of Embodiment 5 notifies at least one of components: a display unit in this image forming apparatus, an internal web server, and a printer watching utility in an external device of the sheet empty. As a result, a user knows sheet empty not only when the user is near the image forming apparatus, but also when the user operates a host computer to use the image forming apparatus or when the user uses the printer watching utility to maintain the image forming apparatus.

Embodiment 6

Hereinafter, an image forming apparatus of Embodiment is explained.

[Machine Configuration]

A mechanical configuration of the image forming apparatus in Embodiment 6 is identical to that in Embodiment 1, and therefore, it is not explained here.

[Functional Blocks]

Figure 21:
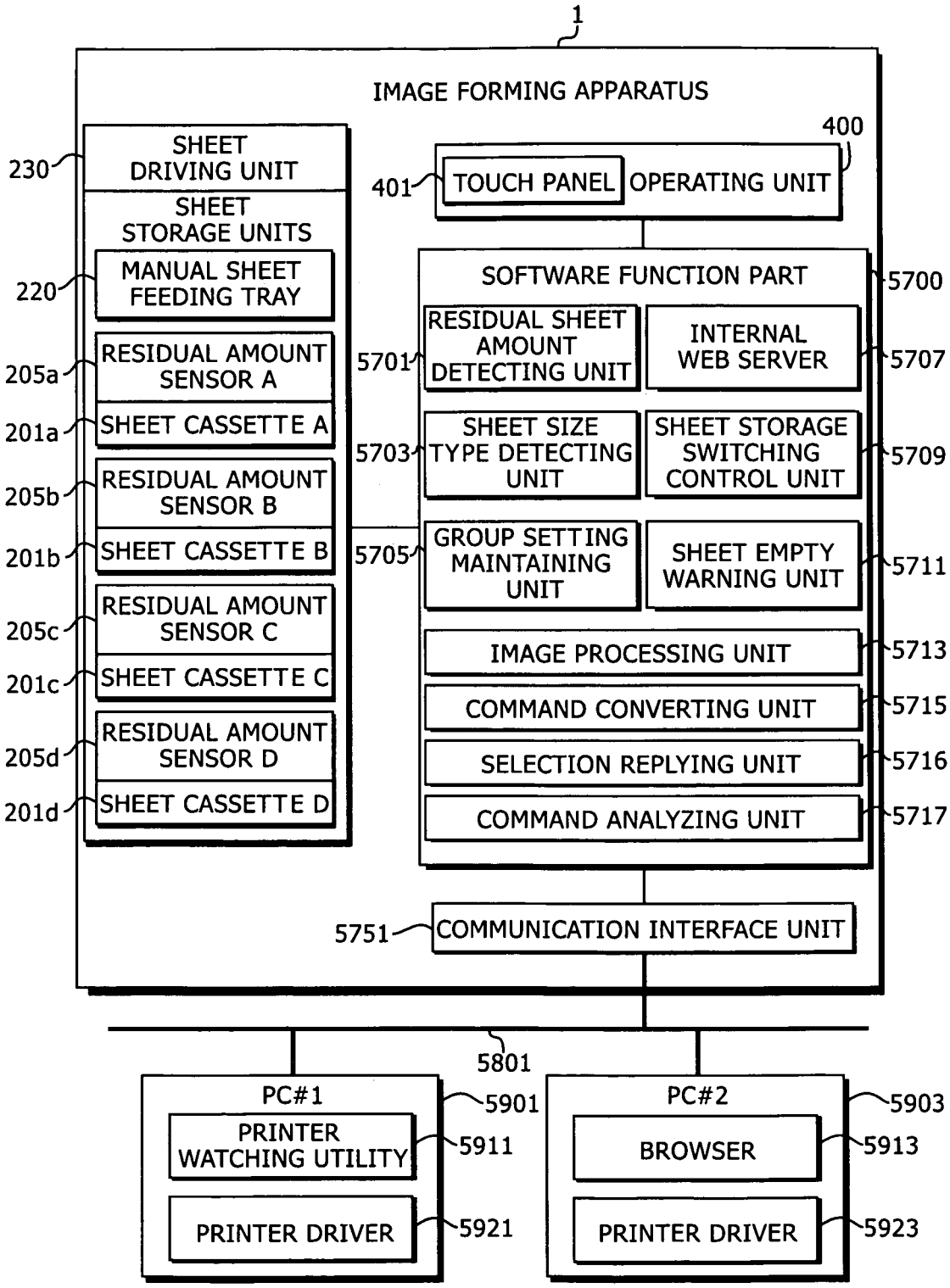
FIG. 21 shows a functional block diagram of an image forming apparatus according to Embodiment 6 of this invention.

FIG. 21 shows a functional block diagram of an image forming apparatus according to Embodiment 6. This functional block diagram does not show other components which are generally installed in an image forming apparatus.

As shown in FIG. 21, the image forming apparatus 1 has a software function part 5700 and a communication interface unit 5751 as functional blocks together with the sheet storage units (the sheet cassettes 201*a*, 201*b*, 201*c* and 201*d*, and the manual sheet feeding tray 220), the sheet driving unit 230, the operation unit 400, the touch panel 401 (a display unit), and so on.

The software function part 5700 has a sheet residual detecting unit 5701, a sheet size type detecting unit 5703, a group setting maintaining unit 5705, an internal web server 5707, a sheet storage switching control unit 5709, a sheet empty warning unit 5711, an image processing unit 5713, a command converting unit 5715, a selection replying unit 5716, and a command analyzing unit 5717.

Further, the image forming apparatus 1 is connected to a network 5801 by the communication interface unit 5751, and is connected via the network 5801 to a PC (Personal Computer) #1 5901 and a PC (Personal Computer) #2 5903 connected to the network 5801.

A PC#1 5901 is a host computer that issues a print job, and has a printer watching utility 5911 and a printer driver 5921. The printer watching utility 5911 is a program for watching a state of the image forming apparatus. The printer driver 5921 is the latest version for functions of the image forming apparatus.

A PC#1 5903 is another host computer that issues a print job, and has a browser 5913 and a legacy printer driver 5923. The browser 5913 accesses the internal web server 5707 to inquire a state of the image forming apparatus. The legacy printer driver 5923 is an old version for general purposes. The legacy printer driver 5923 issues print jobs in a page description language or an escape sequence such as ESC/P. Therefore, the legacy printer driver 5923 can not specify some trays of multistage sheet storage units in a print job for the image forming apparatus, and can not use a group of sheet storage units in the image forming apparatus. In the image forming apparatus, the command converting unit 5715 converts a command to specify a sheet feeding tray.

In the following part, the functional blocks of the image forming apparatus 1 are explained.

The communication interface unit 5751 is an interface unit that connects the image forming apparatus 1 to the network. The image forming apparatus 1 communicates with an external device such as a personal computer by the communication interface unit 5751.

The software function part 5700 is embodied by executing a software program in a computer inside of the image forming apparatus 1.

The residual sheet amount detecting unit 5701 has the same function as that of the residual sheet amount detecting unit 701.

The sheet size type detecting unit 5703 has the same function as that of the sheet size type detecting unit 703.

Some sheet types such as thick paper, color paper and one-side used paper are not detected by those sensors and the frame members. For such sheet types, the group setting maintaining unit 5705 sets the sheet type according to a user input.

The group setting maintaining unit 5705 has the same function as that of the group setting maintaining unit 705.

This image forming apparatus 1 has a grouping function. This grouping function enables to perform printing on a lot of sheets in excess of the maximum sheet capacity of the sheet cassette. Therefore, it is possible to continuously perform printing until all sheets in all of the sheet cassettes in the group are consumed. This is one of the largest advantages of the grouping function.

The group setting maintaining unit 5705 forms a group of the sheet storage units, and makes and maintains a record of the group. For example, a group is formed from sheet cassettes A and C that the sheet size is A4 and the sheet type is plain paper, and a group is formed from sheet cassettes B and D and a manual sheet feeding tray that the sheet size is A4 and the sheet type is one-side used paper.

The group may be formed according to an input to the operation panel 400, according to an instruction received via the communication interface unit 5751 from a printer watching utility 5911 of a PC#1 5901 as an external device, or by using a setting function of the internal web server 5707 from a browser 5913 of a PC#2 5903 as an external device.

The internal web server 5707 has the same function as that of the internal web server 707.

The sheet storage switching control unit 5709 has the same function as that of the sheet storage switching control unit 709.

The sheet empty warning unit 5711 has the same function as that of the sheet empty warning unit 711.

The image processing unit 5713 converts print job data to data in a format compatible with the printing unit 240. When print job data from the printer driver 5921 is described in a page description language, the image processing unit 5713 converts print job data described in a page description language to data in a bitmap format compatible with the printing unit 240. When print job data from the legacy printer driver 5923 (i.e. an old printer driver) is described in a page description language or an escape sequence (i.e. an old print job data format), the image processing unit 5713 also converts the print job data to bitmap data.

The command converting unit 5715 is one of most characteristic functional blocks in this embodiment. Since the legacy printer driver 5923 is an old printer driver, the legacy printer driver 5923 can specify only a few of sheet feeding trays at the maximum due to limitation of a command to specify a sheet feeding tray. This embodiment solves this problem as follows. The command analyzing unit 5717 analyzes a print job. It is determined whether or not the number of sheet storage unit specifying commands in the print job is smaller than the number of sheet storage units in the image forming apparatus according to the analyzing result. If the number of sheet storage unit specifying commands in the print job is smaller than the number of sheet storage units in the image forming apparatus, then the command converting unit 5715 converts the sheet storage unit specifying commands to enable to use whichever of all the sheet storage units in the image forming apparatus for printing.

A sheet storage unit specifying command is converted according to a conversion table (e.g. FIG. 22D). The conversion table has a record to associate a sheet storage unit with one or more sheet storage units. Conversion of the command will be explained in detail when FIGS. 22A to 22D are explained.

If the command analyzing unit 5717 determines that the print job is not compatible with the grouping function of this apparatus, then the command converting unit 5715 converts a sheet storage unit specifying command in the print job to either a command to specify a predetermined group of sheet storage units or a command to specify sheet storage units in a predetermined group. Here, the image forming apparatus 1 is capable of continuously printing with sheet storage units in a group specified by a command in the print job. The group is specified not by a command to specify a sheet storage unit, but by a command to specify a group.

Further, if the command analyzing unit 5717 determines that the print job is not compatible with the grouping function of this apparatus, then the command converting unit 5715 converts a sheet size specifying command in the print job to either a command to specify a group of sheet storage units corresponding to a sheet size of the sheet size specifying command or a command to specify sheet storage units in a group of sheet storage units corresponding to a sheet size of the sheet size specifying command.

The selection replying unit 5716 sends a reply to an inquiry on selectable sheet storage units from the printer driver 5921. The reply does not indicate all sheet storage units in the image forming apparatus, but indicates at least one selectable sheet storage unit which is a sheet storage unit (before conversion in the table) corresponding to the one or more sheet storage units (after conversion in the table) in the conversion table. Therefore, the reply indicates one or more selectable sheet storage units less than all the sheet storage units. The printer driver can use a group of sheet storage units as a large sheet storage unit by specifying a sheet storage unit rather than a group. Here, the printer driver 5921 can perform two-way communication with the image forming apparatus, and can receive the reply from the image forming apparatus.

The command analyzing unit 5717 analyzes a print job and determines whether or not the number of sheet storage units that can be specified by a sheet storage specifying command in the print job is smaller than the number of the sheet storage units. If it is determined that the number of sheet storage units that can be specified by the sheet storage specifying command is smaller than the number of the sheet storage units, then the command converting unit 5715 converts the sheet storage specifying command.

If it is determined that the print job is not compatible with the grouping function of this apparatus, then the command converting unit 5715 also converts the sheet storage specifying command.

[Operations of the Command Converting Unit]

With reference to FIGS. 22A to 22D, explained in detail are operations of the command converting unit 5715 to convert the sheet storage unit specifying command. TRAY#1 to TRAY#5 in FIGS. 22A to 22C are corresponding to five sheet storage units: the sheet cassettes 201*a* to 201*d* and the manual sheet feeding tray 220.

(Case 1) FIG. 22A shows a diagram that explains specifying a sheet feeding tray in a case that the image forming apparatus 1 has five sheet feeding trays that are not in any groups. When a print job is issued, a command to specify a sheet feeding tray is inserted into the print job. In this case, as shown in FIG. 22A, five specifying commands are used to specify the five sheet feeding trays, respectively. The printer driver 5921 is compatible with a function that specifies any of multistage sheet feeding trays in the image forming apparatus 1, and therefore, the printer driver 5921 specifies a sheet feeding tray as shown in FIG. 22A.

(Case 2) FIG. 22B shows a diagram that explains specifying a sheet feeding tray in a case that the image forming apparatus 1 has five sheet feeding trays of which a part is in groups. In this case, the group setting maintaining unit 5705 of the image forming apparatus 1 maintains group settings of a group A and a group B. The group A contains TRAY#1 and TRAY#2, and the group B contains TRAY#3 and TRAY#4. The group setting maintaining unit 5705 also maintains a setting of TRAY#5 as an isolated tray. In this case, the printer driver 5921 compatible with the grouping function of the image forming apparatus 1 issues a print job that contains a command to specify pluralities of sheet feeding trays (e.g. "TRAYS#1, #2 specifying command") as shown in FIG. 22B. If a print job contains a TRAYS#1, #2 specifying command, then the image forming apparatus 1 can perform printing on sheets continuously fed from sheet feeding trays in the group A.

As mentioned above, since the printer driver 5921 is the latest version, the printer driver 5921 has been designed and produced as compatible with functions (e.g. multistage sheet feeding trays and grouping function) of the image forming apparatus 1. Therefore, naturally, the printer driver 5921 can issue commands that properly utilize functions of the image forming apparatus 1. However, in some system environments to issue commands for the image forming apparatus 1, a printer driver of the latest version can not be used, and an old printer driver like the legacy printer driver 5923 must be used. For example, if an old OS is not compatible with the latest version, then an old printer driver such as the legacy printer driver 5923 is obliged to be used on the old OS. The legacy printer driver 5923 does not have a concept of the grouping function, and therefore, there are limitations, for example, the legacy printer driver 5923 specifies two- or three-stage sheet feeding trays at the maximum. The legacy printer driver 5923 can not specify all of the multistage (e.g. five-stage) sheet feeding trays in the image forming apparatus 1.

To solve this problem, as shown in FIG. 22C, a sheet storage unit specifying command issued by the legacy printer driver 5923 is converted according to group settings maintained by the group setting maintaining unit 5705 of the image forming apparatus 1.

For example, when the group setting maintaining unit 5705 maintains the same group settings as that shown in FIG. 22B, if a TRAY#1 specifying command is received from the legacy printer driver 5923, then the command converting unit 5715 converts the TRAY#1 specifying command to a command to specify either TRAY#1 or TRAY#2 of the group A, and if a TRAY#2 specifying command is received from the legacy printer driver 5923, then the command converting unit 5715 converts the TRAY#2 specifying command to a command to specify either TRAY#3 or TRAY#4 of the group B. In this way, since a group of sheet feeding trays is handled as a sheet feeding tray, the number of sheet feeding trays that can be seen from the legacy printer driver is reduced, and a tray specifying command is converted according to group settings.

This command conversion is performed according to the conversion table shown in FIG. 22D. When a TRAY#1 specifying command is received, the TRAY#1 specifying command is converted to a command to specify either TRAY#1 or TRAY#2. When a TRAY#2 specifying command is received, the TRAY#2 specifying command is converted to a command to specify either TRAY#3 or TRAY#4. When a TRAY#5 specifying command is received, the TRAY#3 specifying command is converted to a command to specify TRAY#5.

According to the aforementioned method, the image forming apparatus 1 converts a sheet storage unit specifying command in a print job issued by the legacy printer driver 5923. Therefore, all the sheet feeding trays and groups in the image forming apparatus 1 can be used according to a command from the legacy printer driver 5923.

[Flowchart]

Figure 23:
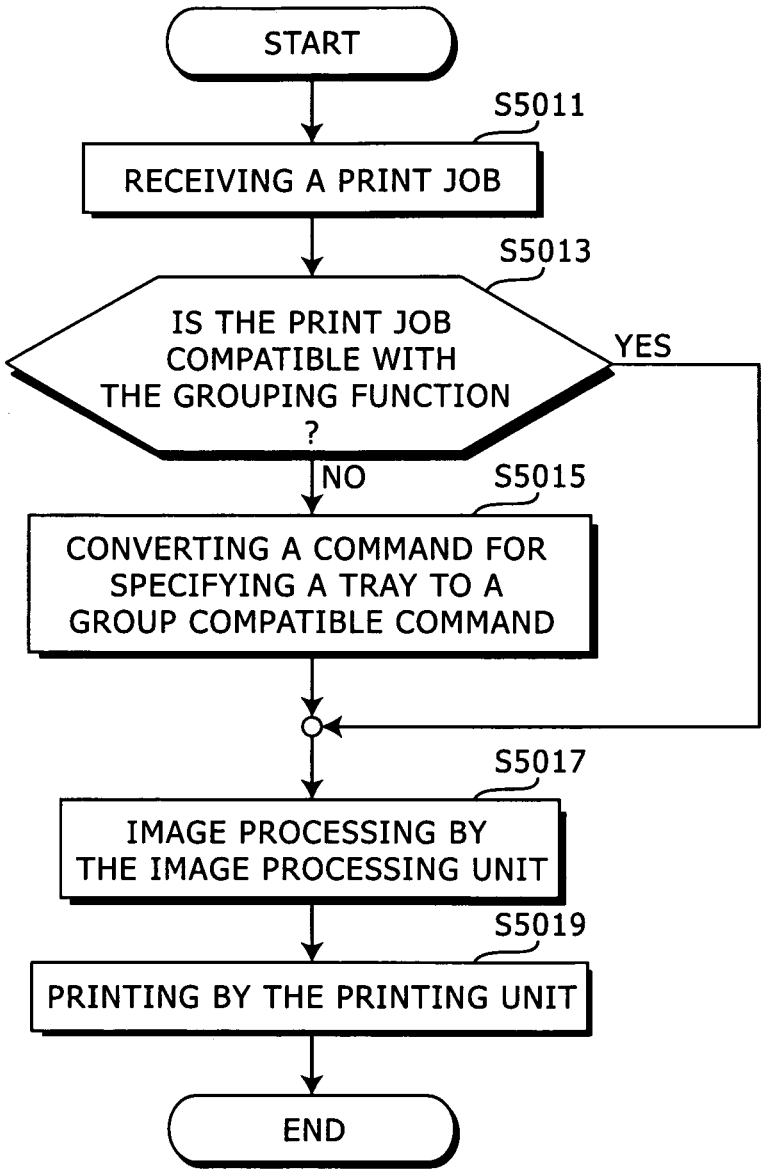
FIG. 23 shows a flowchart of operations when a job is received in the image forming apparatus according to Embodiment 6 of this invention.

With reference to a flowchart of FIG. 23, explained are operations performed when a print job is received in the image forming apparatus 1.

Step S5011: The image forming apparatus 1 receives a print job from the PC#1 5901 or the PC#2 5903.

Step S5013: The command analyzing unit 5717 of the image forming apparatus 1 analyzes the print job received in Step S5011, and determines whether or not the print job is a print job generated by a printer driver compatible with the grouping function like the printer driver 5921. If the print job is a print job generated by a printer driver compatible with the grouping function, then Step S5017 is next executed. Otherwise, the print job is not a print job generated by a printer driver compatible with the grouping function, but a print job generated by an old printer driver incompatible with the grouping function like the legacy printer driver 5923, then Step S5015 is next executed.

Step S5015: The received print job is a job generated by an old printer driver incompatible with the grouping function, and therefore, as mentioned in FIG. 22C, the command converting unit 5715 converts a sheet storage unit specifying command in the print job to a group specifying command that is executable in the image forming apparatus 1. The group specifying command specifies either a group or sheet storage units in a group.

Step S5017: The image processing unit 5713 converts a print job to a data executable in the printing unit 240. The image processing unit 5713 converts the print job after a sheet storage unit specifying command has been converted to a group specifying command, and the image processing unit converts the received printer job compatible with the grouping function.

Step S5019: The printing unit 240 performs printing based on the data converted from the print job in Step S5017.

According to the aforementioned operations, in terms of the grouping function, the image forming apparatus performs printing based on both of the print job generated by the printer driver 5921 compatible with the grouping function and the print job generated by the legacy printer driver 5923 incompatible with the group function.

Advantages of Embodiment 6

Even if a print job has been generated by a printer driver incompatible with multistage sheet storage units or a printer driver incompatible with the grouping function, since the command converting unit 5715 of the image forming apparatus converts a sheet storage unit specifying command in the print job, the image forming apparatus can perform printing on a sheet fed from whichever of all the sheet storage units in terms of the grouping function of the image forming apparatus. Further, in Embodiment 6, the image forming apparatus can show selectable sheet storage units to a printer driver that can perform two-way communication with the image forming apparatus. The selectable sheet storage units are obtained by reversely converting from all the sheet storage units in the image forming apparatus according to the conversion table. Therefore, the image forming apparatus can cause the printer driver to handle the selectable sheet storage unit corresponding to pluralities of sheet storage units in image forming apparatus.

In Embodiment 6, the image forming apparatus 1 is an example of a relatively high performance image forming apparatus. This invention is not limited to this embodiment, and it can also be applied to an image forming apparatus without optional parts and units such as the document feeding part 600, the document scanning unit 500 and the postprocessing part 300.

In Embodiment 6, according to group settings, a sheet storage unit specifying command is converted to a command to specify one or more sheet storage units corresponding to a sheet storage unit specified by the sheet storage unit specifying command. Alternatively, a sheet storage unit specifying command may be converted to a command to specify a group. Similarly, a sheet size specifying command in the print job may be converted to a command to specify either a group corresponding to a sheet size specified by the sheet size specifying command or sheet storage units in the group.

Embodiment 7

Hereinafter, an image forming apparatus of Embodiment 7 is explained.

[Machine Configuration]

A mechanical configuration of the image forming apparatus in Embodiment 7 is identical to that in Embodiment 1, and therefore, it is not explained here.

[Functional Blocks]

Figure 24:
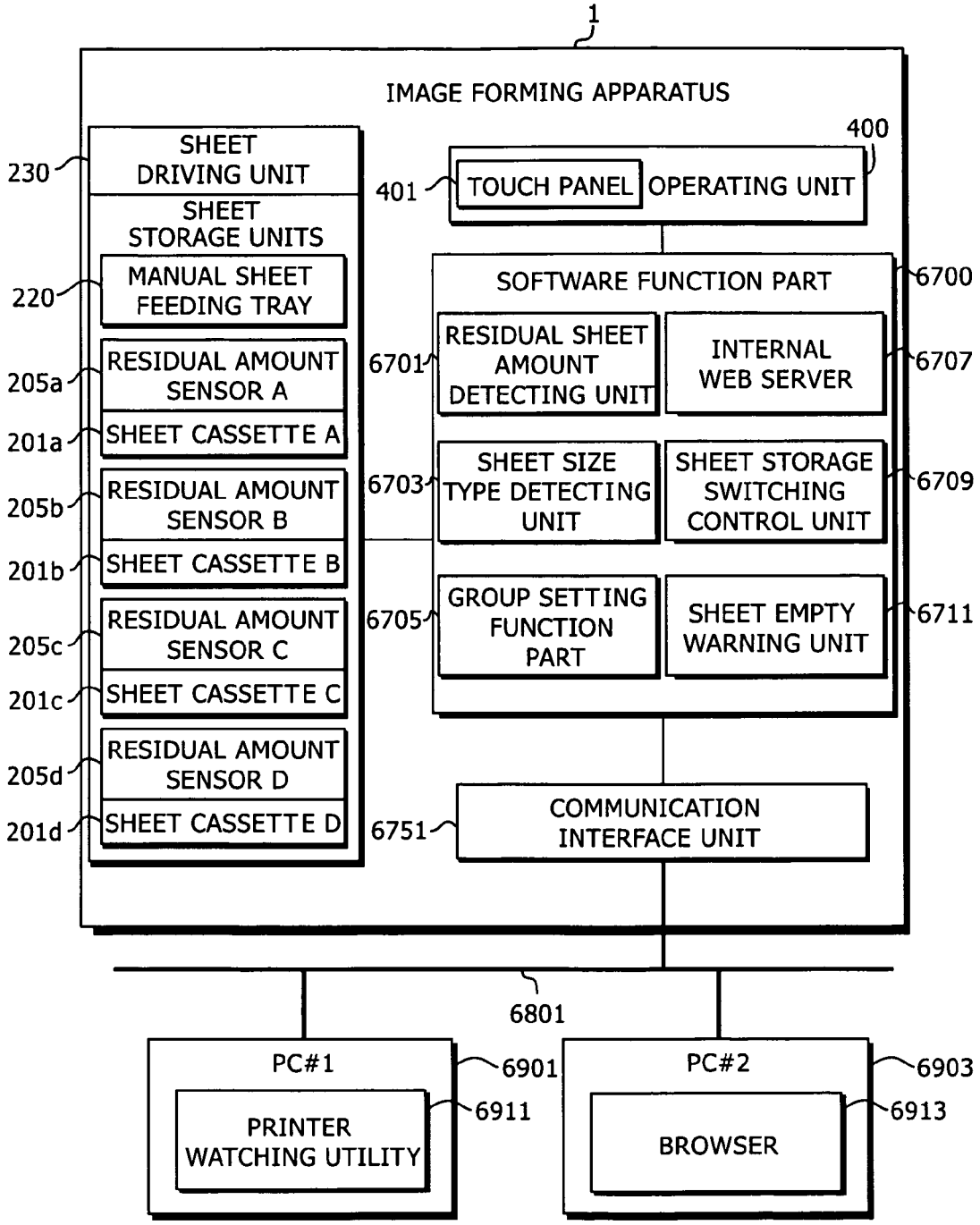
FIG. 24 shows a functional block diagram of an image forming apparatus according to Embodiment 7 of this invention.

FIG. 24 shows a functional block diagram of an image forming apparatus according to Embodiment 7.

This functional block diagram does not show other components which are generally installed in an image forming apparatus.

As shown in FIG. 24, the image forming apparatus 1 has a software function part 6700 and a communication interface unit 6751 as functional blocks together with the sheet storage units (the sheet cassettes 201*a*, 201*b*, 201*c* and 201*d*, and the manual sheet feeding tray 220), the sheet driving unit 230, the operation unit 400, the touch panel 401 (a display unit), and so on.

The software function part 6700 has a sheet residual detecting unit 6701, a sheet size type detecting unit 6703 (as a sheet attribution detecting unit), a group setting function part 6705, an internal web server 6707, a sheet storage switching control unit 6709, and a sheet empty warning unit 6711.

Further, the image forming apparatus 1 is connected to a network 6801 by the communication interface unit 6751, and is connected via the network 6801 to a PC (Personal Computer) #1 6901 and a PC (Personal Computer) #2 6903 connected to the network 6801.

In the following part, the functional blocks are explained.

The communication interface unit 6751 is an interface unit that connects the image forming apparatus 1 to the network. The image forming apparatus 1 communicates with an external device such as a personal computer by the communication interface unit 6751.

The software function part 6700 is embodied by executing a software program in a computer inside of the image forming apparatus 1.

The residual sheet amount detecting unit 6701 has the same function as that of the residual sheet amount detecting unit 701.

The sheet size type detecting unit 6703 receives sheet size signals from frame members, and signals from sensors positioned on the sheet transportation path, and detects respective sheet sizes, respective sheet types and so on of the sheets in the sheet cassettes 201*a*, 201*b*, 201*c* and 201*d* based on the signals. The frame members fit sheets and detect sheet sizes of them in the sheet cassettes 201*a*, 201*b*, 201*c* and 201*d*.

Some sheet types such as thick paper, color paper and one-side used paper are not detected by those sensors and the frame members. For such sheet types, the group setting function part 6705 sets the sheet type according to a user input.

The group setting function part 6705 forms groups of the sheet cassettes (as a grouping function). In general, a group is formed from the sheet cassettes of the same sheet size and the same sheet type. However, a group may be formed from the sheet cassettes of the different sheet sizes and/or the different sheet types. For example, a maintenance person inputs a default group setting when no sheets are in the sheet storage units. In this case, when the maintenance person inputs the setting, he/she does not know whether or not all of the sheet storage units in the group have sheets of the same sheet size and the same sheet type in the future.

The group setting function part 6705 has function units. The function units will be explained below in detail with reference to FIG. 25.

This image forming apparatus 1 has a grouping function. This grouping function enables to perform printing on a lot of sheets in excess of the maximum sheet capacity of the sheet cassette. Therefore, it is possible to continuously perform printing until all sheets in all of the sheet cassettes in the group are consumed. This is one of the largest advantages of the grouping function.

The group setting function part 6705 forms a group of the sheet storage units, and makes and maintains a record of the group. For example, a group is formed from sheet cassettes A and C that the sheet size is A4 and the sheet type is plain paper, and a group is formed from sheet cassettes B and D and a manual sheet feeding tray that the sheet size is A4 and the sheet type is one-side used paper.

The group may be formed according to an input to the operation panel 400, according to an instruction received via the communication interface unit 6751 from a printer watching utility 6911 of a PC#1 6901 as an external device, or by using a setting function of the internal web server from a browser 6913 of a PC#2 6903 as an external device.

The internal web server 6707 has the same function as that of the internal web server 707.

The sheet storage switching control unit 6709 has the same function as that of the sheet storage switching control unit 709.

The sheet empty warning unit 6711 warns of sheet empty on one of the sheet storage units in a group when all sheets are consumed for printing in the sheet storage unit.

[Configuration of the Group Setting Function Part]

Figure 25:
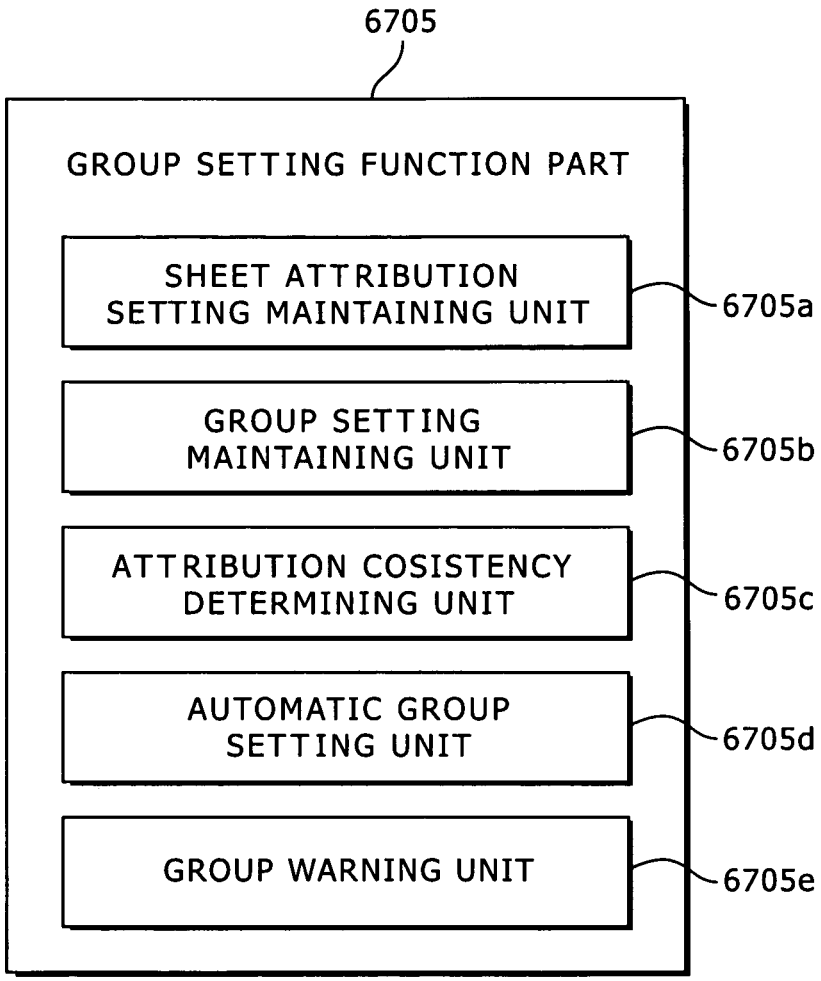
FIG. 25 shows a functional block diagram of the group setting maintaining unit in the image forming apparatus according to Embodiment 7 of this invention.

With reference to FIG. 25, the function units in the group setting function part 6705 are explained.

The group setting function part 6705 has a sheet attribution setting maintaining unit 6705*a*, a group setting maintaining unit 6705*b*, an attribution consistency determining unit 6705*c*, an automatic group setting unit 6705*d*, and a group warning unit 6705*e*.

The sheet attribution setting maintaining unit 6705*a* makes and maintains records of sheet attributions (e.g. sheet size and sheet type) of sheets stored in the sheet storage units (i.e. the sheet cassettes 201*a*, 201*b*, 201*c* and 201*d*, and the manual sheet feeding tray 220).

The group setting maintaining unit 6705*b* receives a group setting that specifies sheet storage units selected by a user, and makes and maintains a record of the group setting.

The attribution consistency determining unit 6705*c* determines whether or not a sheet attribution of a sheet stored in a sheet storage unit in a group is the same as a sheet attribution specified in a setting of the group.

The automatic group setting unit 6705*d* removes a sheet storage unit with an inconsistent sheet attribution determined by the attribution consistency determining unit from the group. The automatic group setting unit 6705*d* forms a new group of the removed sheet storage unit and other one or more sheet storage units with the same sheet attributions as that of the removed sheet storage unit. The automatic group setting unit 6705*d* may search for a sheet storage unit with the same sheet attributions only in the group to which the removed sheet storage unit belongs. Alternatively, the automatic group setting unit 6705*d* may search for it in all groups.

The automatic group setting unit 6705*d* makes and maintains a record of a setting that the aforementioned operations of removing the sheet storage unit and/or forming the new group are effective only for this print job or for this and following print jobs. This setting is input by a user. The automatic group setting unit 6705*d* operates according to this setting. If removing the sheet storage unit and/or forming the new group are effective only for this print job, then the automatic group setting unit 6705*d* restores the original group setting after this print job ends (this is mentioned below in Step S6027 of FIG. 26).

Further, the automatic group setting unit 6705*d* also makes and maintains a record of a setting that the aforementioned operations of removing the sheet storage unit and/or forming the new group are performed or not. This setting is also input by a user (as mentioned below in Step S6025 of FIG. 26). The automatic group setting unit 6705*d* operates according to this setting.

The group warning unit 6705*e* notifies a user of inconsistency among sheet attributions found by the attribution consistency determining unit 6705*c*. The group warning unit 6705*e* also notifies a user of removing the sheet storage unit and forming the new group by the automatic group setting unit 6705*d*. The group warning unit 6705*e* causes the touch panel 401 to display messages in order to notify of them. The group warning unit 6705*e* may notify the printer watching utility 6911 installed in the PC#1 6901, or may notify the browser via the internal web server 6707. Alternatively, two or three methods of the aforementioned warning methods may be performed.

[Flowchart]

Figure 26:
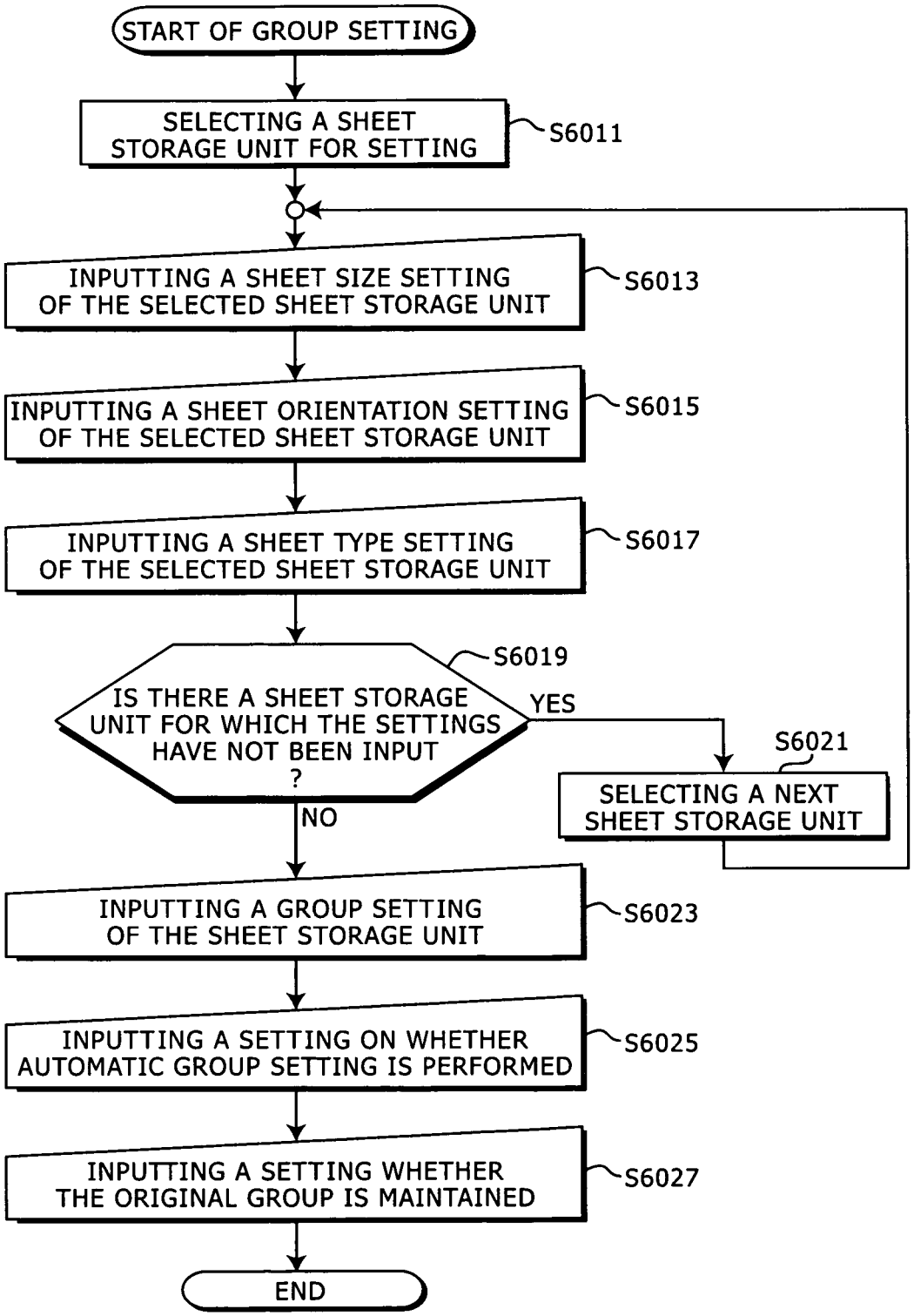
FIG. 26 shows a flowchart of forming a group in the image forming apparatus according to Embodiment 7 of this invention.
Figure 27:
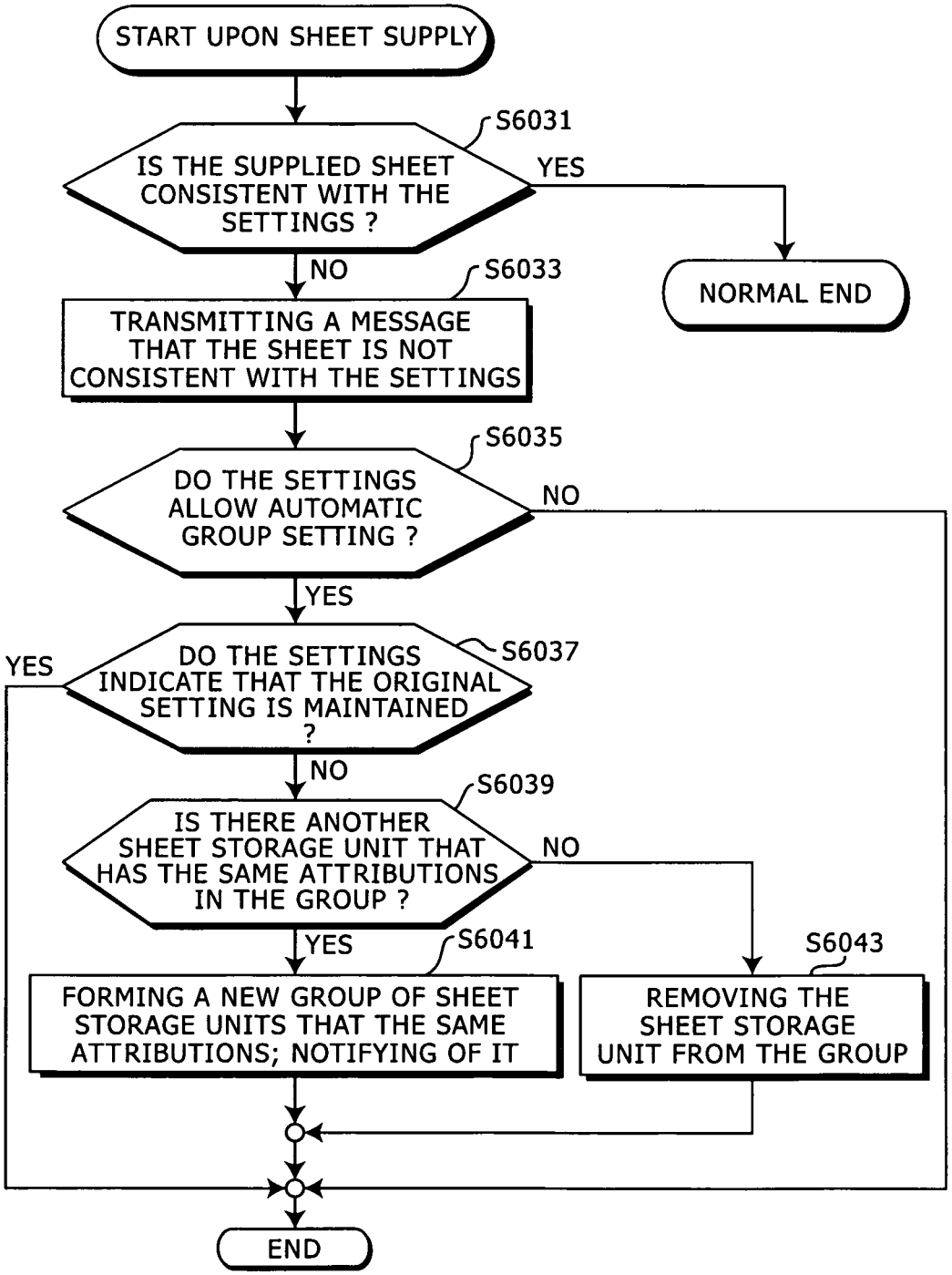
FIG. 27 shows a flowchart of operations when a sheet is supplied in the image forming apparatus according to Embodiment 7 of this invention.
Figure 28:
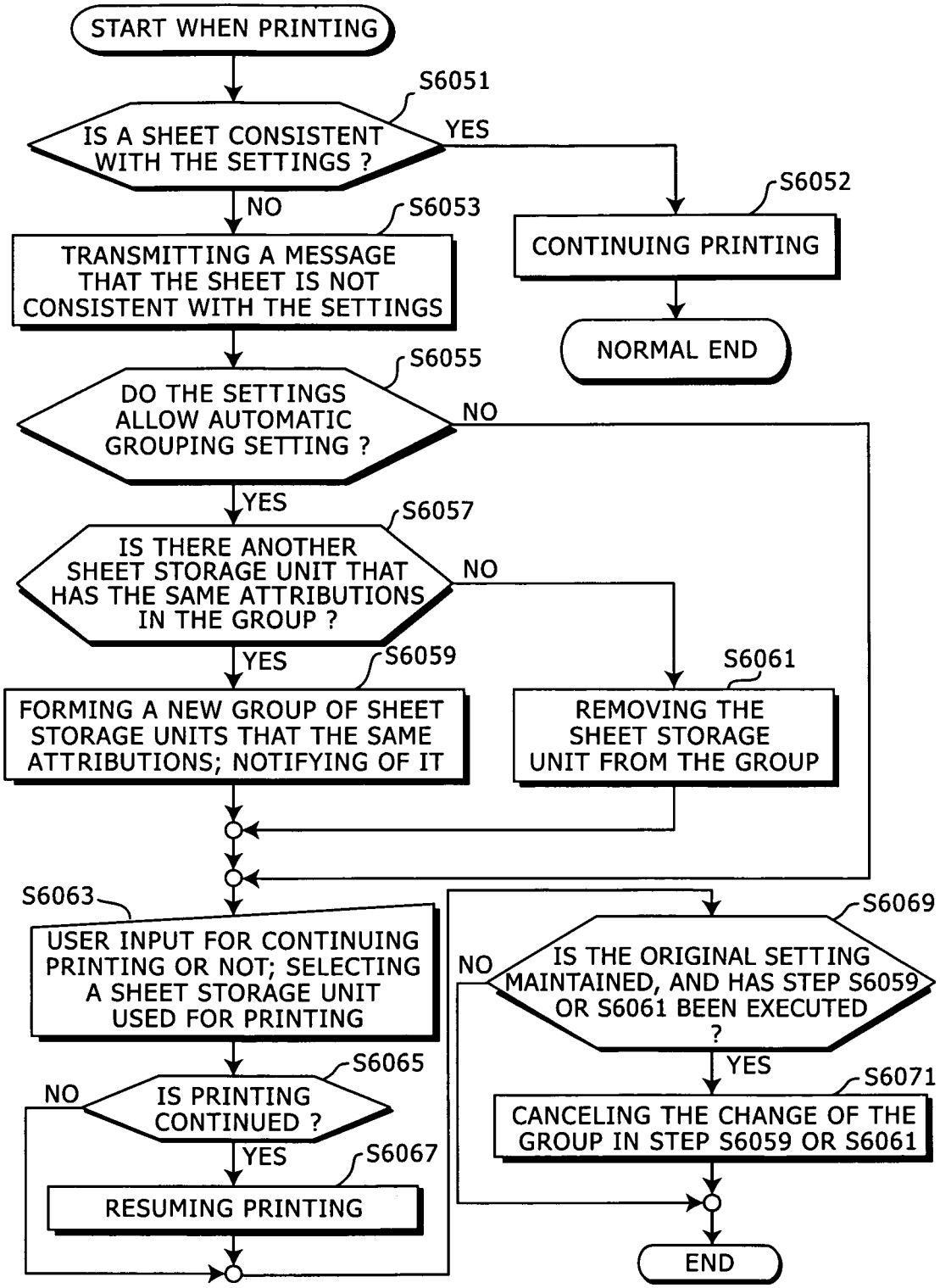
FIG. 28 shows a flowchart of operations for starting printing in an image forming apparatus according to Embodiment 7 of this invention.

With reference to FIGS. 26 to 28, explained are operations to form a group and operations performed when inconsistency of sheet attributions is found in the image forming apparatus of Embodiment 7.

At first, with reference to FIG. 26, explained are operations of setting sheet attributions (e.g. sheet size, feeding orientation, sheet type), and forming a group of sheet storage units.

Step S6011: The sheet attribution setting maintaining unit 6705*a* selects a sheet storage unit to be set sheet attributions. The sheet storage unit may be selected along a downward order from the top or may be selected according to a user operation to the touch panel.

Step S6013: The sheet attribution setting maintaining unit 6705*a* receives an input of a setting on a sheet size for the selected sheet storage unit. A sheet cassette as a sheet storage unit has a structure capable of storing sheets of various sizes. The structure has a movable frame to support edges of the sheets, and detects a sheet size according to a position of the movable frame, for example, by a sensor. The sheet attribution setting maintaining unit 6705*a* receives an input of the setting from the sheet cassette. Alternatively, the sheet size may be identified by a user input, for example, in a case that the image forming apparatus does not have the structure to detect the sheet size, a case that in the manual sheet feeding tray a sheet width can be detected but a sheet length of a sheet can not be detected until the sheet is fed, and a case that no sheets are supplied to the sheet storage unit.

Step S6015: The sheet attribution setting maintaining unit 6705*a* receives an input of a setting on a sheet feeding orientation for the selected sheet storage unit. Similar to Step S6013, some sheet cassettes can detect a sheet feeding orientation when sheets are supplied. Therefore, the sheet attribution setting maintaining unit 6705*a* receives an input of the setting from the sheet cassette. Alternatively, the sheet feeding orientation may be identified by a user input, for example, if the sheet cassette does not detect the sheet feeding orientation. It should be noted that a setting on a sheet feeding orientation may be not input and not used for determining the sheet attribution consistency, for example, when postprocessing is not performed, since even if a sheet is fed in any orientation, the sheet can be rotated. Further, a setting on a sheet size and/or a setting on a sheet type may be not input and not used for determining the sheet attribution consistency.

Step S6017: The sheet attribution setting maintaining unit 6705*a* receives an input of a setting on a sheet type for the selected sheet storage unit. As a sheet attribution, the sheet type includes not only sheet type such as plain paper, thick paper, color paper, or OHP sheet, but also a sheet state such as one-side used paper. If the sheet type can not be detected automatically, then a user inputs the sheet type. The sheet attribution setting maintaining unit 6705*a* receives an input of a setting on the sheet type from the user.

It may be detected that the sheet type is OHP sheet by a sensor when an OHP sheet is stored in the sheet storage unit or while an OHP sheet is being transported.

Step S6019: All sheet attributions for a sheet storage unit are set in Steps S6013 to S6017. It is determined whether or not there is a sheet storage unit for which sheet attributions have not been set. If there is a sheet storage unit for which sheet attributions have not been set, then Step S6021 is next executed. Otherwise, if there are no sheet storage units for which sheet attributions have not been set, then Step S6023 is next executed.

Step S6021: A sheet storage unit for which sheet attributions have not been set is selected. Sheet attributions are set for the selected sheet storage unit in Steps S6013 to S6017.

Step S6023: After sheet attributions have been set for all sheet storage units, an input of a group setting to form a group of the sheet storage units is received.

Step S6025: Inputs of other settings are received: (a) a setting on whether or not a sheet storage unit that has a sheet attribution different from that of one or more other sheet storage units in the group is removed from the group, and (b) a setting on whether or not when there are two or more sheet storage units which have the same sheet attributions are removed from the group, a new group is automatically formed of the removed sheet storage units (this operation is referred as "automatic group setting"). The automatic group setting unit 6705*d* makes and maintains a record of the setting on the automatic group setting, and operates according to the setting (mentioned below).

Step S6027: Received is an input of another setting on whether or not the automatic group setting is effective only for this print job or for this and following print jobs. If the automatic group setting is effective only in this print job, then group settings before performing the automatic group setting (i.e. original group settings) are maintained; and after this print job ends, group settings are restored to a state before the automatic group setting. Making the automatic group setting effective only in this print job is useful to an interruption process, for example, when for a print job, OHP sheets are temporarily stored in a sheet feeding tray that usually stores sheets of A4 paper in a group, and the OHP sheets in the sheet feeding tray are changed to sheets of A4 paper after the print job ends.

Secondly, with reference to FIG. 27, explained are operations after a sheet of paper is supplied in the image forming apparatus. In the operations, it is determined whether or not sheet attributions of a supplied sheet are the same as the sheet attributions set in the process shown in FIG. 26.

Step S6031: The attribution consistency determining unit 6705*c* determines, according to attributions detected by the sheet size type detecting unit 6703, whether or not sheet attributions of a sheet supplied to a sheet storage unit are the same as the sheet attributions that have been set to the sheet storage unit. The sheet attributions are sheet size, sheet feeding orientation, and sheet type. If the sheet size type detecting unit 6703 can not detect any of the sheet attributions, then the attribution consistency determining unit 6705*c* uses the sheet attributions set in Steps S6013 to S6017 to determine it. If all the sheet attributions are the same, then the process in FIG. 27 normally ends. Otherwise, if any of the sheet attributions is not the same, then Step S6033 is next executed.

Step S6033: The group warning unit 6705*e* warns of inconsistency of the sheet attributions. For warning in Step S6033, a warning message is displayed in the touch panel 401 (including a display unit) of the operation unit 400, or the image forming apparatus 1 notifies the printer watching utility 6911 installed in the PC#1 6901, or the image forming apparatus 1 notifies the browser of the PC#2 6903 via the internal web server 6707. Alternatively, two or three methods of the aforementioned warning methods may be performed.

Step S6035: The group warning unit 6705*e* determines, according to the settings on the automatic group setting set in Step S6025 of FIG. 26, whether or not the automatic group setting should be performed. If the automatic group setting should be performed, then Step S6037 is next executed. Otherwise, if the automatic group setting should not be performed, then the process shown in FIG. 27 ends.

Step S6037: The group warning unit 6705*e* determines, according to the setting in Step S6027 of FIG. 26, whether or not the original group settings should be maintained. If the original group settings should be maintained, then the process shown in FIG. 27 ends. Otherwise, if the original group settings should not be maintained, then Step S6039 is next executed.

Step S6039: The group warning unit 6705*e* determines whether or not the group of the sheet storage unit to which a sheet is supplied contains another sheet storage unit with the same sheet attributions as those of the sheet storage unit to which a sheet is supplied. If the group contains another sheet storage unit with the same sheet attributions, then Step S6041 is next executed. Otherwise, if the group contains no other sheet storage units with the same sheet attributions, then Step S6043 is next executed.

Step S6041: A new group is formed of sheet storage units: the sheet storage unit to which a sheet is supplied, and one or more other sheet storage units with the same sheet attributions in the group. The group warning unit 6705*e* notifies a user of forming the new group. The group warning unit 6705*e* notifies of it in the same way as that in Step S6033.

Step S6043: The sheet storage unit to which a sheet is supplied is removed from the group. The group warning unit 6705*e* notifies a user of removing the sheet storage unit from the group. The group warning unit 6705*e* notifies of it in the same way as that in Step S6033.

Thirdly, with reference to FIG. 28, explained are operations of the automatic group setting performed when printing is started.

Step S6051: When printing is started, the attribution consistency determining unit 6705*c* determines, according to attributions detected by the sheet size type detecting unit 6703, whether or not sheet attributions of a sheet stored in each of the sheet storage units are the same as the sheet attributions that have been set to the sheet storage unit. The sheet attributions are sheet size, sheet feeding orientation, and sheet type. If the sheet size type detecting unit 6703 can not detect any of the sheet attributions, then the attribution consistency determining unit 6705*c* uses the sheet attributions set in Steps S6013 to S6017 to determine it. If all sheet attributions of all the sheet storage units are the same as those in the settings, then Step S6052 is next executed. Otherwise, if any of the sheet storage units has inconsistency of a sheet attribution, then Step S6053 is next executed.

Step S6052: There are no problems on sheet attributions. The printing is continued, and the process shown in FIG. 28 ends.

Step S6053: The group warning unit 6705*e* warns of inconsistency of the sheet attributions, and stops the printing. The group warning unit 6705*e* notifies of it in the same way as that in Step S6033.

Step S6055: The group warning unit 6705*e* determines, according to the settings on the automatic group setting set in Step S6025 of FIG. 26, whether or not the automatic group setting should be performed. If the automatic group setting should be performed, then Step S6057 is next executed. Otherwise, if the automatic group setting should not be performed, then Step S6063 is next executed.

Step S6057: The group warning unit 6705*e* determines whether or not the group of the sheet storage unit currently selected to feed a sheet of paper contains another sheet storage unit with the same sheet attributions as those of the currently selected sheet storage unit. If the group contains another sheet storage unit with the same sheet attributions, then Step S6059 is next executed. Otherwise, if the group does not contains no other sheet storage units with the same sheet attributions, then Step S6061 is next executed.

Step S6059: A new group is formed of sheet storage units: the sheet storage unit to which a sheet is supplied, and the another sheet storage unit with the same sheet attributions.

The group warning unit 6705*e* notifies a user of forming the new group. The group warning unit 6705*e* notifies of it in the same way as that in Step S6033.

Step S6061: The sheet storage unit to which a sheet is supplied is removed from the group. The group warning unit 6705*e* notifies a user of removing the sheet storage unit from the group. The group warning unit 6705*e* notifies of it in the same way as that in Step S6033.

Step S6063: Due to inconsistency of sheet attributions in the group, the group setting maintaining unit 6705*b* receives a selection of whether or not the printing is continued. When the group setting maintaining unit 6705*b* receives a selection that the printing is continued, the group setting maintaining unit 6705*b* also receives a selection of a sheet storage unit. The selection specifies one of three alternatives: a sheet storage unit in the new group, a sheet storage unit in the original group, and the removed sheet storage unit.

Step S6065: It is determined, according to the selection in Step S6063, whether or not the printing is continued. If it is determined that the printing is continued, then Step S6067 is next executed. Otherwise, if it is determined that the printing is not continued, the Step S6069 is next executed.

Step S6067: The printing is resumed with feeding a sheet from the sheet storage unit specified by the selection in Step S6063.

Step S6069: It is determined whether or not the original group settings are maintained and the automatic group setting has been performed in Step S6059 or S6061. Whether or not the original group settings are maintained is determined according to the setting in Step S6027. If it is determined that the original group settings are maintained and the automatic group setting has been performed in Step S6059 or S6061, then Step S6071 is next executed; otherwise, the process shown in FIG. 28 ends.

Step S6071: Since the automatic group setting in Step S6059 or S6061 is effective only in this print job, the group settings are restored after finishing the printing (i.e. this print job). To restore the group settings, the removed sheet storage unit is included in the original group; and sheet storage units in the new group are included in the original group, and then the new group is deleted.

According to the aforementioned operations, the image forming apparatus 1 removes a sheet storage unit of sheet attributions different from those of other sheet storage units in a group or moves it to a new group. After the sheet storage unit is removed or moved to a new group, a user can choose either a group of sheet storage unit or a sheet storage unit to be used for resuming printing.

In Steps S6039 and S6057, the group warning unit 6705*e* searches for a sheet storage unit with the same sheet attribution only in the group to which the removed sheet storage unit belongs. Alternatively, the group warning unit 6705*e* may search for it in all groups.

[User Interface Screen for Forming a Group]

A user interface screen for forming a group in Embodiment 7 is the same as that in Embodiment 1, and therefore, it is not explained here.

Advantages of Embodiment 7

When a sheet is supplied or when printing is started, if the image forming apparatus detects a sheet storage unit of sheet attributions different from those of other sheet storage units, then the image forming apparatus removes the sheet storage unit from the group currently selected for printing. It prevents to print on a sheet of paper with incorrect sheet attributions.

Further, if the group contains another sheet storage unit of the same sheet attributions as those of the removed sheet storage unit, then the image forming apparatus forms a new group of sheet storage units of the same sheet attributions as those of the removed sheet storage unit. Therefore, sheet storage units of the same sheet attributions as those of the removed sheet storage unit can be used to continue printing.

Further, in Step S6063 of FIG. 28, a user can choose one from (a) the removed sheet storage unit, (b) the new group, (c) the unremoved sheet storage unit in the currently selected group (i.e. the original group), and (d) the currently selected group (i.e. the original group). Therefore, the automatic group setting is more useful for the user.

Further, the group warning unit 6705*e* notifies a user of a change in the group settings (e.g. removing a sheet storage unit from a group, forming a new group, and so on). Therefore, it makes the user know the change in the group settings.

Further, a user can choose (a) whether the automatic group setting is performed or not, (b) whether the group setting is effective only in a current print job or not, (c) searching for the sheet storage unit of the same sheet attributions only in the currently selected group or in all groups; and the image apparatus operates as chosen by the user. Therefore, more alternatives are provided to the user.

Further, if the automatic group setting is effective only in a current print job, then the removed sheet storage unit is only out of the group until a print job being executed when the sheet storage unit is removed is finished. That is, after finishing the print job, then the removed sheet storage unit returns to the group. Therefore, even if sheets of paper with sheet attributions different from the settings are temporarily stored in a sheet storage unit and used for printing, and the sheets of paper are changed to sheets with sheet attributions specified in the settings after the printing, then it is not necessary to change the settings when the sheets are changed.

Further, if the automatic group setting is effective only in a current print job, then the new group that contains the removed sheet storage unit only persists until a print job being executed when the new group is formed is finished. That is, after finishing the print job, all sheet storage units in the new group returns their original group(s). Therefore, even if sheets of paper with sheet attributions different from the settings are temporarily stored in a sheet storage unit and used for printing, and the sheets of paper are changed to sheets with sheet attributions specified in the settings after the printing, then it is not necessary to change the settings when the sheets are changed.

Further, the sheet attributions used to detect inconsistency contain at least one of sheet size, sheet feeding orientation and sheet type. A user can choose whether or not each of them (that is, a sheet size, a sheet feeding orientation, and a sheet type) is included to the sheet attributions used to detect inconsistency.

Further, when a print job does not need a process in a postprocessing device, even if a sheet feeding orientation is not the same as that in the setting, a correct printing result can be obtained by rotating a print image of the print job by 90 degrees. Therefore, sheet feeding orientation may not be included to the sheet attributions of which inconsistency is detected. As a result, more sheet storage units can be used for printing.

In Embodiment 7, the image forming apparatus 1 has the document feeding part 600, the document scanning unit 500 and the postprocessing part 300. This is an example of a relatively high performance image forming apparatus. This invention is not limited to this embodiment, and it can also be applied to an image forming apparatus without these parts and units.

In Embodiment 7, when a group is formed, a user may input sheet attributions corresponding to the group; otherwise, sheet attributions corresponding to the group are identified from a sheet stored in a selected sheet storage unit. If a user inputs sheet attributions corresponding to the group, then a sheet storage unit of sheet attributions different from those input by the user is removed from the group.

In Step S6063 of FIG. 28, a user chooses a sheet storage unit or a group. Alternatively, in Step S6063, the apparatus may automatically select a sheet storage unit or a group.

When sheet attributions corresponding to a group are automatically identified, sheet attributions corresponding to a group may be decided according to a majority rule. If the numbers of sheet storage units with a set of sheet attributions is the same as the number of sheet storage units with another set of sheet attributions, then one of them is selected as sheet attributions corresponding to the group randomly, by a user or according to a history.

Embodiment 8

Hereinafter, an image forming apparatus of Embodiment 8 is explained.

[Machine Configuration]

A mechanical configuration of the image forming apparatus in Embodiment 8 is identical to that in Embodiment 1, and therefore, it is not explained here.

[Functional Blocks]

Figure 29:
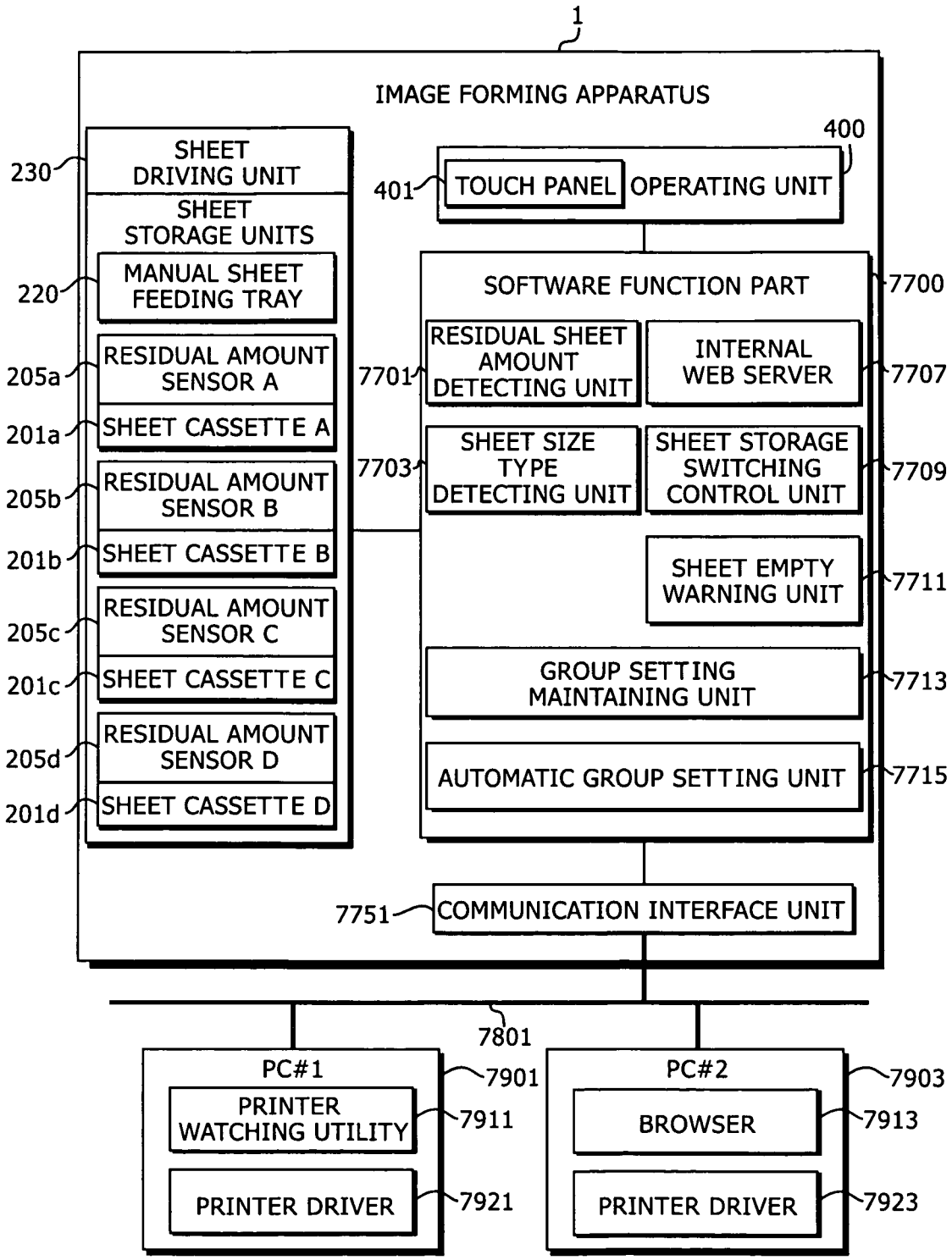
FIG. 29 shows a functional block diagram of an image forming apparatus according to Embodiment 8 of this invention.

FIG. 29 shows a functional block diagram of an image forming apparatus according to Embodiment 8.

This functional block diagram does not show other components which are generally installed in an image forming apparatus.

As shown in FIG. 29, the image forming apparatus 1 has a software function part 7700 and a communication interface unit 7751 as functional blocks together with the aforementioned sheet storage units (the sheet cassettes 201*a*, 201*b*, 201*c* and 201*d*, and the manual sheet feeding tray 220), the sheet driving unit 230, the operation unit 400, the touch panel 401 (a display unit), and so on.

The software function part 7700 has functional blocks of a sheet residual detecting unit 7701, a sheet size type detecting unit 7703 (as a sheet attribution detecting unit), an internal web server 7707, a sheet storage switching control unit 7709, a sheet empty warning unit 7711, a group setting maintaining unit 7713, and an automatic group setting unit 7715.

Further, the image forming apparatus 1 is connected to a network 7801 by the communication interface unit 7751, and is connected via the network 7801 to a PC (Personal Computer) #1 7901 and a PC (Personal Computer) #2 7903 connected to the network 7801.

In the following part, the functional blocks are explained.

The communication interface unit 7751 is an interface unit that connects the image forming apparatus 1 to the network. The image forming apparatus 1 communicates with an external device such as a personal computer by the communication interface unit 7751.

The software function part 7700 is embodied by executing a software program in a computer inside of the image forming apparatus 1.

The residual sheet amount detecting unit 7701 has the same function as that of the residual sheet amount detecting unit 701.

The sheet size type detecting unit 7703 receives sheet size signals from frame members, and signals from sensors positioned on the sheet transportation path, and detects respective sheet sizes, respective sheet types and so on of the sheets in the sheet cassettes 201*a*, 201*b*, 201*c* and 201*d* based on the signals. The frame members fit sheets and detect sheet sizes of them in the sheet cassettes 201*a*, 201*b*, 201*c* and 201*d*.

Some sheet types such as thick paper, color paper and one-side used paper are not detected by those sensors and the frame members. For such sheet types, the group setting maintaining unit 7713 sets the sheet type according to a user input.

The internal web server 7707 has the same function as that of the internal web server 707.

The sheet storage switching control unit 7709 has the same function as that of the sheet storage switching control unit 709.

The sheet empty warning unit 7711 warns of sheet empty on one of the sheet storage units in a group when all sheets are consumed for printing in the sheet storage unit.

The group setting maintaining unit 7713 is capable of forming groups of the sheet cassettes (as a grouping function). In general, a group is formed from the sheet cassettes of the same sheet size and the same sheet type. However, a group may be formed from the sheet cassettes of the different sheet sizes and/or the different sheet types. For example, a maintenance person inputs a default group setting when no sheets are in the sheet storage units. In this case, when the maintenance person inputs the setting, he/she does not know whether or not all of the sheet storage units in the group have sheets of the same sheet size and the same sheet type in the future.

This image forming apparatus 1 has a grouping function. This grouping function enables to perform printing on a lot of sheets in excess of the maximum sheet capacity of the sheet cassette. Therefore, it is possible to continuously perform printing until all sheets in all of the sheet cassettes in the group are consumed. This is one of the largest advantages of the grouping function.

The group setting maintaining unit 7713 forms a group of the sheet storage units, and makes and maintains a record of the group. For example, a group is formed from sheet cassettes A and C that the sheet size is A4 and the sheet type is plain paper, and a group is formed from sheet cassettes B and D and a manual sheet feeding tray that the sheet size is A3.

The group may be formed according to an input to the operation panel 400, according to an instruction received via the communication interface unit 7751 from a printer watching utility 7911 of a PC#1 7901 as an external device, or by using a setting function of the internal web server 7707 from a browser 7913 of a PC#2 7903 as an external device.

The automatic group setting unit 7715 forms a group from sheet storage units of one or more same sheet attributions according to one or more sheet attributions detected by the sheet size type detecting unit 7703 and/or one or more sheet attributions input by a user. A group setting of this group is maintained by the group setting maintaining unit 7713.

When the automatic group setting unit 7715 forms a group, the automatic group setting unit 7715 selects one from three modes: (a) forming a group from sheet storage units of a same sheet size, (b) forming a group from sheet storage units of a same sheet type, and (c) forming a group from sheet storage units of both of a same sheet size and a same sheet type. Hereinafter, this selection of the mode is referred as "mode setting."

[Flowchart]

Figure 30:
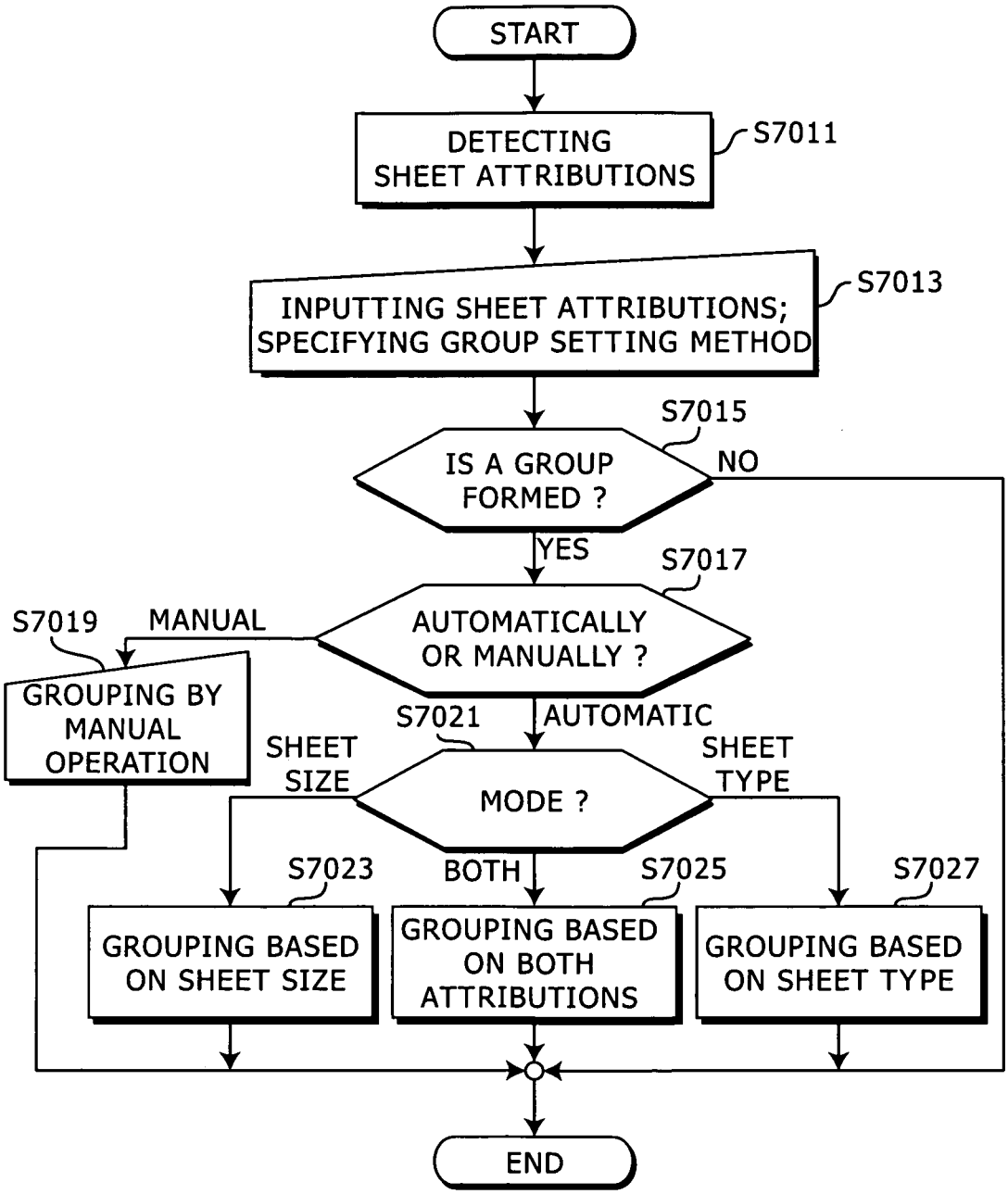
FIG. 30 shows a flowchart of forming a group in the image forming apparatus according to Embodiment 8 of this invention.

With reference to a flowchart in FIG. 30, explained are operations to automatically form a group in the image forming apparatus of Embodiment 8.

Step S7011: The residual sheet amount detecting unit 7701 receives output signals from sensors attached to sheet storage units (i.e. the sheet cassettes 201*a*, 201*b*, 201*c* and 201*d*, and the manual sheet feeding tray 220) in the image forming apparatus, and detects respective sheet sizes of sheets stored in the sheet storage units from the output signals. The residual sheet amount detecting unit 7701 also detects respective sheet types of sheets stored in the sheet storage units from the output signals, if possible. The group setting maintaining unit 7713 makes and maintains a record of the detected sheet size and/or the detected sheet type for each of the sheet storage units.

Step S7013: If there is a sheet attribution that was not detected in Step S7011, then the group setting maintaining unit 7713 receives a user input to set the sheet attribution, and makes and maintains a record of the sheet attribution based on the user input. The group setting maintaining unit 7713 receives user inputs for settings of: (a) whether or not a group is formed, (b) forming a group manually or automatically, if a group is formed, and (c) which of the three modes is used for automatically forming a group (i.e. mode setting). This automatic group forming and the mode setting will be explained below in detail with reference to FIG. 31.

Step S7015: It is determined according to the setting in Step S7013, whether or not a group is formed. If it is determined that a group is formed, then Step S7017 is next executed. Otherwise, if it is determined that a group is not formed, then the process shown in FIG. 30 ends.

Step S7017: It is determined according to the setting in Step S7013, that a group is formed manually or automatically. If it is a group is formed manually, then Step S7019 is next executed. If it is a group is formed automatically, then Step S7021 is next executed.

Step S7019: The group setting maintaining unit 7713 receives user inputs of a group setting to form a group, and makes and maintains a record of the group setting.

Step S7021: The automatic group setting unit 7715 determines which of the modes has been selected for automatic group forming. If a group is formed from sheet storage units of a same sheet size, then Step S7023 is next executed. If a group is formed from sheet storage units of a same sheet type, then Step S7027 is next executed. If a group is formed from sheet storage units of both of a same sheet size and a same sheet type, then Step S7025 is next executed.

Step S7023: The automatic group setting unit 7715 forms a group from sheet storage units of a same sheet size.

Step S7025: The automatic group setting unit 7715 forms a group from sheet storage units of both of a same sheet size and a same sheet type.

Step S7027: The automatic group setting unit 7715 forms a group from sheet storage units of a same sheet type.

According to the aforementioned operations, the image forming apparatus forms one or more groups from sheet storage units.

When a print job is executed after these operations, printing is performed with feeding a sheet of paper from a sheet storage unit in a group specified in the print job, and even if sheet empty occurs on the sheet storage unit, the printing is continued with feeding a sheet of paper from another sheet storage unit in the group.

[Detailed Operations of Forming a Group and a User Interface Thereof]

Figure 31A:
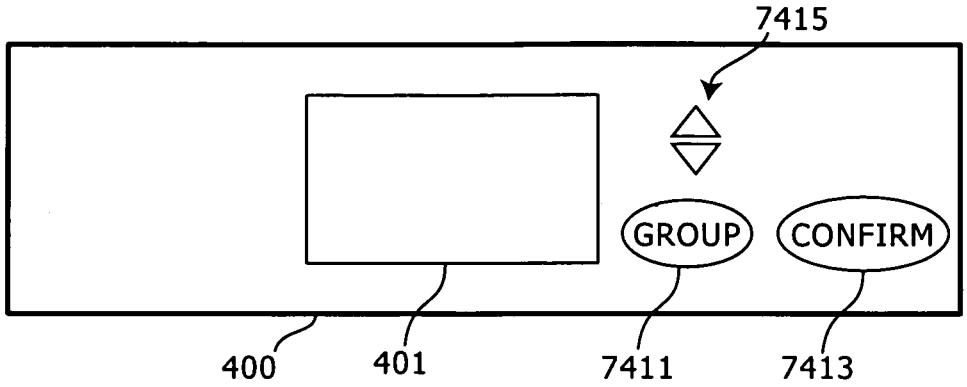
FIGS. 31A and 31B show keys in an operation unit and a screen used for forming a group in the image forming apparatus according to Embodiment 8 of this invention.
Figure 31B:
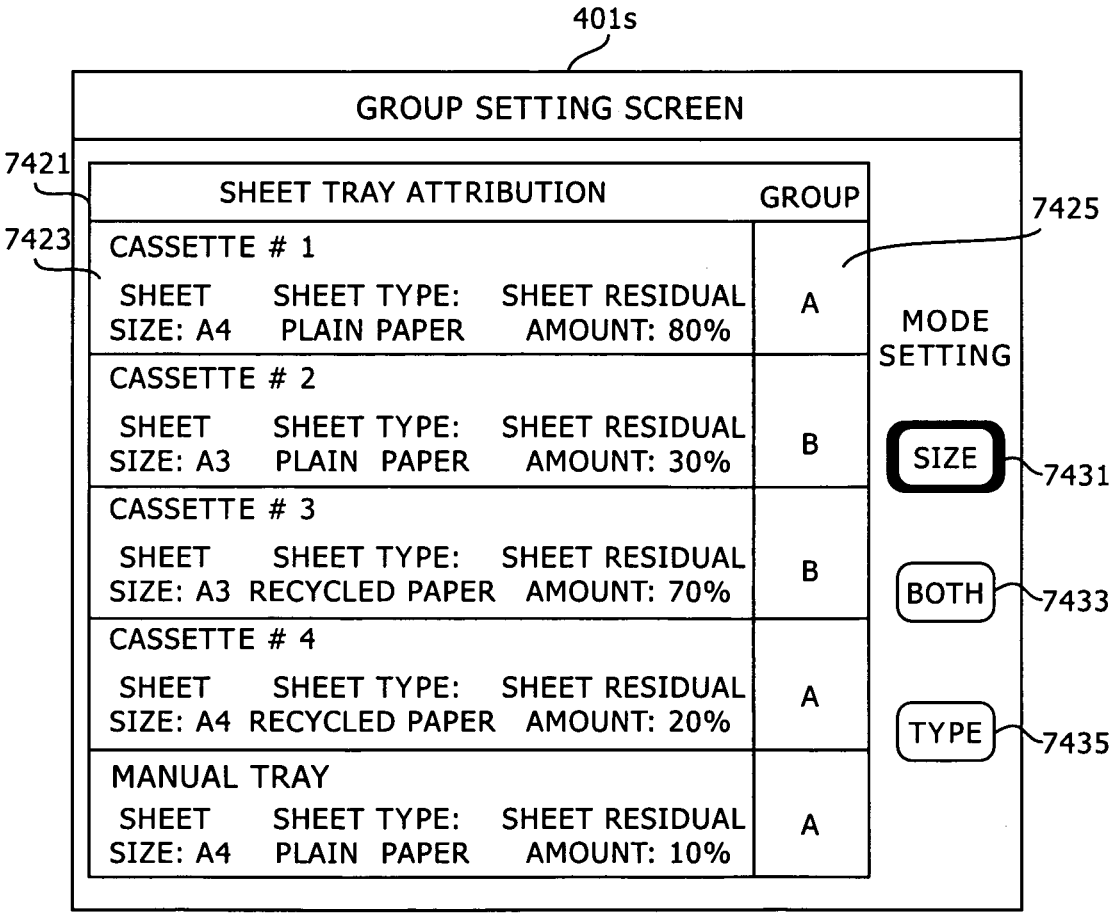

With reference to FIGS. 31A and 31B, detailed operations of forming a group and a user interface thereof are explained here.

FIG. 31A shows the operation unit 400 of the image forming apparatus 1. The operation unit 400 has the touch panel 401 as a display unit, a group setting key 7411, a confirmation key 7413, and up and down keys 7415.

When the group setting key 7411 is pushed down, the process to form a group is started, and a group setting screen is displayed on the touch panel 401 as shown in FIG. 31B.

The group setting screen 401*s* contains a tray attribution table 7421 that indicates sheet attributions and residual amount of sheets for each of the sheet storage units. For example, in an indication field 7423, sheet attributions and residual amount of sheets of the sheet cassette 201*a* (i.e. CASSETTE#1 in FIG. 31B) are indicated. If forming a group has been performed, then the group to which the sheet storage unit belongs is indicated in a group field 7425. Further, for example, if a mode to form a group based on only sheet size has been selected for automatic group forming in the mode setting, then CASSETTE#1, CASSETTE#4 as the sheet cassette 201*d*, and MANUAL TRAY as the manual sheet feeding tray 220 have sheets of the size A4, and therefore a group A has been formed of them; and CASSETTE#2, and CASSETTE#3 have sheets of the size A3, and therefore, a group B has been formed of them. As a result, if a mode of only sheet size has been selected, then in the screen 401*s*, a sheet size key 7431 is highlighted, and the group fields 7425 of CASSETTE#1, CASSETTE#4 and MANUAL TRAY indicates the group A, and the group fields 7425 of CASSETTE#2 and CASSETTE#3 indicates the group B.

There are a sheet type key 7435 and a both attribution key 7433 for the mode setting other than the sheet size key 7431. The sheet type key 7435 is selected to select a mode to form a group based on only sheet type in the mode setting. The both attribution key 7433 is selected to select a mode to form a group based on both sheet size and sheet type in the mode setting. When one of the up and down keys 7415 is pushed down, another one of the keys 7431, 7433 and 7435 is highlighted. If the confirmation key 7413 is pushed down, then the highlighted key is selected. If another key (e.g. the key 7433 or 7435 in FIG. 31B) than the currently selected key (e.g. the key 7431 in FIG. 31B) is selected, then groups are re-formed based on a new mode corresponding to the new selected key.

If a sheet type area in the indication field 7423 is touched when the tray attribution table 7421 is displayed, then the touch panel 401 detects that the sheet type area is touched, and a sheet type in the sheet type area can be changed according to a user input. If a sheet type can not be detected automatically, then a user inputs the sheet type.

After a sheet type is changed, if a user pushes down the group setting key 7411, then groups are re-formed based on the changed sheet type.

Advantages of Embodiment 8

The automatic group setting unit automatically forms a group based on one or more sheet attributions obtained by the sheet size type detecting unit and/or one or more sheet attributions input by a user if undetectable. It saves user work for forming a group. It prevents a trouble such as printing on incorrect sheets, for example, in a case that a user manually forms a group from sheet storage units of different sheet attributions by mistake.

In Embodiment 8, the image forming apparatus 1 is an example of a relatively high performance image forming apparatus. This invention is not limited to this embodiment, and it can also be applied to an image forming apparatus without optional parts and units such as the document feeding part 600, the document scanning unit 500 and the postprocessing part 300.

Further, in Embodiment 8, sheet size and sheet type are taken into account to form a group. In addition to sheet size and sheet type, one or more other sheet attributions such as sheet feeding orientation (e.g. A4 or A4-R) may be taken into account to form a group.

The start button 402 may be used instead of the confirmation key 7413 shown in FIG. 31A.

Further, the group setting key 7411 may be a hardware key shown in FIG. 31A or a key displayed on the touch panel by software. A user's touch to a key displayed on the touch panel 401 is detected by the touch panel 401.

Further, in Embodiment 8, the up and down keys 7415 are used to select an item in the group setting screen. Alternatively, the touch panel 401 may detect a user's touch to an item to select the item in the group setting screen.

In ordinary machines, a lot of user work is required to form a group from sheet storage units. According to this embodiment, this problem is solved by the automatic group setting unit that automatically forms a group based on one or more sheet attributions of sheet storage units.

Embodiment 9

Hereinafter, an image forming apparatus of Embodiment is explained. In Embodiment 9, both a sheet feeding tray and a sheet storage unit refer to the same thing.

Example 1

[Machine Configuration]

A mechanical configuration of the image forming apparatus in Embodiment 9 is identical to that in Embodiment 1, and therefore, it is not explained here.

[Functional Blocks]

Figure 32:
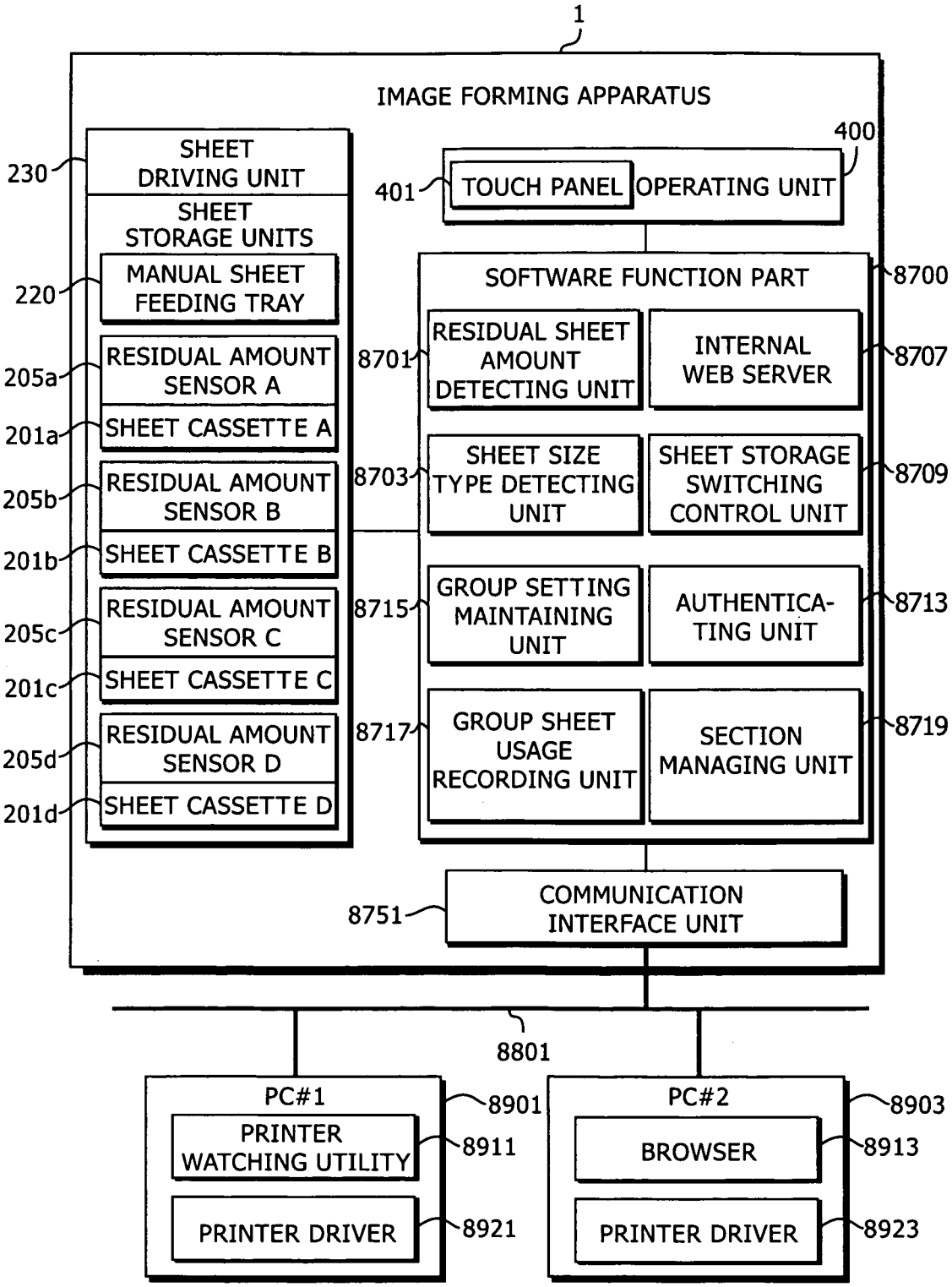
FIG. 32 shows a functional block diagram of an image forming apparatus according to Embodiment 9 of this invention.

FIG. 32 shows a functional block diagram of an image forming apparatus according to Embodiment 9.

This functional block diagram does not show other components which are generally installed in an image forming apparatus.

As shown in FIG. 32, the image forming apparatus 1 has a software function part 8700 and a communication interface unit 8751 as functional blocks together with the sheet storage units (the sheet cassettes 201*a*, 201*b*, 201*c* and 201*d*, and the manual sheet feeding tray 220), the sheet driving unit 230, the operation unit 400, the touch panel 401 (a display unit), and so on.

The software function part 8700 has functional blocks of a sheet residual detecting unit 8701, a sheet size type detecting unit 8703, an internal web server 8707, a sheet storage switching control unit 8709, an authenticating unit 8713, a group setting maintaining unit 8715, a group sheet usage recording unit 8717, and a section managing unit 8719.

Further, the image forming apparatus 1 is connected to a network 8801 by the communication interface unit 8751, and is connected via the network 8801 to a PC (Personal Computer) #1 8901 and a PC (Personal Computer) #2 8903 connected to the network 8801.

In the following part, the functional blocks are explained.

The communication interface unit 8751 is an interface unit that connects the image forming apparatus 1 to the network. The image forming apparatus 1 communicates with an external device such as a personal computer by the communication interface unit 8751.

The software function part 8700 is embodied by executing a software program in a computer inside of the image forming apparatus 1. In the following part, the functional blocks in the software function part 8700 are explained.

The residual sheet amount detecting unit 8701 has the same function as that of the residual sheet amount detecting unit 701.

The sheet size type detecting unit 8703 has the same function as that of the sheet size type detecting unit 703.

Some sheet types such as thick paper, color paper and one-side used paper are not detected by those sensors and the frame members. For such sheet types, the group setting maintaining unit 8715 sets the sheet type according to a user input.

The internal web server 8707 has the same function as that of the internal web server 707. The internal web server 8707 can provide a setting screen (mentioned below) for setting a sheet storage unit to be substituted.

The sheet storage switching control unit 8709 has the same function as that of the sheet storage switching control unit 709.

If a sheet storage unit used to feed a sheet is automatically changed to another one in a group, then the apparatus may print on a sheet that a user does not intend to use in some cases, for example, a case that sheet storage units of different sheet sizes and/or different sheet types belongs to the group. Therefore, there is a setting of whether or not the automatic change of sheet storage unit is performed, and the apparatus operates according to this setting.

For example, in a case that a group contains TRAY#1, TRAY#2, and TRAY#3, and TRAY#1 has a sheet of A4 plain paper, TRAY#2 has a sheet of A4 plain paper, and TRAY#3 has a sheet of A3 plain paper, the setting can be set as the automatic change can be performed only between TRAY#1 and TRAY#2, and the automatic change is performed neither between TRAY#1 and TRAY#3 nor between TRAY#2 and TRAY#3.

The group setting maintaining unit 8715 is capable of forming groups of the sheet storage units (as a grouping function).

In this embodiment, groups of sheet storage units are used for a section management, and may be or may not be used for the aforementioned continuous printing, that is, automatically changing a sheet storage unit to feed sheets continuously.

Forming a group is explained in detail below with an explanation of a user interface screen. The group may be formed according to an input to the operation panel 400, according to an instruction received via the communication interface unit 8751 from a printer watching utility 8911 of a PC#1 8901 as an external device, or by using a setting function of the internal web server 8707 from a browser 8913 of a PC#2 8903 as an external device.

Table 4 shows an example of records of group settings maintained by the group setting maintaining unit 8715.

TABLE 4

| # | GROUP NAME | TRAYS IN THE GROUP |
|---|---|---|
| 1 | GROUP A | TRAY #1, TRAY #4 |
| 2 | GROUP B | TRAY #2, TRAY #4 |

The group setting maintaining unit 8715 forms groups from sheet storage units, and the groups commonly have any of the sheet storage units.

In Table 4, two groups A and B have been formed, the group A has been formed from two sheet storage units: TRAY#1 and TRAY#4, and the group has been formed from two sheet storage units: TRAY#2 and TRAY#4. Thus, TRAY#4 belongs to both of the groups A and B.

In Table 4, the groups A and B commonly have one tray, that is, TRAY#4. Alternatively, the groups may commonly have two or more sheet storage units. For example, the groups A and B commonly have TRAY#3 in addition to the sheet storage units shown in Table 4.

One or more of the groups formed from the sheet storage units may have no common sheet storage unit. For example, in addition to the groups A and B shown in Table 4, a group C may be formed. The group C contains only TRAY#3 and MANUAL TRAY. In this case, the groups A and C have no common sheet storage unit, and the groups B and C have no common sheet storage unit.

The authenticating unit 8713 maintains a record of authentication information of a user section, and executes an authentication based on the authentication information before a user uses this apparatus, and allows the user to use this apparatus only if the user is authenticated.

Specifically, when the authenticating unit 8713 executes the authentication, the authenticating unit 8713 determines whether or not a set of a section ID and a password as section authentication information input by a user is the same that in the authentication information (e.g. shown in Table 5).

TABLE 5

| # | USER SECTION | SECTION ID | PASSWORD | GROUP | TOTAL NUMBER OF CONSUMED SHEETS |
|---|---|---|---|---|---|
| 1 | DEVEL-OPMENT DEPT | knk | *uio)9%hjksEd | A | 638 |
| 2 | GEN-ERAL AFFAIRS DEPT | smk | pl*%hkM#$hDf | B | 232 |

For example, the first record in Table 5 contains an section ID "knk" of a user section "Development department", and a hash value "*uio)9%hjksEd" of a password of it, and the group A is assigned to the Development department, and the total number of sheets consumed by the Development department is "638."

The authenticating unit 8713 receives the section ID and the password input by a user from the operation unit 400, and calculates a hash value of the password, and identifies a record that contains a same section ID as the input section ID, and determines whether or not the hash value of the input password is the same as that in the record in Table 5. If it determines that the hash value of the input password is the same as that in the record in Table 5, then the authenticating unit 8713 allows the user to use this apparatus.

The user can use sheets of paper stored in sheet storage units in only the group corresponding to a user section to which the user belongs. For example, a user of the Development department in Table 5 can use sheets of paper stored in only sheet storage units in the group A. The sheet storage units in the group A are identified as TRAY#1 and TRAY#4 from Table 4.

The group sheet usage recording unit 8717 maintains respective records of consuming sheets in the groups. The records are associated with user section authentication information (i.e. a section ID and a password). The total number of consumed sheets of a user section is increased when any of users in the user section consumes a sheet of paper. For example, in Table 5, the total number of sheets consumed by the Development department is increased when any of users in the Development department consumes a sheet of paper.

The section managing unit 8719 manages records in Table 5, and associates section authentication information of a user section with one of the groups, and maintains a record of the association together with the records maintained by the group sheet usage recording unit.

[User Interface Screen for Forming a Group]

A user interface screen for forming a group in Embodiment 9 is the same as that in Embodiment 1, and therefore, it is not explained here.

PRACTICE EXAMPLES OF THE SECTION MANAGEMENT

In the following part, explained are practice examples of the section management performed when groups have been formed from sheet storage units.

PRACTICE EXAMPLE 1

Here, as shown in Table 5, a group A is formed from TRAY#1 and TRAY#2, and a group B is formed from TRAY#2 and TRAY4. The Development department is allowed to use the group A and the General affairs department is allowed to use the group B.

Here, the Development department pays a cost of sheets stored in TRAY#1, and the General affairs department pays a cost of sheets stored in TRAY#2. Since TRAY#4 belongs to both of the groups A and B, a cost of sheets stored in TRAY#4 may be paid by a division that includes the Development department and the General affairs department and has a common budget on the departments.

A detailed usage of TRAY#4 may be decided by the departments. For example, sheets of a rarely used type such as OHP sheet or A3 paper may be stored in TRAY#4.

PRACTICE EXAMPLE 2

Here, information on consuming a sheet on each of the sheet storage unit is recorded in addition to the total number in Table 5.

For example, in the same group settings as those in Practice example 1, spare sheets are stored in TRAY#4. The Development department ordinarily uses sheets stored in TRAY#1. However, for example, if the Development department has used all sheets provided in TRAY#1 for a current month, then the Development department can borrow and use sheets stored in TRAY#4 which belongs to both of the groups. If the Development department borrows and uses sheets stored in TRAY#4, then in next month, the Development department supplies sheets of the same number of borrowed sheets to TRAY#4. Therefore, even if the cost of sheets of paper in a current month reaches a monthly budget, spare sheets stored in a common sheet storage unit can be used.

Advantages of Example 1

One or more sheet storage units can belong to pluralities of groups. Therefore, a flexible sheet management can be performed. For example, a division that has the common budget may pay a cost of sheets of paper stored in a common sheet storage unit.

A sheet storage unit that belongs to pluralities of groups can be used as a spare sheet storage unit. Even if the cost of sheets of paper supplied in an ordinarily used sheet storage unit reaches a monthly budget, spare sheets stored in the spare sheet storage unit can be borrowed and used.

As shown in Table 5, a data amount in the table that maintains the section information and the section authentication information is small and determined according to the number of user sections. Therefore, if the number of user sections is fixed, then the data amount of the table is not increased due to the use of the apparatus. As a result, since resources such as memory are not wasted, this embodiment can be applied to a low-price image forming apparatus with small resources.

Example 2

In Example 2, the image forming apparatus performs a personal authentication and a personal usage management rather than the authentication and the usage management for user sections mentioned in Example 1.

A mechanical configuration of the image forming apparatus in Example 2 is identical to that in Embodiment 1 as well as Example 1, and therefore, it is not explained here.

Functional blocks of Example 2 is the same as those of Example 1, but the authenticating unit 8713, the group sheet usage recording unit 8717 and the section managing unit 8719 have different functions. Thus, function differences of these units are explained here.

The authenticating unit 8713 maintains a record of personal authentication information of a user, and executes an authentication based on the personal authentication information before a user uses this apparatus, and allows the user to use this apparatus only if the user is authenticated. The authenticating unit 8713 receives a user ID and a password input by a user from the operation unit 400, and calculates a hash value of the password, and identifies a record that contains a same user ID as the input user ID, and determines whether or not the hash value of the input password is the same as that in the record in Table 6. If it determines that the hash value of the input password is the same as that in the record in Table 6, then the authenticating unit 8713 allows the user to use this apparatus.

The group sheet usage recording unit 8717 maintains respective records of consuming sheets by the user. The records are associated with personal authentication information (i.e. a user ID and a password).

The section managing unit 8719 associates the personal authentication information with section information (e.g. a section name or a section ID) of a section that the user belongs, and associates the section information with one of the groups, and maintains a record of the association together with the records maintained by the group sheet usage recording unit.

Table 6 shows records maintained by the section managing unit 8719.

The respective records in Table 6 are maintained for users. For example, the first record in Table 6 contains a user name "SUMIO MARUYAMA", a user ID "a1818", a hash value of a password "Xedd899%6d3#", a group "A" as a group available for this user, a user section "Development department" of this user, and the total number of consumed sheets "120" of this user.

As mentioned above, the personal authentication and the personal sheet usage management are performed in Example 2.

Advantages of Example 2

In Example 2, a management for each user can be performed, in addition to advantages of Example 1.

In Example 1, users in a user section shares section authentication information: a section ID and a password, and therefore, the more users are in the user section, the more liable the section authentication information is to be leaked out. In Example 2, since a unique ID and a unique password are set for each user, its security is increased, and it is easy to identify a leakage path of the personal authentication information if the personal authentication information is leaked out.

In Embodiment 9, the image forming apparatus 1 is an example of a relatively high performance image forming apparatus. This invention is not limited to this embodiment, and it can also be applied to an image forming apparatus without optional parts and units such as the document feeding part 600, the document scanning unit 500 and the postprocessing part 300.

In Example 1 and Example 2, the IDs and the passwords are input by operating the operation unit 400. Alternatively, these IDs and passwords may be read out from an ID card such as RFID (Radio Frequency Identification), IC card, or magnetic card. Alternatively, another authentication method such as biometric authentication may be performed.

Further, in Example 1 and Example 2, the authenticating unit 8713 performs the authentication. Alternatively, the apparatus may not have the authenticating unit 8713, and a group of sheet storage units to be used may be selected by a user input without any authentication.

Further, in Example 1 and Example 2, the section managing unit 8719 maintains records of consuming sheets in groups, in association with section information or personal information. Alternatively, the apparatus may not have the section managing unit 8719, and if it does not have the section managing unit 8719, then the group sheet usage recording unit 8717 may record consuming sheets of each group corresponding to each user section.

TABLE 6

| # | NAME | USER ID | PASSWORD | GROUP | USER SECTION | TOTAL NUMBER OF CONSUMED SHEETS |
|---|---|---|---|---|---|---|
| 1 | SUMIO MARUYAMA | a1818 | Xedd899%6d3# | A | DEVELOPMENT DEPT | 120 |
| 2 | ICHIRO KADOKAWA | c3246 | iUyh(7%4$lop | B | GENERAL AFFAIRS DEPT | 80 |
| 3 | MARUKO KADOTA | k8764 | okIM*7^&gr#R | A | DEVELOPMENT DEPT | 60 |

Embodiment 10

Hereinafter, an image forming apparatus of Embodiment 10 is explained.

Example 1

In the following part, an image forming system is explained. This image forming system has an image forming apparatus of Example 1, and other image forming apparatuses. In Example 1 of Embodiment 10, the image forming system does not have a print server.

[Machine Configuration]

A mechanical configuration of the image forming apparatus in Example 1 of Embodiment 10 is identical to that in Embodiment 1, and therefore, it is not explained here.

[Functional Blocks]

A functional block diagram of the image forming apparatus in Example 1 of Embodiment 10 is identical to that in Embodiment 4 (i.e. in FIG. 12), and therefore, it is not explained here.

[Network Configuration]

Figure 33:
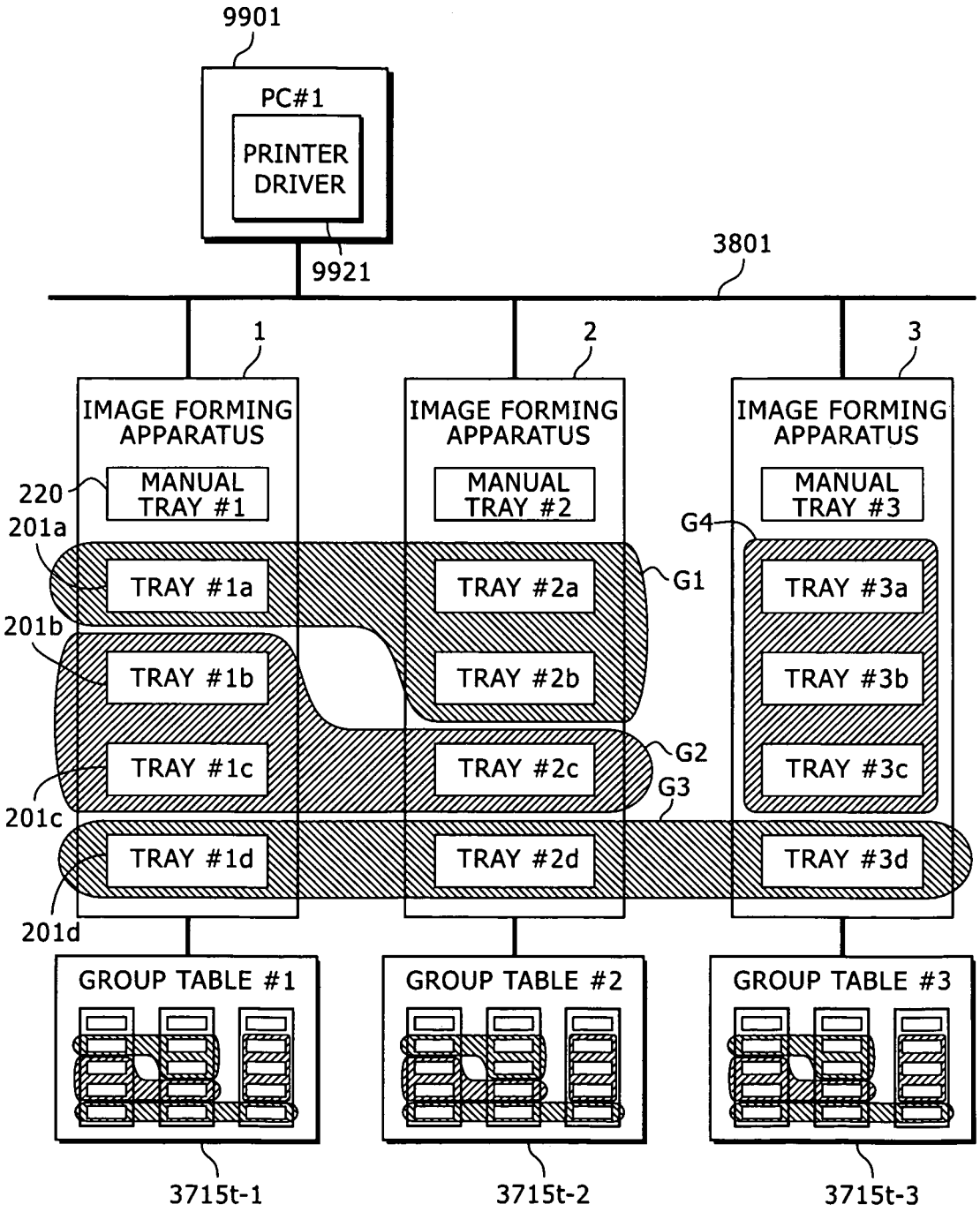
FIG. 33 shows a network configuration of image forming apparatuses without a management server according to Embodiment 10 of this invention.

FIG. 33 shows a network configuration of image forming apparatuses in Example 1. Three image forming apparatuses (i.e. the image forming apparatus 1, an image forming apparatus 2, and an image forming apparatus 3), of which each has the same configuration, are connected via the network 3801 to each other.

A PC#1 9901 is connected to the network 3801, and a printer driver 9921 in the PC#1 9901 generates and transmits a print job to one of the image forming apparatuses (e.g. the image forming apparatus 1).

Operations of the image forming apparatuses in Example 1 are the same as those of Embodiment 4, and therefore, it is not explained here.

Advantages of Example 1

In this system of the image forming apparatuses connected via the network, a print job is divided and executed by the image forming apparatuses in parallel. Therefore, a time for printing is reduced to a short time as divided by the number of the image forming apparatuses.

Example 2

In Example 2 of Embodiment 10, a print server performs a group management and a division of a print job.

[Machine Configuration]

A mechanical configuration of the image forming apparatus in Example 2 of Embodiment 10 is identical to that in Example 1 of Embodiment 10, and therefore, it is not explained here.

[Functional Blocks and Network Configuration]

Figure 34:
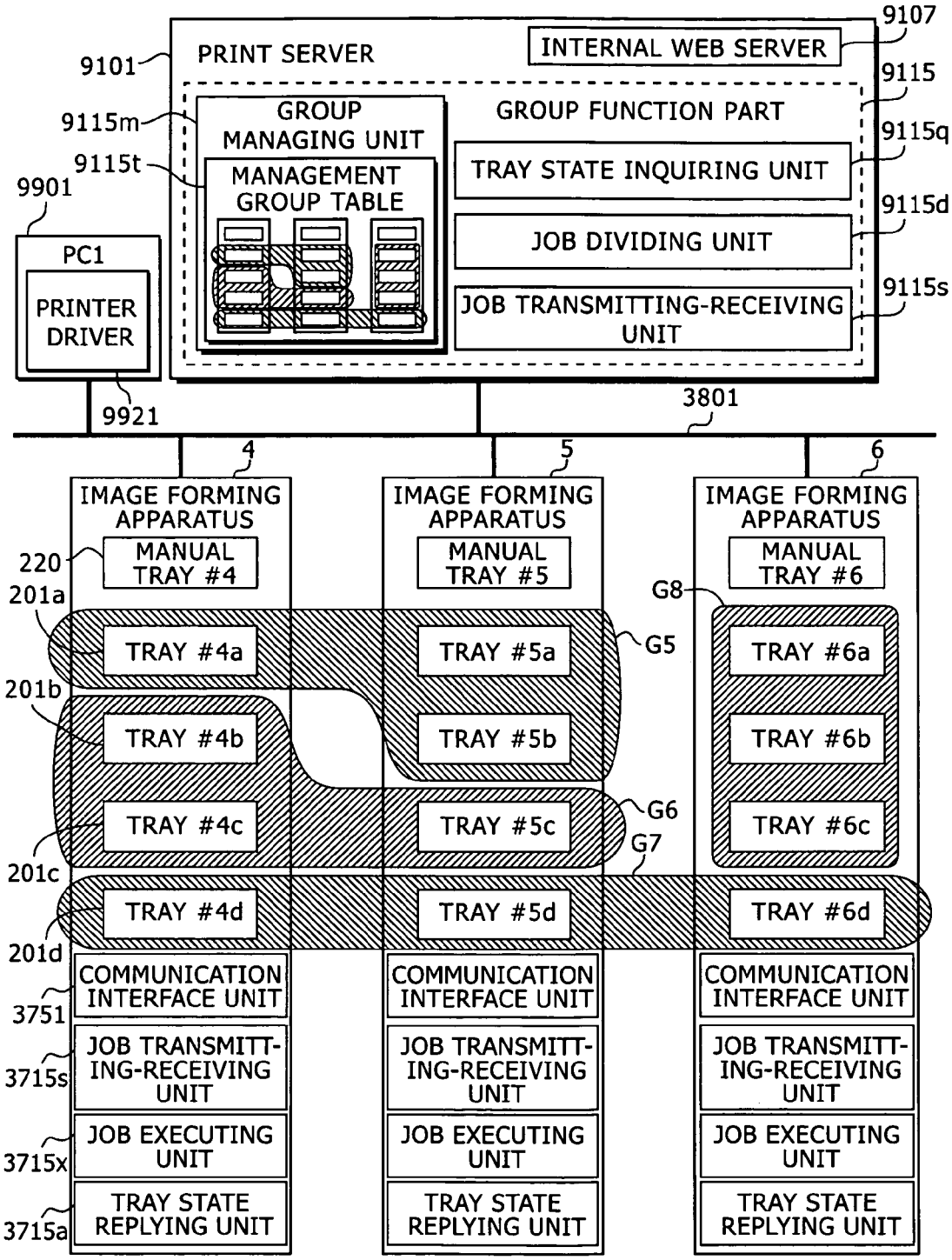
FIG. 34 shows a network configuration of image forming apparatuses with a management server according to Embodiment 10 of this invention.

With reference to FIG. 34, functional blocks and a network configuration in the image forming system of Example 2 are explained. In the image forming system of Example 2, since a print server 9101 manages groups of sheet storage units, each of image forming apparatuses has a relatively simpler configuration than that of Example 1. The functional blocks of the image forming apparatus are also explained with reference to FIG. 34.

As shown in FIG. 34, pluralities of image forming apparatuses 4, 5 and 6 are connected via the network 3801 to the print server 9101. Each of the image forming apparatuses 4, 5 and 6 has the same configuration.

In Example 2, the image forming apparatus 4 has a sheet storage unit 201*a* (that is, TRAY #4*a* in FIG. 34), a sheet storage unit 201*b* (that is, TRAY #4*b* in FIG. 34), a sheet storage unit 201*c* (that is, TRAY #4*c* in FIG. 34), and a manual sheet feeding tray 220 (that is, MANUAL TRAY #4 in FIG. 34), as well as the image forming apparatus 1 in Embodiment 4.

Further, the image forming apparatus 4 also has a communication interface 3751, a job transmitting-receiving unit 3715*s*, a job executing unit 3715*x*, and a tray state replying unit 3715*a*, as well as the image forming apparatus 1 in Embodiment 4.

The image forming system of Example 2 has a network configuration that contains the print server 9101, though the image forming system of Example 1 does not have the print server 9101.

The print server 9101 has an internal web server 9107, and a group function part 9115. The group function part has a group managing unit 9115*m*, a tray state inquiring unit 9115*q*, a job dividing unit 9115*d*, and a job transmitting-receiving unit 9115*s*.

The group managing unit 9115*m* maintains a management group table 9115*t* that contains group setting information. In Example 2, the management group table 9115*t* contains the group setting information of groups G5, G6, G7 and G8 as well as the groups G1 to G4 of Example 1. The groups G5, G6 and G7 are network groups, and the group G8 is not a network group, that is, has sheet storage units in only one of the image forming apparatuses.

The group managing unit 9115*m* may generate the management group table 9115*t* based on necessary information (e.g. configuration and settings of sheet storage units in the image forming apparatuses). The print server 9101 may communicate with the image forming apparatuses to obtain the necessary information.

This information is obtained in the same way as that explained for forming groups shown in FIG. 16. Since the print server 9101 manages groups, the image forming apparatus may not transmit such information to the other image forming apparatuses, but only transmit it to the print server 9101. As a result, burdens of the image forming apparatuses on a group management and communication for the group management are reduced. The print server 9101 has the management group table 9115*t*, and therefore, the image forming apparatuses may not perform a group management. In another example, it is possible to add a print server to the image forming system of Example 1 in which the image forming apparatuses perform a group management.

The tray state inquiring unit 9115*q* sends an inquiry to each of the image forming apparatuses to inquire a state of a sheet storage unit in a group. Specifically, it inquires whether or not each of the sheet storage units in the group has a correct sheet (i.e. a sheet with a correct sheet size, a correct sheet type, and so on), and whether or not each of the sheet storage units in the group has sheets of paper more than an expected usage amount for printing.

The job dividing unit 9115*d* divides a print job into divisional print jobs to perform parallel printing in the image forming apparatuses. The number of the divisional print jobs is the same as the number of the image forming apparatuses. An original print job is generated by a printer driver of a host computer such as the printer driver of the PC#1 9901, and transmitted via the network 3801 to the print server 9101. The job dividing unit 9115*d* of the print server 9101 divides the original print job into divisional print jobs. The number of the divisional print jobs is the same as the number of the available image forming apparatuses. The tray state inquiring unit

9115*q* sends inquiries to image forming apparatuses that have sheet storage units in a group (e.g. the group G7 in FIG. 34) in advance. Image forming apparatuses that reply that it is available for printing to the inquiries are identified as the available image forming apparatuses.

The job transmitting-receiving unit 9115 has a function for receiving a print job from the PC#1 9901 (as a job receiving unit), and a function for transmitting the divisional print jobs to the image forming apparatuses (as a job transmitting unit).

The internal web server 9107 transmits a state and/or settings of the print server, and/or a current execution state of a print job to an external device (e.g. a browser of the PC#2 9903) in order to confirm them in the external device. In this example, while a user accesses the internal web server 9107 by the external device, the user may input instructions for forming a group from sheet storage units of image forming apparatuses.

[Forming a Group from Sheet Storage Units]

In Example 2, for forming a group, a user interface screen as shown in FIG. 16 is displayed on a browser that receives information to necessary to display it from the internal web server 9107. This browser is the browser 3913, a browser in the printer watching utility 3911, or the like. This browser may be a browser not in a PC, but in the image forming apparatuses.

[Flowchart]

Figure 35:
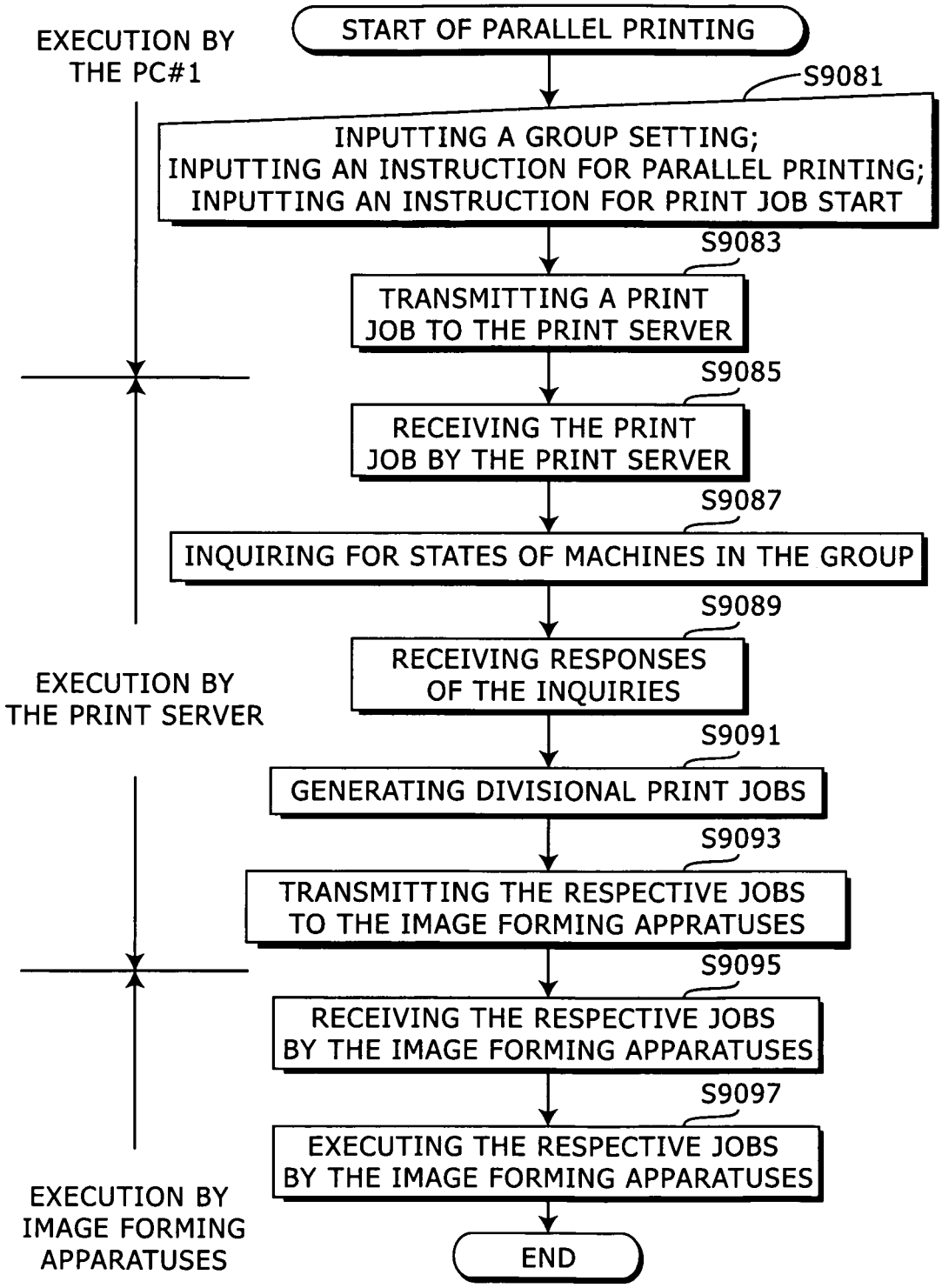
FIG. 35 shows a flowchart of operations for printing in parallel by the image forming apparatuses according to Embodiment 10 of this invention.

With reference to FIG. 35, operations of the print server in Example 2 are explained.

The printer driver 9921 of the PC#1 9901 as a host computer generates a print job. When the host computer starts parallel printing for the print job, the process shown in FIG. 35 is started.

Step S9081: A user inputs a group setting to the PC#1 9901 to form a group of sheet storage units. Specifically, to form a group, the user may use a browser to access the internal web server 9107, and may input a group setting to a group setting screen shown in FIG. 16 displayed in the browser. Alternatively, the user may directly specify a group setting via the printer driver 9921. The user also inputs an instruction for parallel printing. Further, the user selects a document to be printed, and inputs an instruction to start printing.

Step S9083: The printer driver 9921 of the PC#1 9901 generates a print job of the document specified in Step S9081, and transmits the print job to the print server 9101 with the group setting.

Step S9085: In and after Step S9085, the print server 9101 executes the following process. The job transmitting-receiving unit 9115*s* receives the print job and the group setting at the same time. The group setting may have been set before the print job is generated and transmitted. If one or more groups have been formed before the print job is generated, then the user may choose one of the one or more groups when the print job is generated.

Step S9087: The tray state inquiring unit 9115*q* sends an inquiry to each of image forming apparatuses that have sheet storage units in a group specified in the group setting, in order to inquire whether or not each of the sheet storage units is available for executing this print job.

Step S9089: The tray state inquiring unit 9115*q* receives replies from the image forming apparatuses.

Step S9091: The job dividing unit 9115*d* divides the print job received from the PC#1 9901 into divisional print jobs of which the number is the same as the number of the image forming apparatuses that reply that the specified sheet storage unit is available for printing. The print job is divided in the same way as that in Steps S3031 to S3035 of FIG. 18, and therefore, it is not explained in detail here.

Step S9093: The job transmitting-receiving unit 9115*s* transmits the respective divisional print jobs to the image forming apparatuses that reply that the specified sheet storage unit is available for printing Step S9095: In and after Step S9095, the image forming apparatuses execute the following process. Each of the image forming apparatus (e.g. the image forming apparatuses 4 to 6 in FIG. 34) receives one of the divisional print jobs. Specifically, the job transmitting-receiving unit 3715*s* of the image forming apparatus receives the divisional print job via the communication interface 3751.

Step S9097: The job executing unit 3715*x* in the image forming apparatus executes the divisional print job received in Step S9095 until it ends.

According to the aforementioned operations, the print server 9101 manages groups of sheet storage units, and the print server 9101 divides a print job into divisional print jobs, and two or more of the image forming apparatuses 4 to 6 receive and execute the divisional print job, respectively. As a result, the system performs parallel printing.

In this example, if sheet empty occurs while the divisional print job is being executed in Step S9097, then the process shown in FIG. 19 may be executed to continue executing the divisional print job.

Advantages of Example 2

In the image forming system of Example 2, the print server 9101 performs a group management of sheet storage units. Therefore, the image forming apparatuses 4, 5 and 6 are not required to perform the group management. As a result, a configuration of the system can be reduced.

Further, the print server 9101 performs a group management and dividing a print job. Therefore, the image forming apparatuses do not need to perform them, and therefore, average image forming apparatuses without functions to perform them can be used for parallel printing in this system. As a result, burdens are reduced in CPUs and memories in the image forming apparatuses, and therefore printing performance by the CPUs and the memories is increased. In addition, in this case, burdens on communication for managing the group tables are reduced.

In Embodiment 10, the image forming apparatus 1 is an example of a relatively high performance image forming apparatus. This invention is not limited to this embodiment, and it can also be applied to an image forming apparatus without optional parts and units.

In Embodiment 10, the printer driver 9921 of the host computer PC#1 9901 generates a print job. Alternatively, one of the image forming apparatuses may generate a print job, for example, in order to print a document scanned by the document scanning unit 500. In Example 1, to print a scanned document, the job dividing unit in the image forming apparatus that scans the document can divide a print job of the document into divisional print jobs, and transmit one or more of the divisional print jobs to one or more other image forming apparatuses for parallel printing. In Example 2, to print a scanned document, the image forming apparatus that scans the document can transmit a print job of the document to the print server 9101, and the job dividing unit in the print server 9101 divides the print job into divisional print jobs, and the divisional print jobs are transmitted to image forming apparatuses for parallel printing.

Further, in Embodiment 10, the number of image forming apparatuses available for parallel printing is identified, and a print job is divided into divisional print jobs of which the number is the same as the identified number of the image forming apparatuses, and the divisional print jobs are transmitted to the available image forming apparatuses, respectively. Therefore, it is prevented to transmit a divisional print job to the image forming apparatus that can not execute the divisional print job.

In Embodiment 10, a group can be formed from sheet storage units among image forming apparatuses connected via electronic communication channels to each other. Further, in Embodiment 10, image forming apparatuses that have sheet storage units in a group performs parallel printing for a print job, and therefore, the print job is finished in a short time. Further, in Embodiment 10, the print server performs a group management and dividing a print job. Therefore, the image forming apparatuses do not need to perform them, and average image forming apparatuses without functions to perform them can be used for parallel printing in this system. As a result, burdens are reduced in CPUs and memories in the image forming apparatuses, and therefore printing performance by the CPUs and the memories is increased. In addition, in this case, burdens on communication for managing the group tables are reduced.

The description of the present invention has been presented for purposes of illustration and description, and is not intended to be exhaustive or limited to the invention in the form disclosed. Many modifications and variations will be apparent to those of ordinary skill in the art.

What is claimed is:

1. An image forming apparatus, comprising:

pluralities of sheet storage units;

a printing unit;

a sheet driving unit that feeds a sheet of paper from the sheet storage units to the printing unit;

a group setting maintaining unit that forms a group of the sheet storage units;

a residual sheet amount detecting unit that detects sheet empty on any of the sheet storage units in the group;

a sheet storage switching control unit that controls the sheet driving unit to select another one of the sheet storage units in the same group for feeding a sheet, if the residual sheet amount detecting unit detects the sheet empty; said sheet driving unit to select one of the sheet storage units that has the least number of residual sheets in the same group next a sheet empty warning unit that warns a user of the sheet empty detected by the residual sheet amount detecting unit; and the sheet empty warning unit issues a first warning that warns that one of the sheet storage units is empty and issues a second warning that warns a user that only one of the sheet storage units in a group has a sheet;

a sheet attribution detecting unit that detects one or more sheet attributions of sheets stored in the sheet storage units;

an attribution consistency determining unit that determines whether or not a sheet attribution of a sheet stored in one of the sheet storage units in the group is same as a sheet attribution of a sheet stored in other ones of the sheet storage units; and wherein said group setting unit automatically forms the group according to a sheet attribution of sheets stored in the sheet storage units and removes a sheet storage unit with an inconsistent sheet attribution from the group.

2. The image forming apparatus according to claim 1, wherein:

the sheet empty warning unit notifies at least one of a display unit in this image forming apparatus, an internal web server and a printer watching utility in an external device of the sheet empty.

* * * * *